US005392098A

United States Patent [19]

Ehara et al.

[11] Patent Number: 5,392,098

[45] Date of Patent: Feb. 21, 1995

[54] ELECTROPHOTOGRAPHIC APPARATUS WITH AMORPHOUS SILICON-CARBON PHOTOSENSITIVE MEMBER DRIVEN RELATIVE TO LIGHT SOURCE

[75] Inventors: Toshiyuki Ehara; Koji Yamazaki; Shigenori Ueda; Hitoshi Murayama, all of Nagahama, Japan

[73] Assignee: Canon Kabushiki Kaisha, Tokyo, Japan

[21] Appl. No.: 891,176

[22] Filed: May 29, 1992

[30] Foreign Application Priority Data

| | | | |
|---|---|---|---|
| May 30, 1991 | [JP] | Japan | 3-153684 |
| May 30, 1991 | [JP] | Japan | 3-153733 |
| May 30, 1991 | [JP] | Japan | 3-153737 |
| May 30, 1991 | [JP] | Japan | 3-153763 |
| May 30, 1991 | [JP] | Japan | 3-153780 |
| May 30, 1991 | [JP] | Japan | 3-153790 |

[51] Int. Cl.[6] ..... G03G 15/02

[52] U.S. Cl. ..... 355/219; 355/211; 355/229

[58] Field of Search ..... 355/210, 211, 219, 228, 355/229, 232; 346/160, 108; 430/56, 57, 69, 272

[56] References Cited

U.S. PATENT DOCUMENTS

| | | | |
|---|---|---|---|
| 4,650,736 | 3/1987 | Saitoh et al. | 430/57 |
| 4,696,884 | 9/1987 | Saitoh et al. | 430/58 |
| 4,705,733 | 11/1987 | Saitoh et al. | 430/57 |
| 4,735,883 | 4/1988 | Honda et al. | 430/69 |
| 4,758,127 | 7/1988 | Imai et al. | 414/411 |
| 4,814,248 | 3/1989 | Kamata et al. | 430/69 |
| 4,864,419 | 9/1989 | Saito et al. | 346/160 X |
| 4,932,859 | 6/1990 | Yagi et al. | 430/57 X |
| 4,943,503 | 7/1990 | Nojima et al. | 430/57 X |
| 5,059,501 | 10/1991 | Yagi et al. | 430/57 X |
| 5,106,711 | 4/1992 | Kawamura et al. | 430/56 |
| 5,141,836 | 8/1992 | Shirai et al. | 430/128 |
| 5,172,132 | 12/1992 | Haneda et al. | 346/108 X |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

An electrophotographic apparatus includes an amorphous silicon electrophotographic photosensitive member thereon having a conductive base, a photoconductive layer thereon containing carbon atoms, a content of which is minimum adjacent a position closest to the surface layer and/or other atoms, and a surface layer thereon containing 40–90 atomic % of carbon atoms and/or other atoms; a light source for electric discharge driven through a pulse width modulation using a reference wave having a frequency of not higher than 10 kHz; a device for projecting information light onto the photosensitive member; and a driver for driving the photosensitive member relative to the light source at such a speed that a peripheral speed of the photosensitive member divided by the frequency of the reference wave is not more than 1 mm.

6 Claims, 55 Drawing Sheets

TYPE 1

TYPE 2

TYPE 3

ELECTROPHOTOGRAPHIC APPARATUS WITH AMORPHOUS SILICON-CARBON PHOTOSENSITIVE MEMBER DRIVEN RELATIVE TO LIGHT SOURCE

FIELD OF THE INVENTION AND RELATED ART

The present invention relates to an electrophotographic apparatus and more particularly to a main discharging exposure of an amorphous silicon photosensitive member having a conductive base, a photoconductive layer thereon and a surface layer thereon to improve a potential stability, to prevent a light memory and to suppress unevenness of the image density.

The amorphous silicon photosensitive member is used in a high speed copying machine or a laser beam printer (LBP) or the like as an electrophotographic photosensitive member because it has a high surface hardness, a high sensitivity to a long wavelength light such as those produced by a semiconductor laser (770–800 nm) and is hardly deteriorated even if it is repeatedly used.

FIG. 60 is a schematic sectional view of a typical amorphous silicon photosensitive member. The amorphous silicon photosensitive member ("a-Si photosensitive member") comprises a conductive supporting member or base 201 of aluminum, a charge injection preventing layer 202 on the surface of the conductive base 201, a photoconductive layer 203 and a surface layer 204. Here, the charge injection preventing layer 201 functions to prevent charge injection from the conductive base 201 to the photoconductive layer 203, and is not always required. The photoconductive layer 203 comprises at least amorphous material containing silicon atom and exhibits a photoconductivity. The surface layer 204 comprises silicon atom and carbon atom (hydrogen atom and/or halogen atom, as desired). The surface layer 204 functions to retain a visualized image thereon in an electrophotographic apparatus. Generally, a combination of the photoconductive layer 203 and the charge injection preventing layer 202, is called "photoconductive layer". In the following description, the charge injection preventing layer 202 is omitted for the purpose of simplicity of explanation, except for the case in which the provision of the charge injection preventing layer 202 is influential to the effects.

FIG. 61 is a schematic view of a major part of a conventional electrophotographic apparatus using a-Si photosensitive member. In this apparatus, the a-Si photosensitive member 101 covers the entire circumferential surface of a cylindrical drum 100. Around the a-Si photosensitive member 101, there are disposed a primary charger 102 for uniformly charging the photoconductive layer 203 of the a-Si photosensitive member 101, image information supplying means (not shown) for producing exposure light 103 in accordance with image information to become a latent image, a developing device 104 for developing the electrostatic latent image into a visualized image, a transfer charger (not shown) for transferring the visualized image onto a transfer material, separating means (not shown) for separating the transfer material from the a-Si photosensitive member 101, a cleaning device 105 and a primary discharging light source 106, adjacent the surface of the a-Si photosensitive member 101, in the order named in the direction of X (along the circumferential of drum 100) with predetermined spaces therebetween.

Here, the diameter of the a-Si photosensitive member 101 is at most 80–120 mm. Therefore, in the case of the electrophotographic apparatus using the a-Si photosensitive member 101, in order to compensate for the low charging property which is the peculiar to the a-Si photosensitive member, a large main charging device 102 is required, and in addition, in order to compensate for the dark decay of the a-Si photosensitive member 101, it is desired that the developing device 104 is disposed closely to the main charger 102. These make the arrangements of the devices around the photosensitive member difficult. In addition, based on the recent demand for the high speed copying machine, it is difficult to provide a sufficiently large space between the main charging device 102 to the main discharging light source 106.

As for the main discharging light source 106, an array of LED which can strictly control the wavelength and the light quantity of the light therefrom, is used from the standpoint of removing the light memory (ghost phenomenon), retaining the charging property and suppressing the potential shift. Because of the limited spaces, the array is usually disposed between the cleaning device 105 and the main charger 102 as in the case of another photosensitive member (Se, OPC or the like). As for the actuating system for the main discharging light source 106, a conventional DC system is used, and the light quantity of the main discharging light is adjusted by a resistor connected in series thereto. Therefore, even if the wavelength and the light quantity of the main discharging light is changed, the charging power and the potential shift are equivalent if the light memory level is equivalent. However, in view of the above factors, the light quantity of the main discharging light has to be decreased at the cost of permitting the increase of the light memory level such as ghost, in some cases.

The a-Si photosensitive member 101 has a number of dangling bonds, which function as localized levels to trap a part of photo-carriers to deteriorate the mobility thereof, or to decrease the recombination possibilities of the photo-generated carriers. Therefore, a part of the photo-carriers generated by the exposure during the image formation process is released from the localized levels simultaneously with the application of the electric field to the a-Si photosensitive member 101 during the next charging process, which results in a surface potential difference between the exposed portion and the nonexposed portion of the a-Si photosensitive member 101. This difference appears in a final image as the unevenness attributable to the light memory.

Under the circumstances, the light memory (ghost) is usually removed by the uniform exposure by the main discharging step to overproduce the photo-carriers latently existing in the a-Si photosensitive member 101 to provide uniformity over the whole surface. In this case, it is possible to effectively remove the light memory (ghost) by increasing the quantity of light of the main discharging light from the main discharging light source 106 or by making the wavelength of the main discharging light close to the peak of the spectral sensitivity (approx. 680–700 nm) of the a-Si photosensitive member 101.

However, in the above-described electrophotographic apparatus, the a-Si photosensitive member 101 has a tendency of easily producing the light memory.

Therefore, if the light quantity of the main discharging light from the main discharging light source 101 is too large or if the wavelength of the main discharging light is increased to approach the spectral sensitivity peak of the a-Si photosensitive member 101, the probability of the generation of the photo-carriers at deep positions of the a-Si photosensitive member 101 in the direction of the thickness thereof, and the remaining rate of the photo-carriers, is increased. If this occurs before the recombination of the over existing photo-carriers latently existing in the a-Si photosensitive member 101, the main discharging step starts which results in remarkable decrease of the charging efficiency. More particularly, since the main discharging step has to include the photo-carrier recombination step and the surface potential increasing step, the amount of the photo-carriers in the a-Si photosensitive member 101 immediately before the start of the charging step is significantly influential to the level of the subsequent surface potential (charging property). In addition, the potential shift phenomenon is increased by which, when the image forming process is repeated continuously under the same conditions, the potential at the developing device 104 gradually decreases. This makes the image density unstable during the copying operation.

For these reasons, it is desirable that the main discharging light projection from the main discharging light source 106 is effected with as small a quantity of light as possible and with as short a wavelength as possible with the wavelength within the ranges capable of erasing the light memory. Further, it is desirable that the charging step is started after almost all of the photo-carriers are recombined. However, even if the level of the photo-memory is maintained equivalent by changing the quantity and wavelength of the main discharging light and the the charging property and the potential shift are also maintained equivalent, the conventional electrophotographic process allows a certain level of ghost image because the charging property, and therefore, the dark potential, has to be assured.

The temperature dependency of the dark potential and the light potential of the a-Si photosensitive member 101 is approximately −2 to −9 V/degree and −1.5 to −4 V/degree. If the temperature of the a-Si photosensitive member 101 increases by 10° C., for example, the dark potential changes by about −20 to −90 V, and the light potential changes by about −15 to −40 V. In view of this, the conventional electrophotographic apparatus is equipped with a drum heater disposed close to the inside surface of the a-Si photosensitive member 101 to control the temperature thereof so as to maintain a constant temperature for the photosensitive member 101. However, when a great number of copies are continuously produced, the heat is transferred from the a-Si photosensitive member 101 to the copy sheets, and it becomes difficult to maintain the constant temperature of the photosensitive member 101. Then, the surface potential of the a-Si photosensitive member 101 changes with the result of variation in the image density. In order to solve this problem, it would be considered that the capacity of the drum heater is increased in the side of the main assembly of the copying machine, and the response in the control system is improved. However, such a solution will result in the increase of the cost of the copying apparatus and the increase of the electric power consumption.

SUMMARY OF THE INVENTION

Accordingly, it is a principal object of the present invention to provide an electrophotographic apparatus using an amorphous silicon photosensitive member exhibiting good total performance.

It is another object of the present invention to provide an electrophotographic apparatus using an amorphous silicon photosensitive member in which the light memory removing power of the main discharging light desirable for the ghost image removal is maximized, and the decrease of the charging property and the potential shift are minimized, and in addition, the potential unevenness in the direction of the generating line of the photosensitive member is reduced.

It is a further object of the present invention to provide an electrophotographic apparatus using an amorphous silicon photosensitive member in which the light memory removing power of the main discharging light desirable for the ghost image removal is maximized, and the decrease of the charging property and the potential shift are minimized, and in addition, the temperature dependency and the potential unevenness in the direction of the generating line of the photosensitive member is decreased.

It is a further object of the present invention to provide an electrophotographic apparatus using an amorphous silicon photosensitive member in which the light memory removing power of the main discharging light desired for the ghost image removal is maximized, and the decrease of the charging property and the potential shift are minimized, and in addition, the temperature dependency and the unevenness in the generating and circumferential directions of the amorphous silicon photosensitive member is decreased.

According to an aspect of the present invention, there is provided an electrophotographic apparatus comprising: an amorphous silicon electrophotographic photosensitive member having a conductive base, a photoconductive layer thereon containing carbon atoms, a content of which is minimum adjacent a position closest to said surface layer and/or other atoms, and a surface layer thereon containing 40–90 atomic % of carbon atoms and/or other atoms; a light source for electric discharge driven through a pulse width modulation using a reference wave having a frequency of not higher than 10 kHz; means for projecting information light onto said photosensitive member; and driving means for driving said photosensitive member relative to the light source at such a speed that a peripheral speed of said photosensitive member divided by the frequency of the reference wave is not more than 1 mm.

These and other objects, features and advantages of the present invention will become more apparent upon a consideration of the following description of the preferred embodiments of the present invention taken in conjunction with the accompanying drawings.

Graph (A) shows an illumination intensity when the duty ratio D is 25%.

Graph (B) shows an illumination intensity when the duty ratio D is 50%.

Graph (C) shows an illumination intensity when the duty ratio D is 100%.

Figure 7:
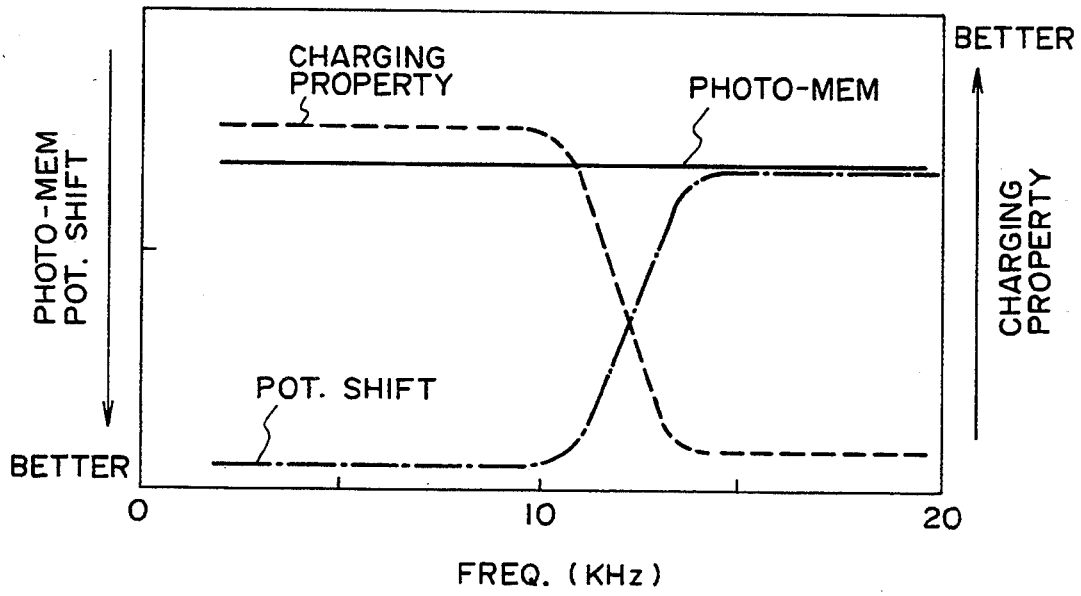

FIG. 7 is a graph showing a result of Experiment 4.

Figure 8A:
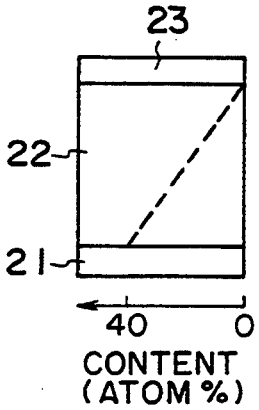
Figure 8B:
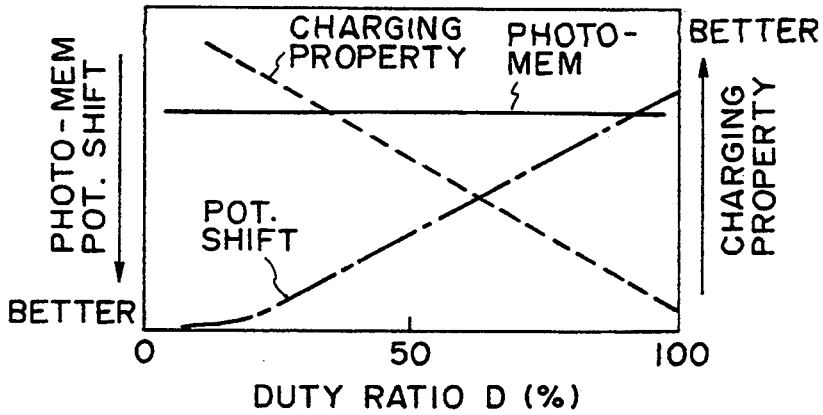
Figure 8C:
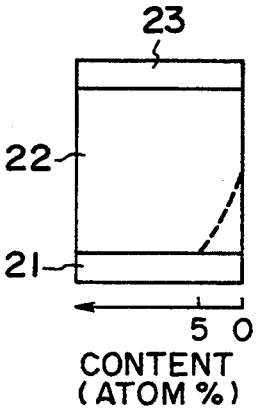
Figure 8D:
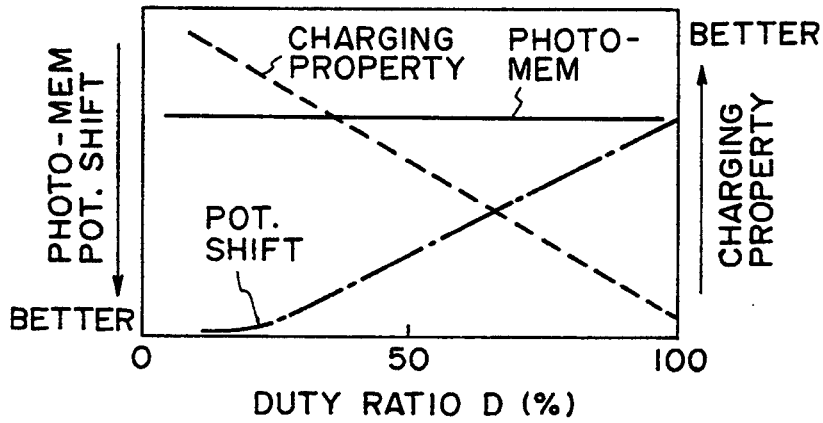
Figure 8E:
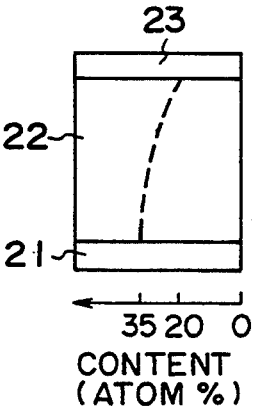
Figure 8F:
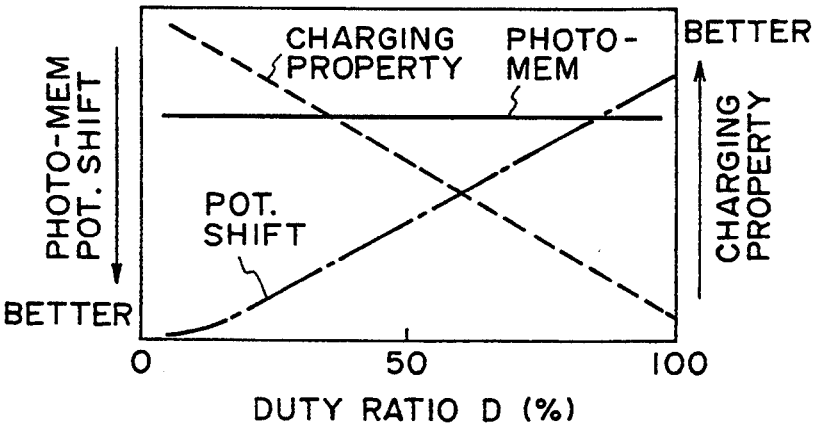

FIGS. 8A–8F are concerned with Experiment 5 in which carbon atom content in the photoconductive layer of a-Si photosensitive member is continuously decreased from the conductive base toward the surface layer. FIGS. 8A, 8C and 8E show the distributions of the carbon atom content, and FIGS. 8B, 8D and 8F show the results of the experiments.

Figure 9A:
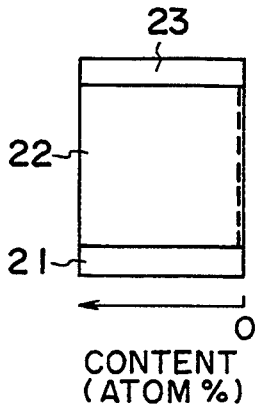
Figure 9B:
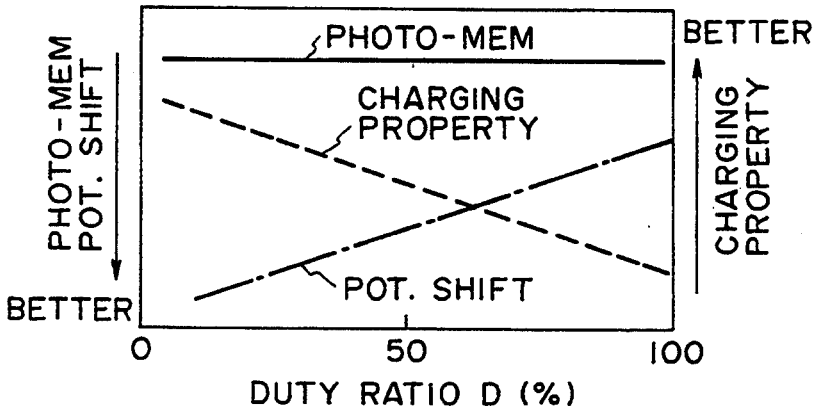
Figure 9C:
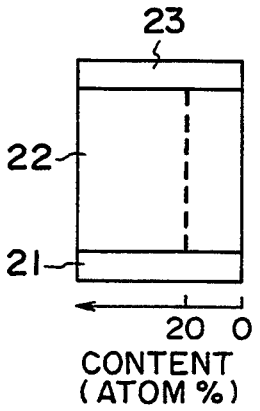
Figure 9D:
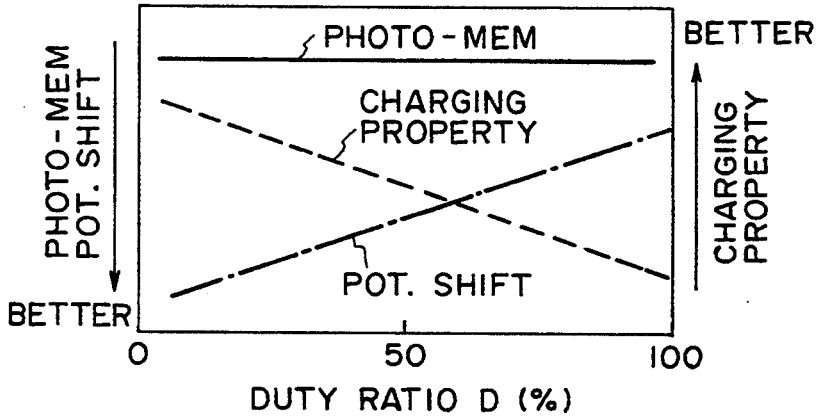
Figure 9E:
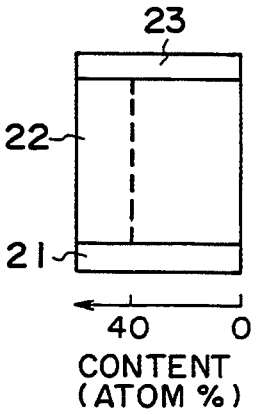
Figure 9F:
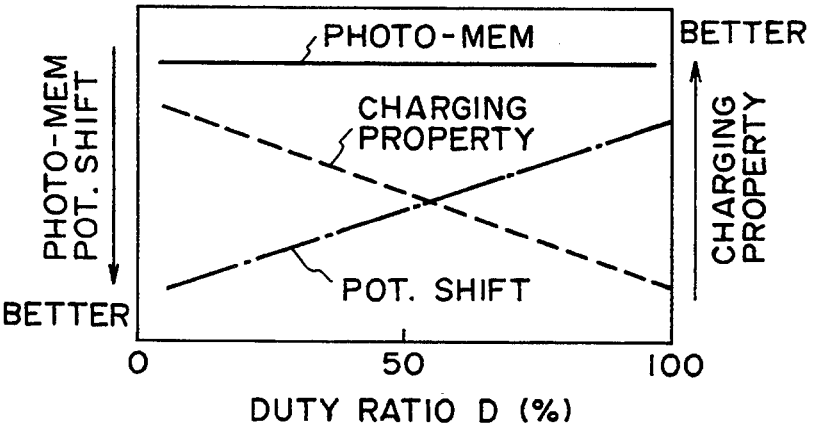

FIGS. 9A–9F are concerned with Experiment 5 in which carbon atom content in the photoconductive layer of a-Si photosensitive member is constant from the conductive base toward the surface layer. FIGS. 9A, 9C and 9E show the distributions of the carbon atom content, and FIGS. 9B, 9D and 9F show the results of the experiments.

Figure 10A:
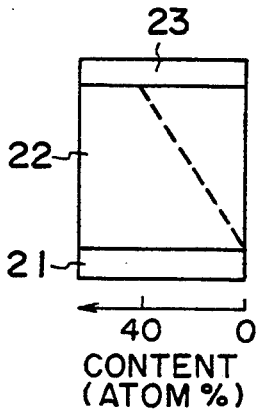
Figure 10B:
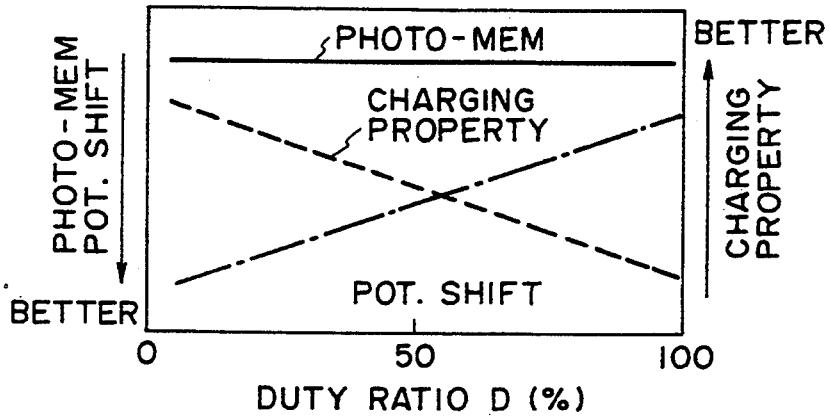
Figure 10C:
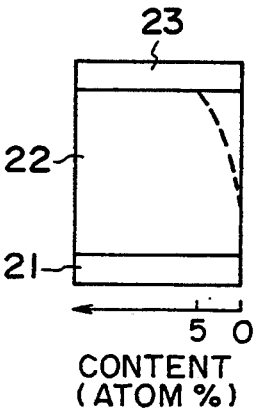
Figure 10D:
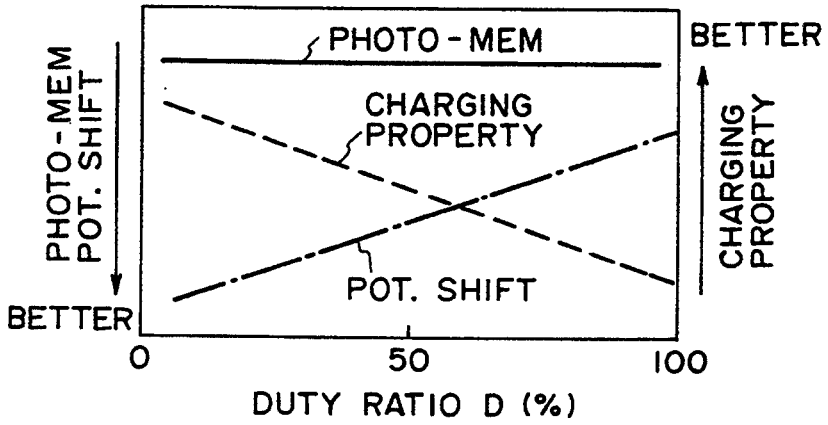
Figure 10E:
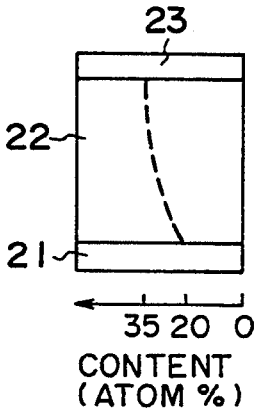
Figure 10F:
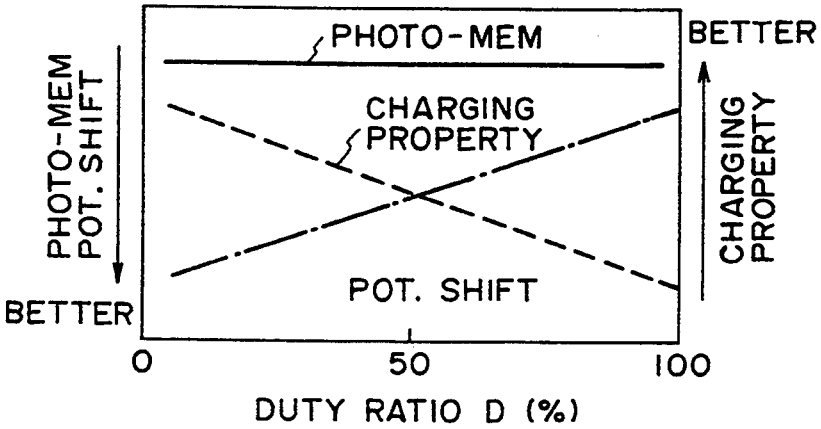

FIGS. 10A–10F are concerned with Experiment 5 in which carbon atom content in the photoconductive layer of a-Si photosensitive member is continuously increased from the conductive base toward the surface layer. FIGS. 10A, 10C and 10E show the distributions of the carbon atom content, and FIGS. 10B, 10D and 10F show the results of the experiments.

Figure 11A:
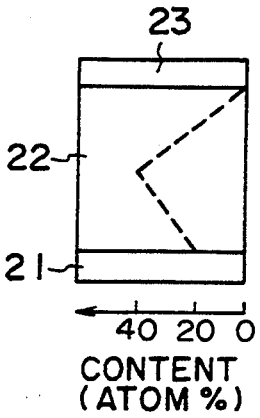
Figure 11B:
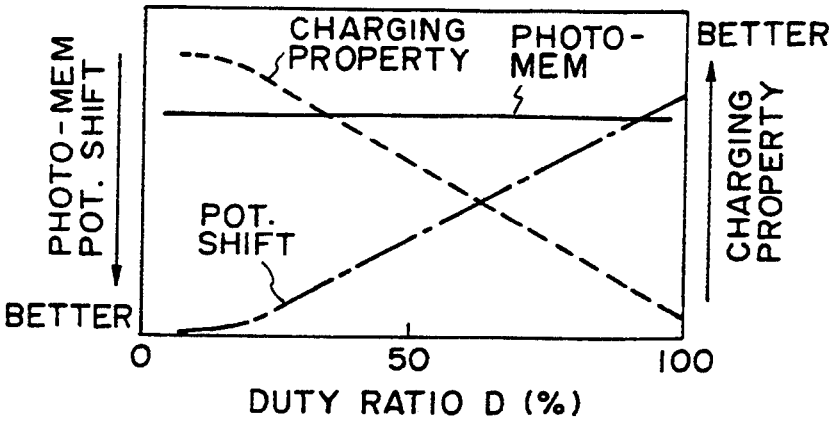
Figure 11C:
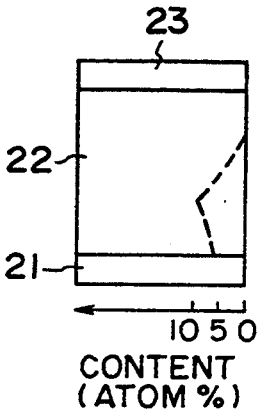
Figure 11D:
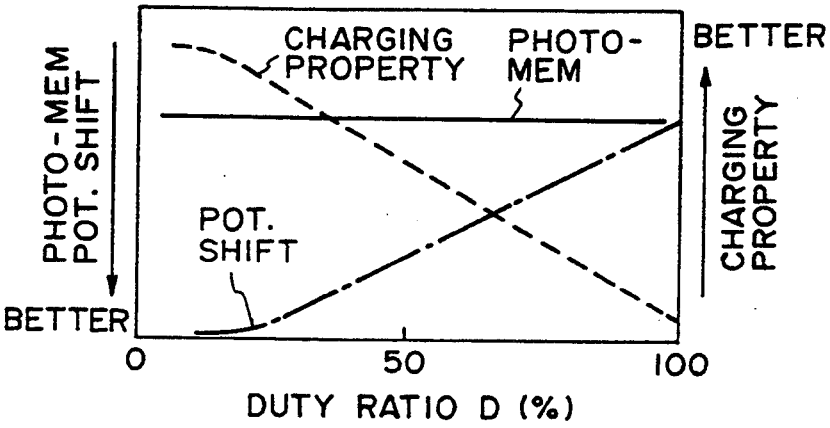
Figure 11E:
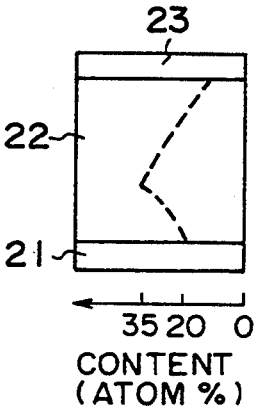
Figure 11F:
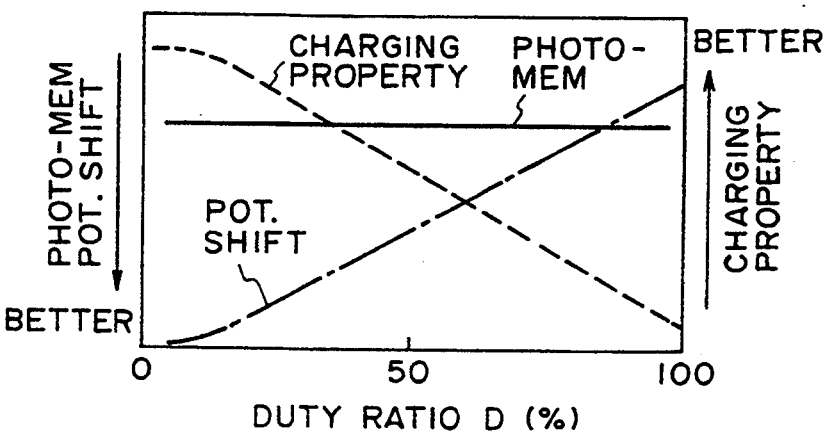

FIGS. 11A–11F are concerned with Experiment 5 in which carbon atom content in the photoconductive layer of a-Si photosensitive member is continuously increased and then decreased from the conductive base toward the surface layer. FIGS. 11A, 11C and 11E show the distributions of the carbon atom content, and FIGS. 11B, 11D and 11F show the results of the experiments.

Figure 12A:
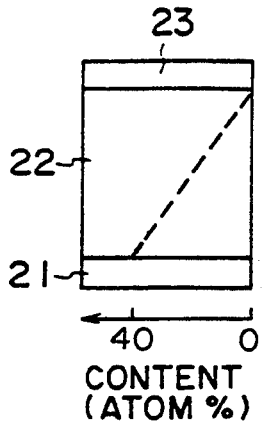
Figure 12B:
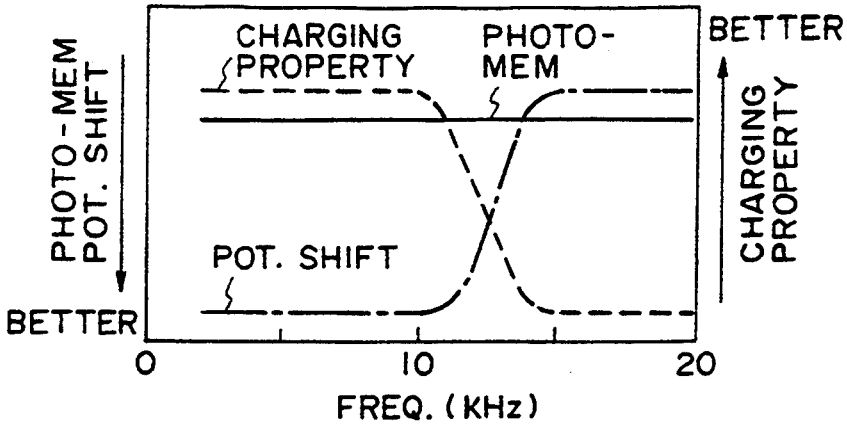
Figure 12C:
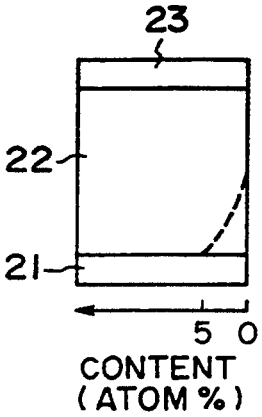
Figure 12D:
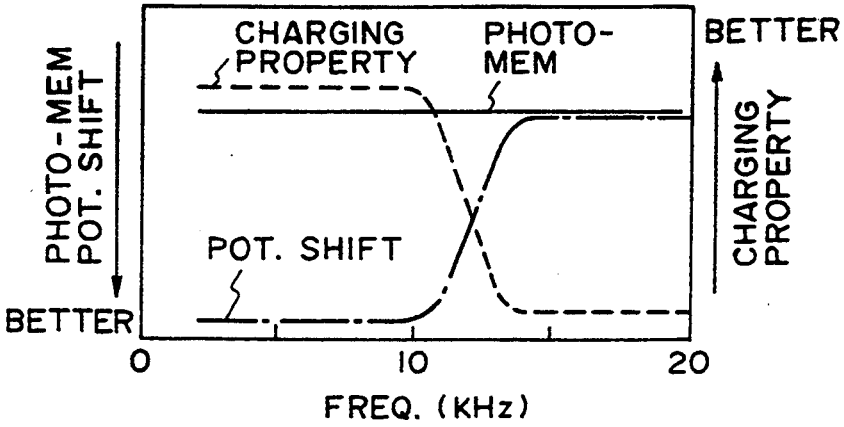
Figure 12E:
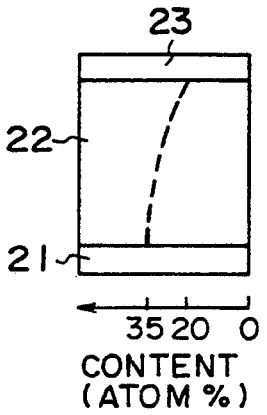
Figure 12F:
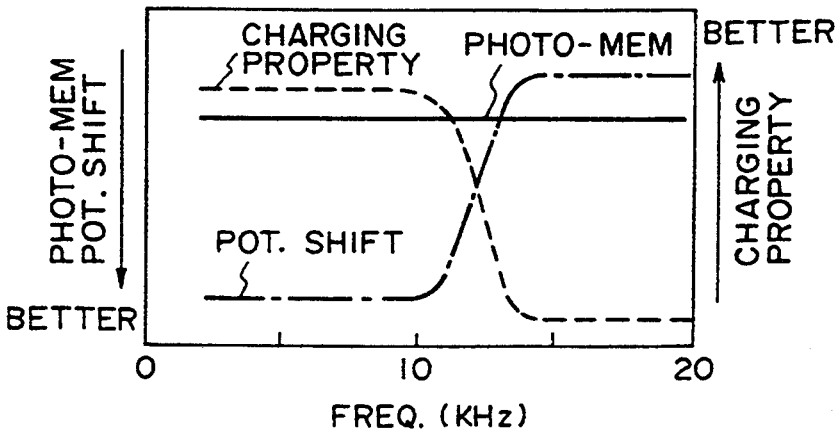

FIGS. 12A–12F are concerned with Experiment 6 in which carbon atom content in the photoconductive layer of a-Si photosensitive member is continuously decreased from the conductive base toward the surface layer. FIGS. 12A, 12C and 12E show the distributions of the carbon atom content, and FIGS. 12B, 12D and 12F show the results of the experiments.

Figure 13A:
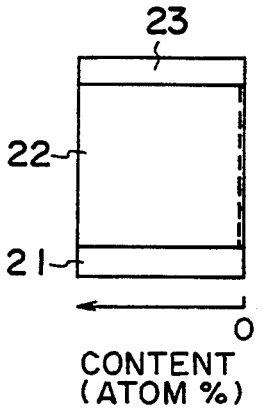
Figure 13B:
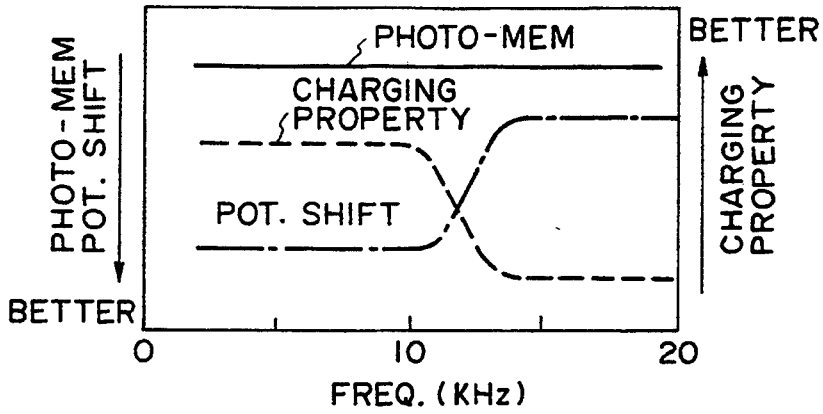
Figure 13C:
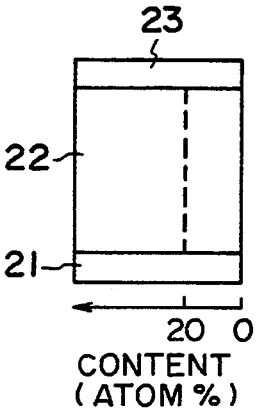
Figure 13D:
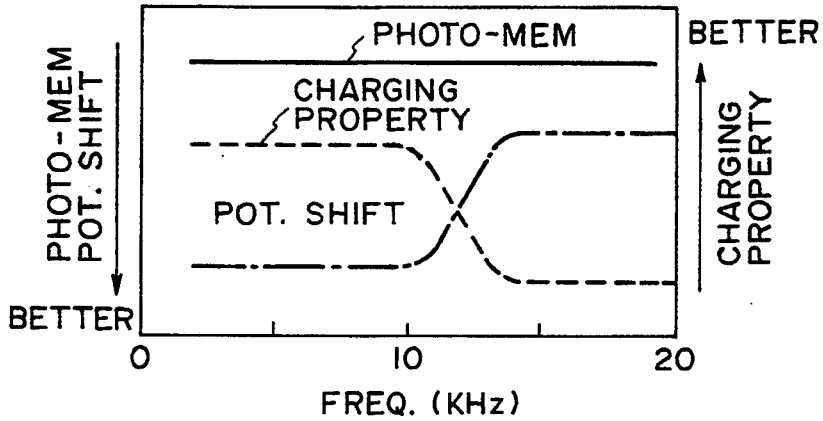
Figure 13E:
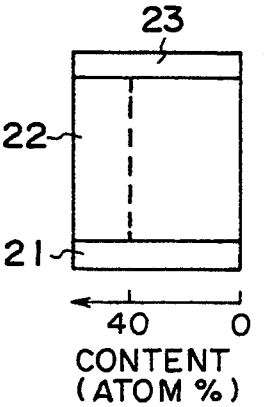
Figure 13F:
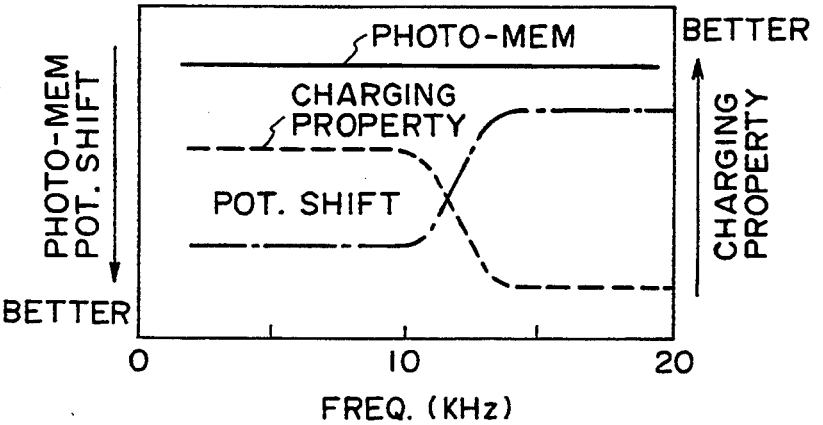

FIGS. 13A–13F are concerned with Experiment 6 in which carbon atom content in the photoconductive layer of a-Si photosensitive member is constant from the conductive base toward the surface layer. FIGS. 13A, 13C and 13E show the distributions of the carbon atom content, and FIGS. 13B, 13D and 13F show the results of the experiments.

Figure 14A:
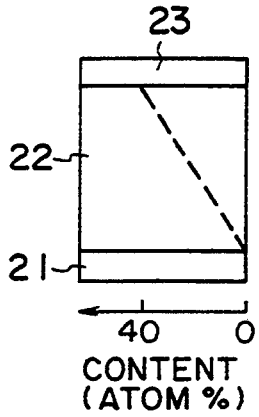
Figure 14B:
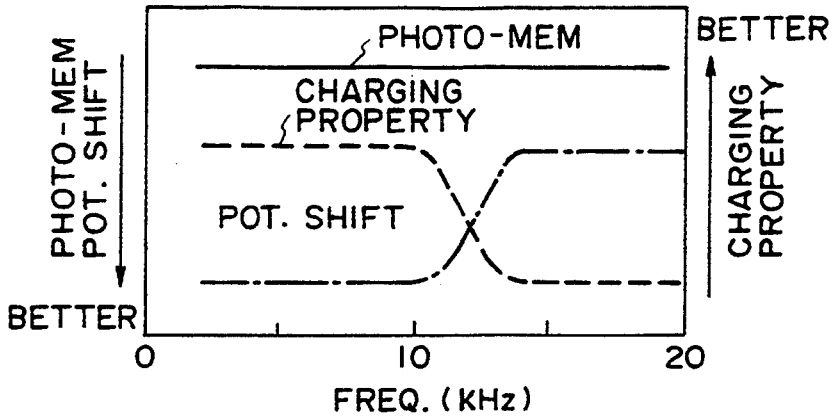
Figure 14C:
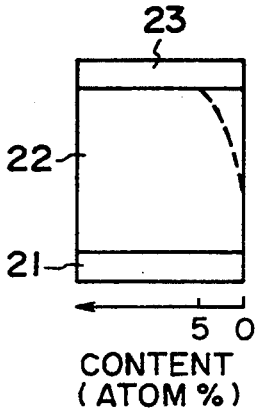
Figure 14D:
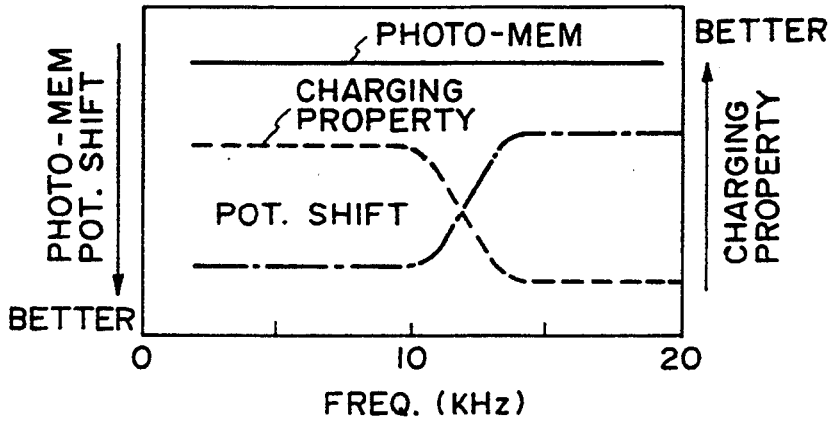
Figure 14E:
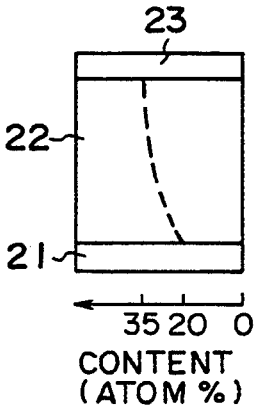
Figure 14F:
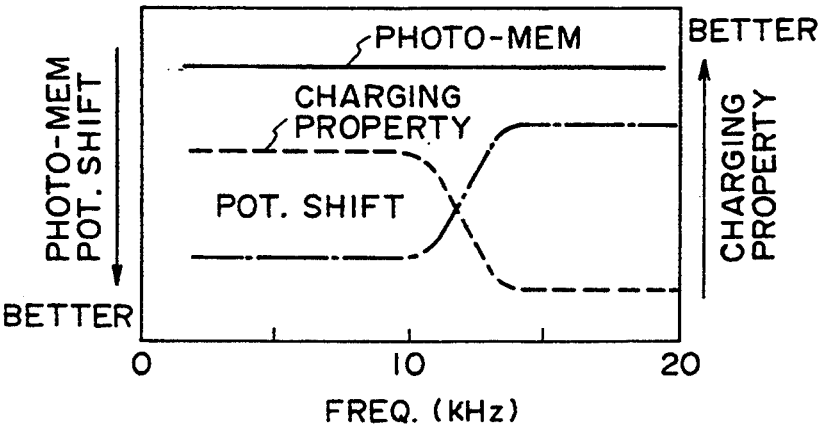

FIGS. 14A–14F are concerned with Experiment 6 in which carbon atom content in the photoconductive layer of a-Si photosensitive member is continuously increased from the conductive base toward the surface layer. FIGS. 14A, 14C and 14E show the distributions of the carbon atom content, and FIGS. 14B, 14D and 14F show the results of the experiments.

Figure 15A:
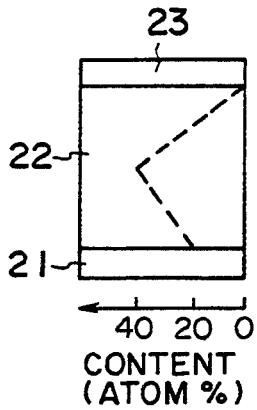
Figure 15B:
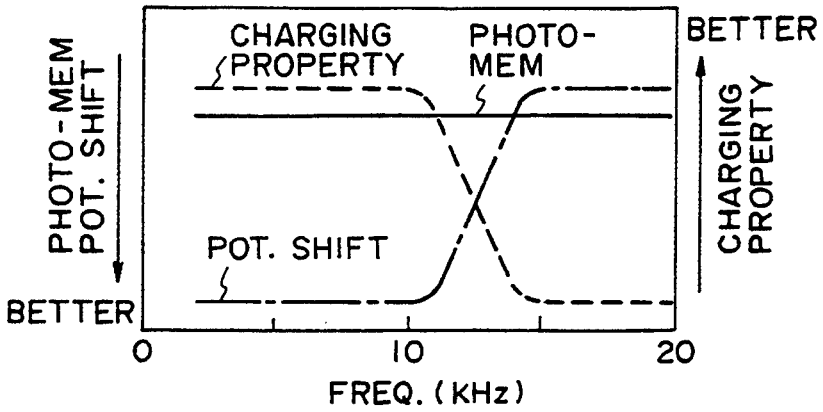
Figure 15C:
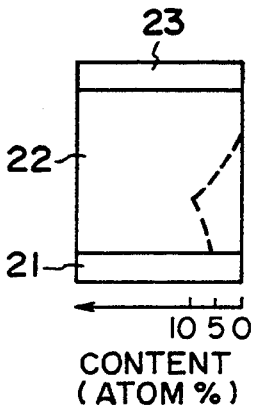
Figure 15D:
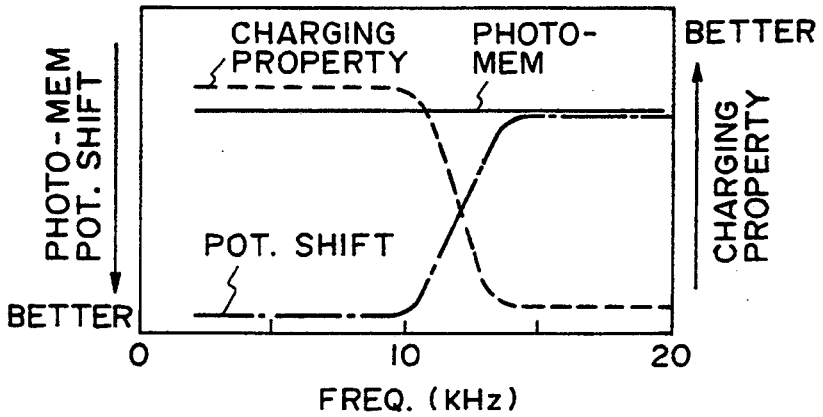
Figure 15E:
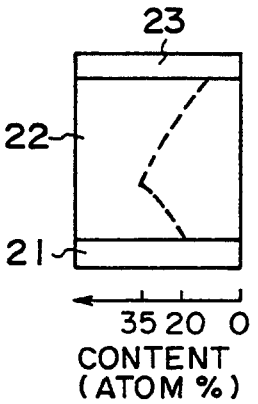
Figure 15F:
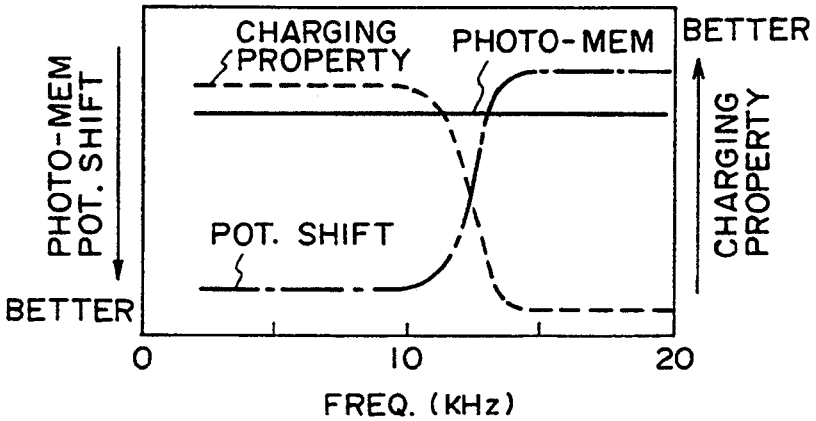

FIGS. 15A–15F are concerned with Experiment 6 in which carbon atom content in the photoconductive layer of a-Si photosensitive member is continuously increased and then decreased from the conductive base toward the surface layer. FIGS. 15A, 15C and 15E show the distributions of the carbon atom content, and FIGS. 15B, 15D and 15F show the results of the experiments.

Figure 16A:
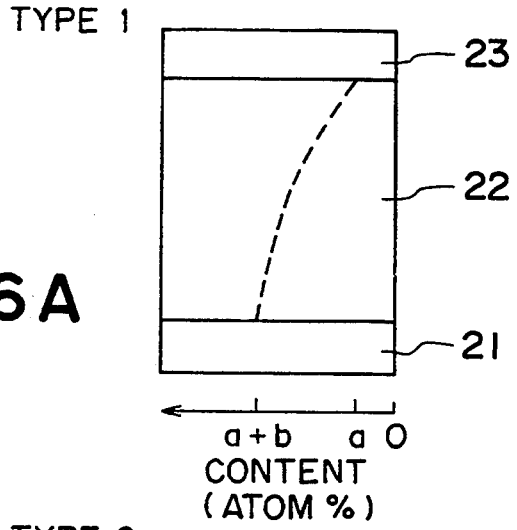
Figure 16B:
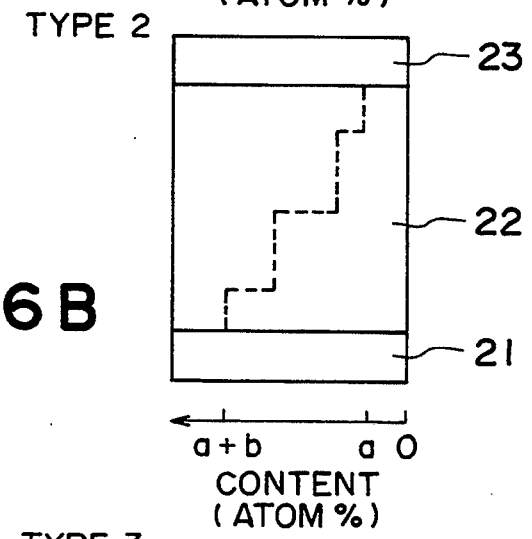
Figure 16C:
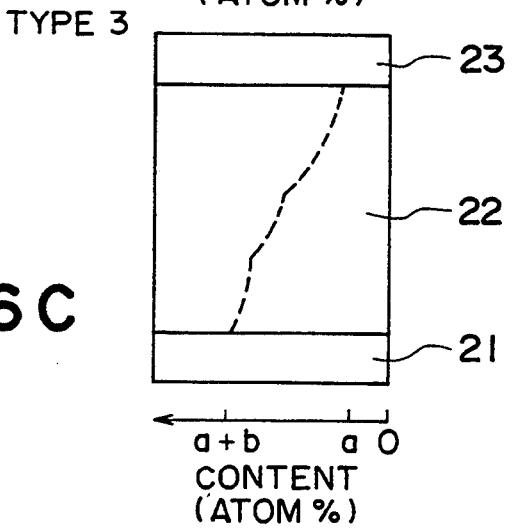

FIGS. 16A, 16B and 16C are concerned with Experiment 7 and show the distribution of the carbon atom contents in the photoconductive layers of the a-Si photosensitive layers of Types 1, 2 and 3 photosensitive members, respectively.

Figure 17A:
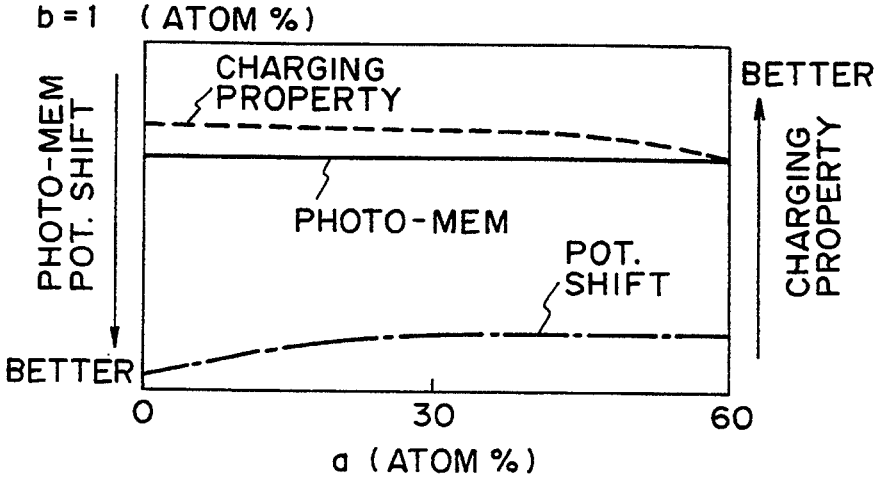
Figure 17B:
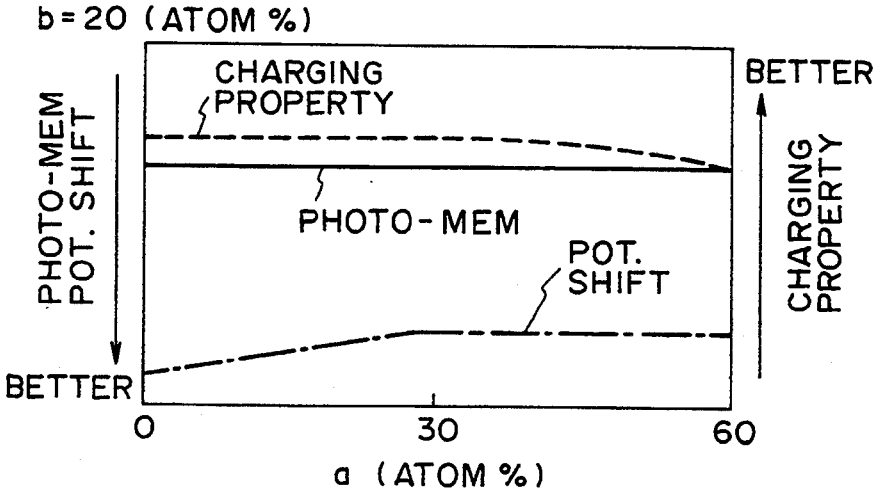
Figure 17C:
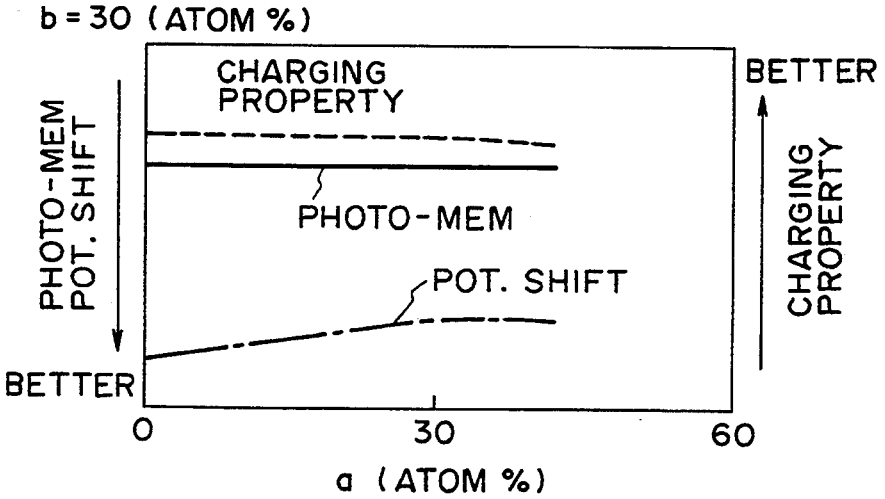

FIGS. 17A, 17B and 17C are concerned with Type 1 shown in FIG. 16A and are graphs showing the test results of the light memory, the charging property and the potential shift in which the carbon atom content (a atomic %) in the portion closest to the surface layer is varied. FIG. 17A is concerned with the case of the carbon atom content (a+b atomic %) in the portion closest to the conductive base being a+1 atomic %; FIG. 17B is concerned with the case of the carbon atom content (a+b atomic %) in the portion closest to the conductive base being a+20 atomic %; FIG. 17C is concerned with the case of the carbon atom content (a+b atomic %) in the portion closest to the conductive base being a+30 atomic %.

Figure 18A:
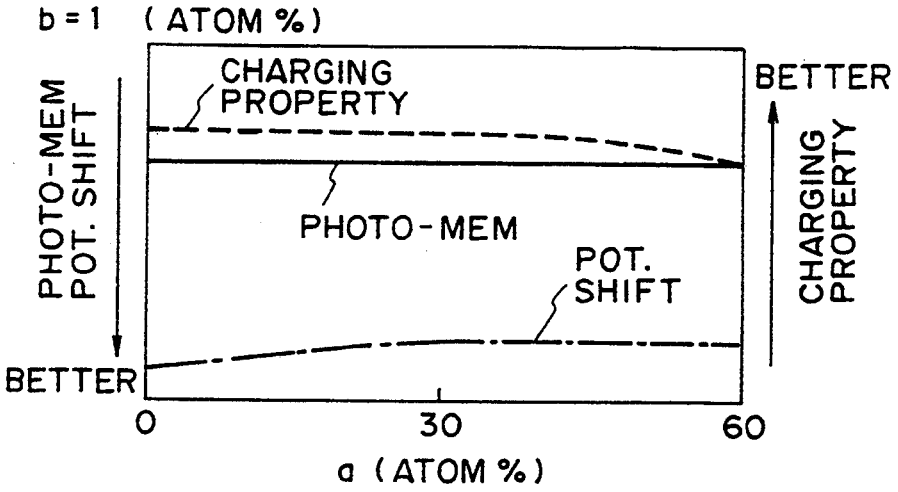
Figure 18B:
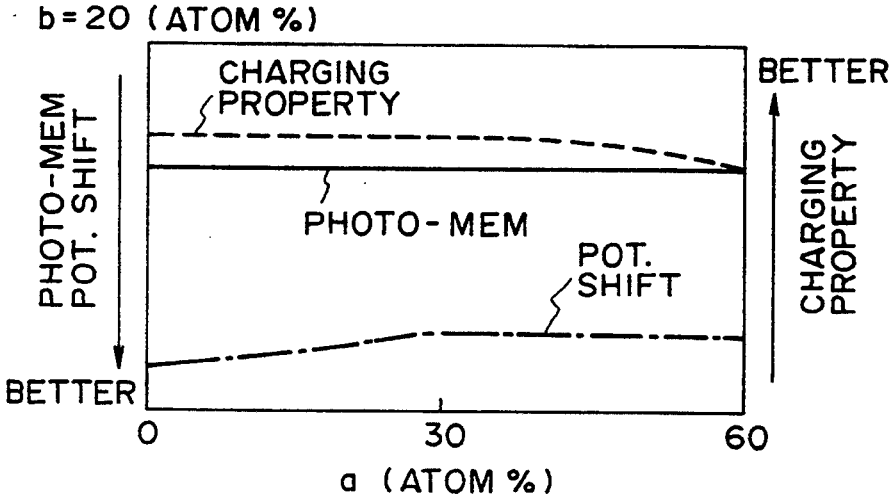
Figure 18C:
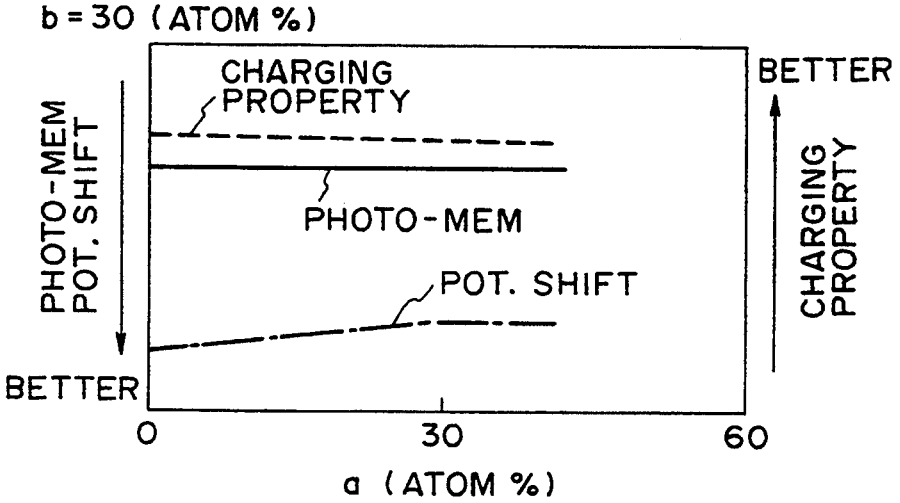

FIGS. 18A, 18B and 18C are concerned with Type 2 shown in FIG. 16B and are graphs showing the test results of the light memory, the charging property and the potential shift in which the carbon atom content (a atomic %) in the portion closest to the surface layer is varied. FIG. 18A is concerned with the case of the carbon atom content (a+b atomic %) in the portion closest to the conductive base being a+1 atomic %; FIG. 18B is concerned with the case of the carbon atom content (a+b atomic %) in the portion closest to the conductive base being a+20 atomic %; FIG. 18C is concerned with the case of the carbon atom content (a+b atomic %) in the portion closest to the conductive base being a+30 atomic %.

Figure 19A:
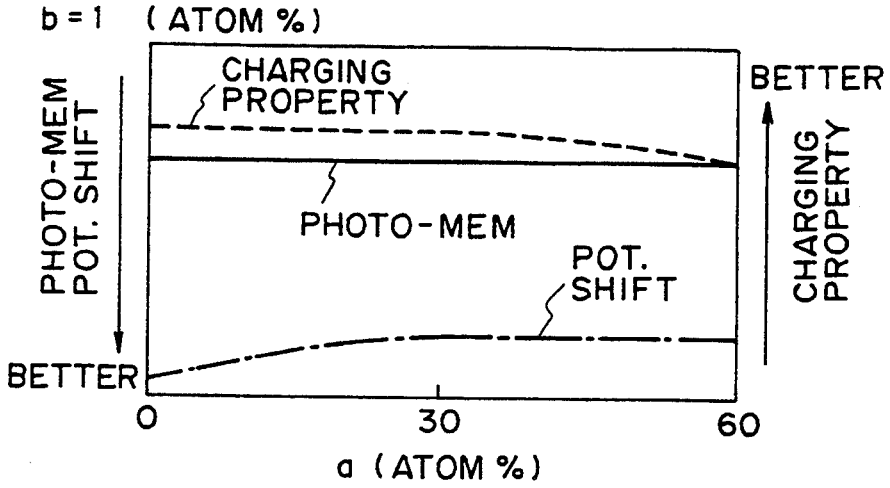
Figure 19B:
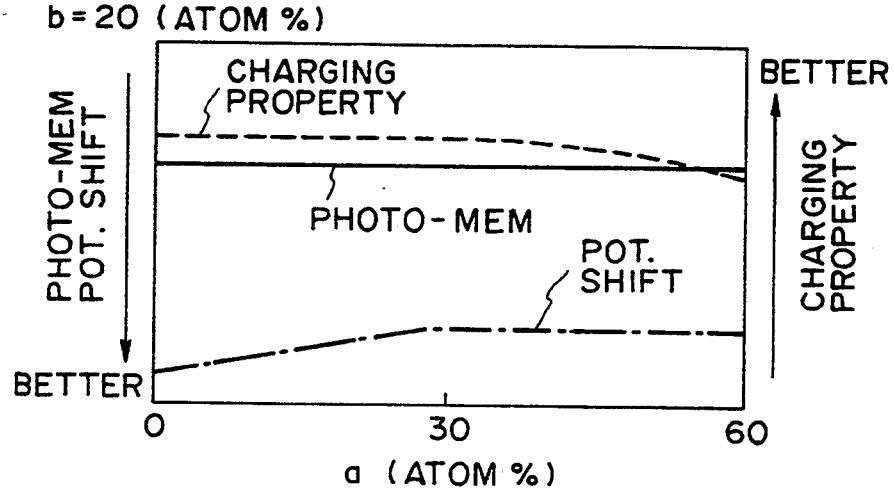
Figure 19C:
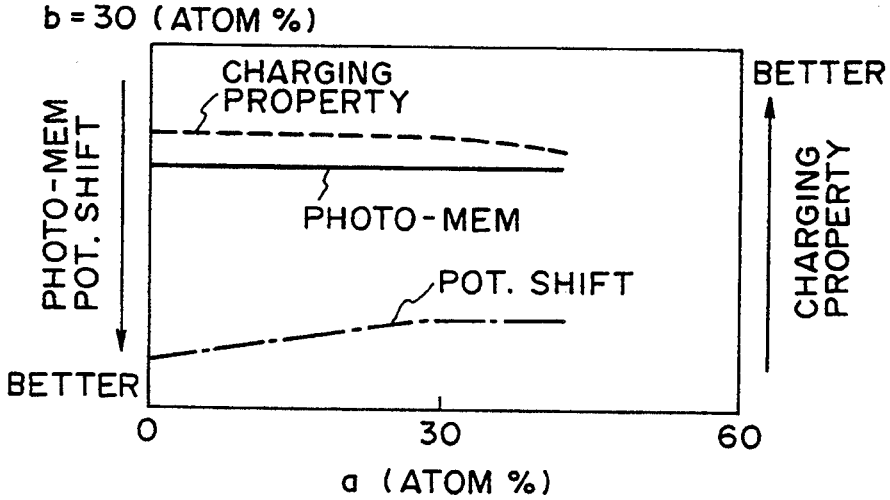

FIGS. 19A, 19B and 19C are concerned with Type 3 shown in FIG. 16C and are graphs showing the test results of the light memory, the charging property and the potential shift in which the carbon atom content (a atomic %) in the portion closest to the surface layer is varied. FIG. 19A is concerned with the case of the carbon atom content (a+b atomic %) in the portion closest to the conductive base being a+2 atomic %; FIG. 19B is concerned with the case of the carbon atom content (a+b atomic %) in the portion closest to the conductive base being a+20 atomic %; FIG. 19C is concerned with the case of the carbon atom content (a+b atomic %) in the portion closest to the conductive base being a+30 atomic %.

Figure 20A:
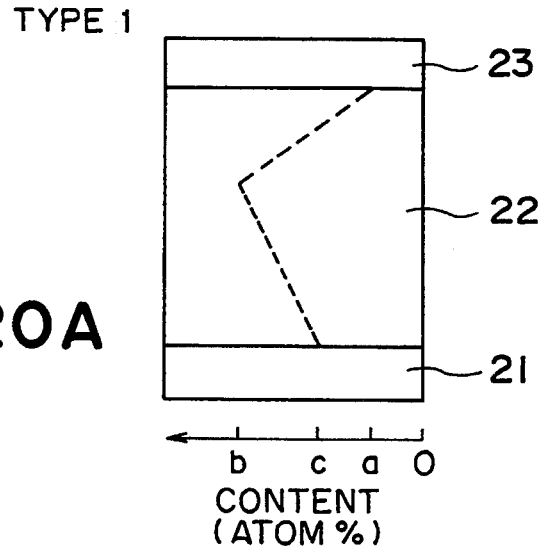
Figure 20B:
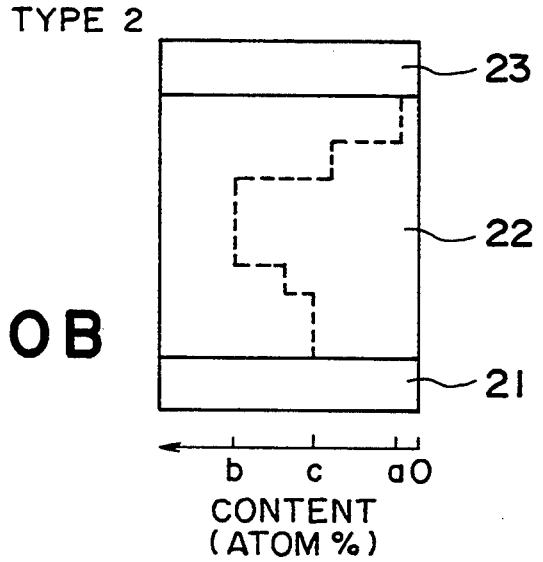
Figure 20C:
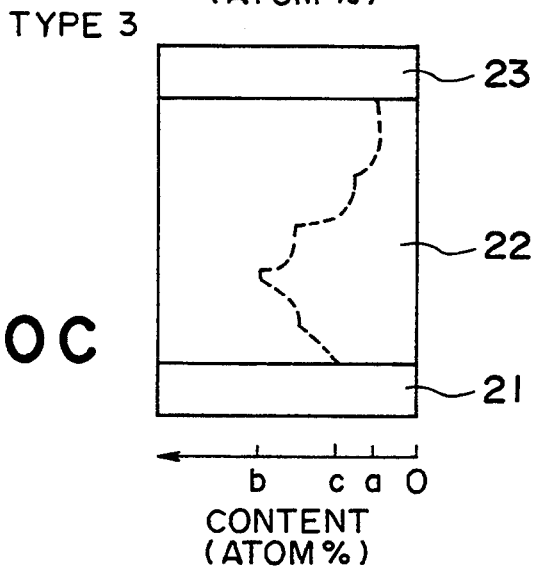

FIGS. 20A, 20B and 20C are concerned with Experiment 8 and show the distribution of the carbon atom contents in the photoconductive layers of the a-Si photosensitive layers of Types 1, 2 and 3 photosensitive members, respectively.

Figure 21A:
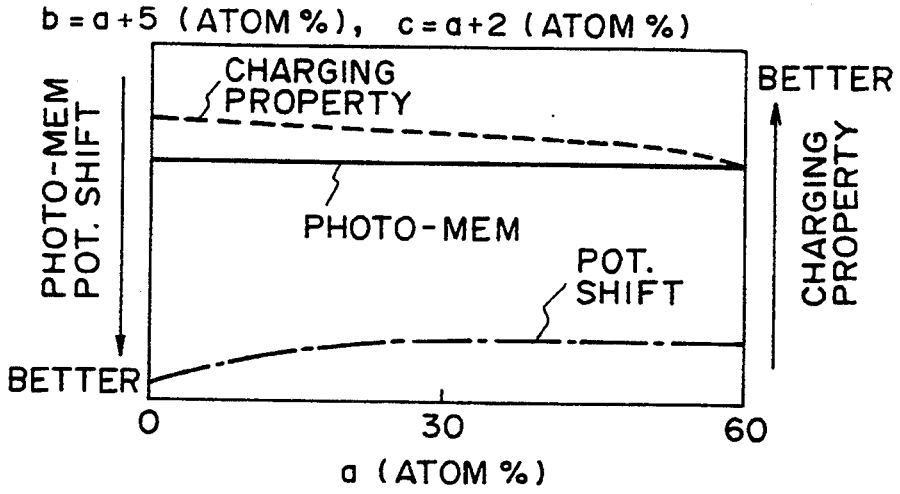
Figure 21B:
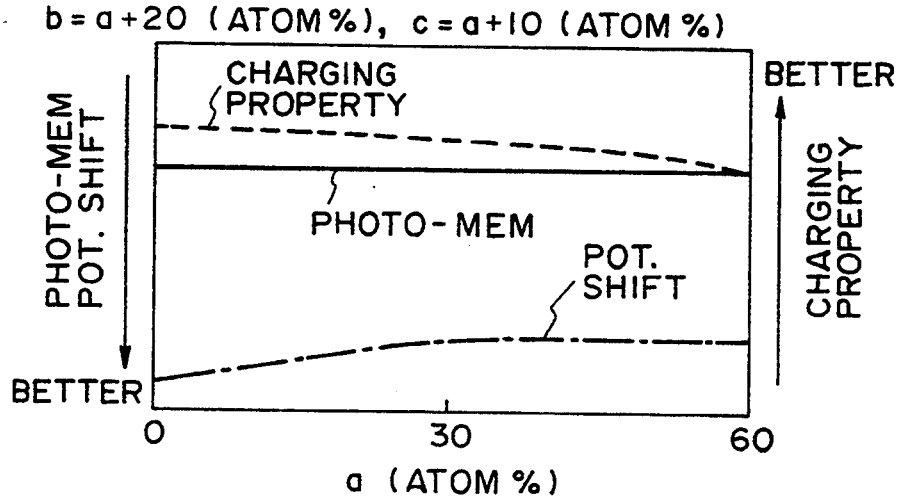
Figure 21C:
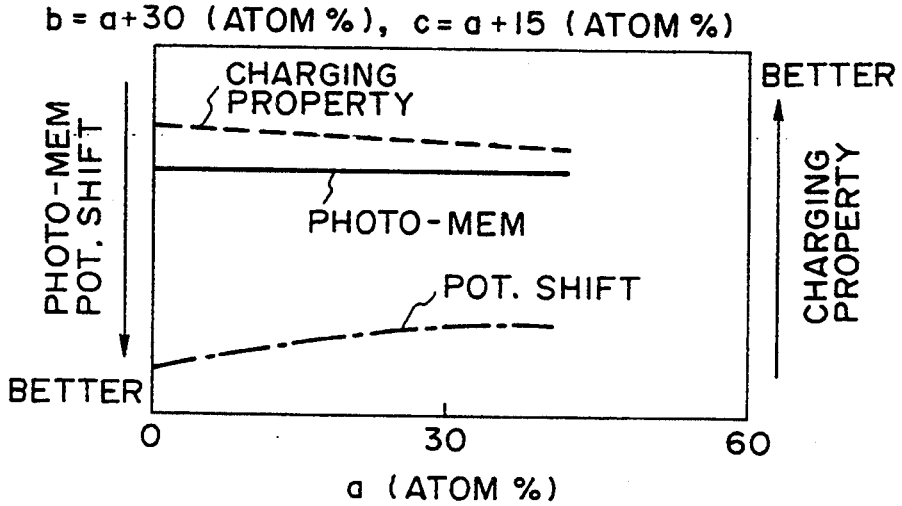

FIGS. 21A, 21B and 21C are concerned with Type 1 shown in FIG. 20A and are graphs showing the test results of the light memory, the charging property and the potential shift in which the carbon atom content (a atomic %) in the portion closes to the surface layer is varied. FIG. 21A is concerned with the case in which the content (a+b atomic %) between the surface layer and the conductive base is a+5 atomic %, and the carbon atom content (a+c atomic %) in the portion closest to the conductive base is a+2 atomic %; FIG. 21B is concerned with the case in which the content (a+b atomic %) between the surface layer and the conductive base is a+20 atomic %, and the carbon atom content (a+c atomic %) in the portion closest to the conductive base is a+10 atomic %; and FIG. 21C is concerned with the case in which the content (a+b atomic %) between the surface layer and the conductive base is a+30%, and the carbon atom content (a+c atomic %) in the portion closest to the conductive base is a+15 atomic %.

Figure 22A:
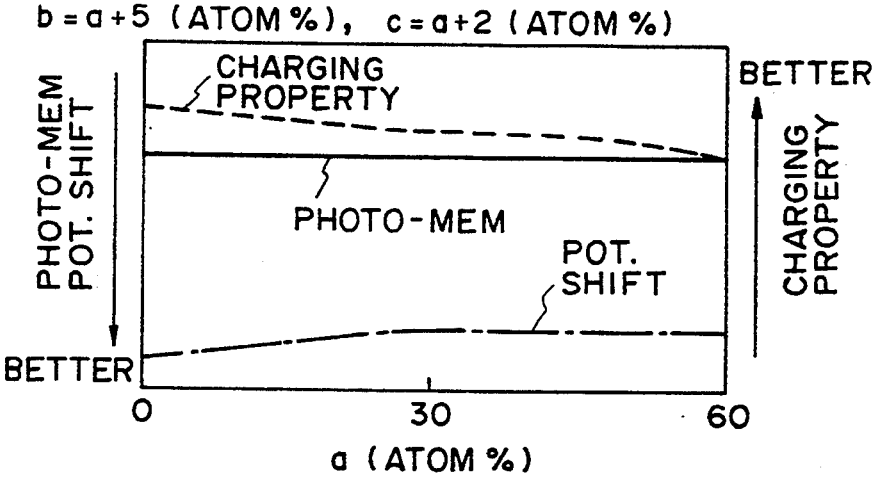
Figure 22B:
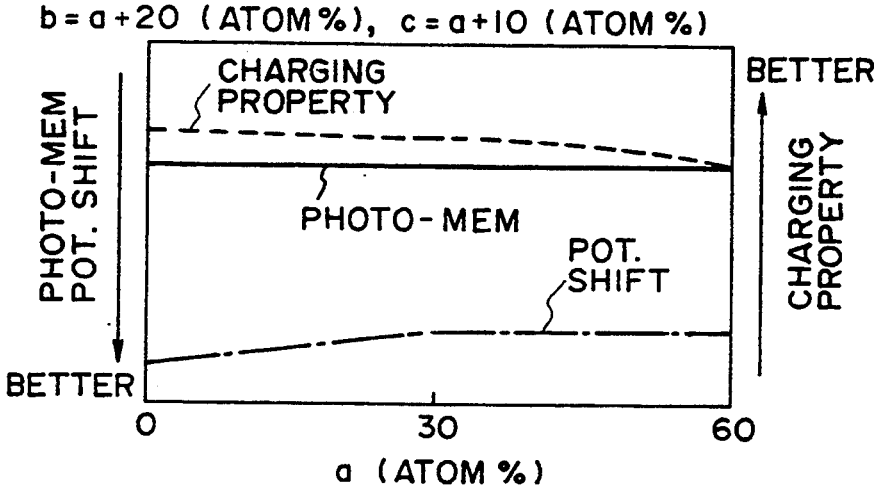
Figure 22C:
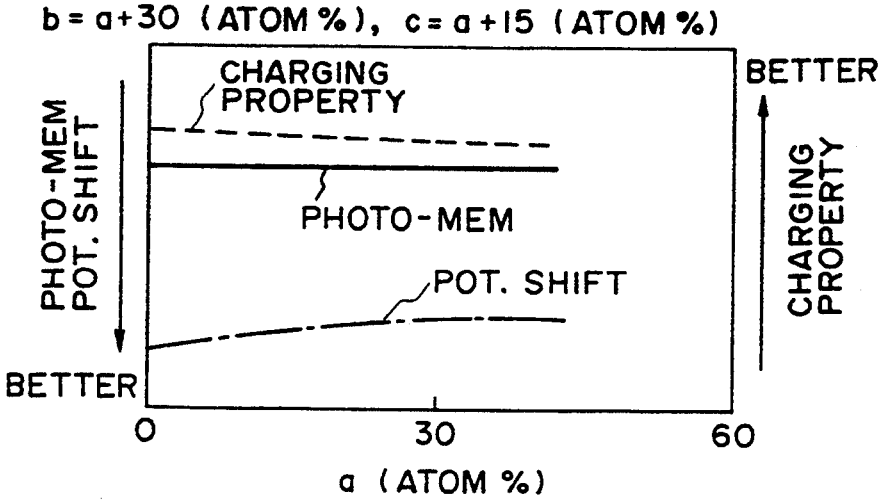

FIGS. 22A, 22B and 22C are concerned with Type 2 shown in FIG. 20B and are graphs showing the test results of the light memory, the charging property and the potential shift in which the carbon atom content (a atomic %) in the portion closes to the surface layer is varied. FIG. 22A is concerned with the case in which the content (a+b atomic %) between the surface layer and the conductive base is a+5 atomic %, and the carbon atom content (a+c atomic %) in the portion closest to the conductive base is a+2 atomic %; FIG. 22B is concerned with the case in which the content (a+b atomic %) between the surface layer and the conductive base is a+20 atomic %, and the carbon atom content (a+c atomic %) in the portion closest to the conductive base is a+10 atomic %; and FIG. 22C is concerned with the case in which the content (a+b atomic %) between the surface layer and the conductive base is a+30%, and the carbon atom content (a+c atomic %) in the portion closest to the conductive base is a+15 atomic %.

Figure 23A:
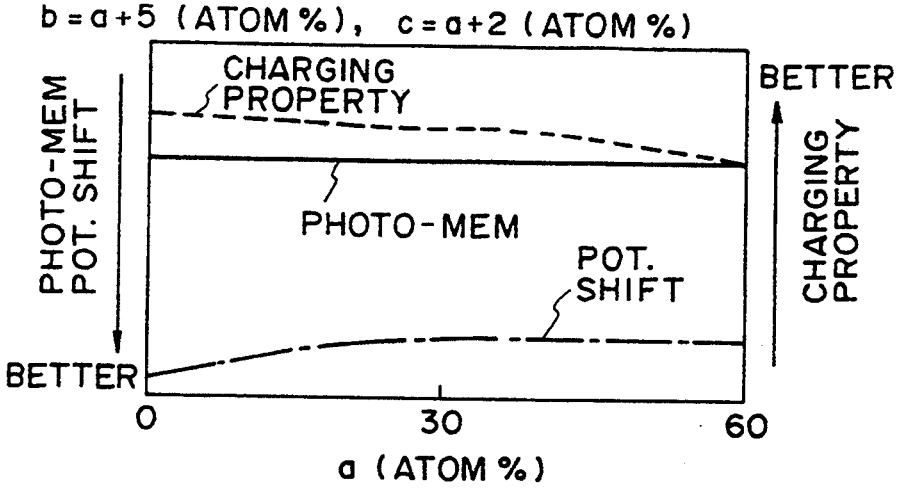
Figure 23B:
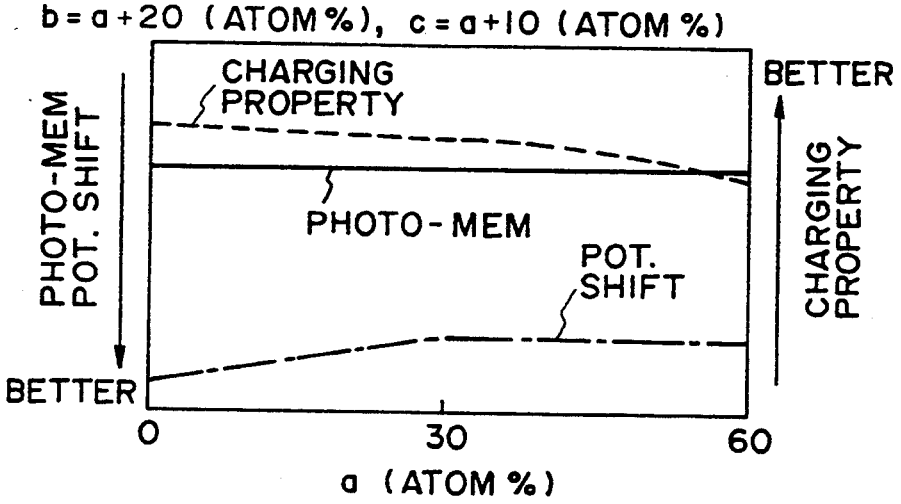
Figure 23C:
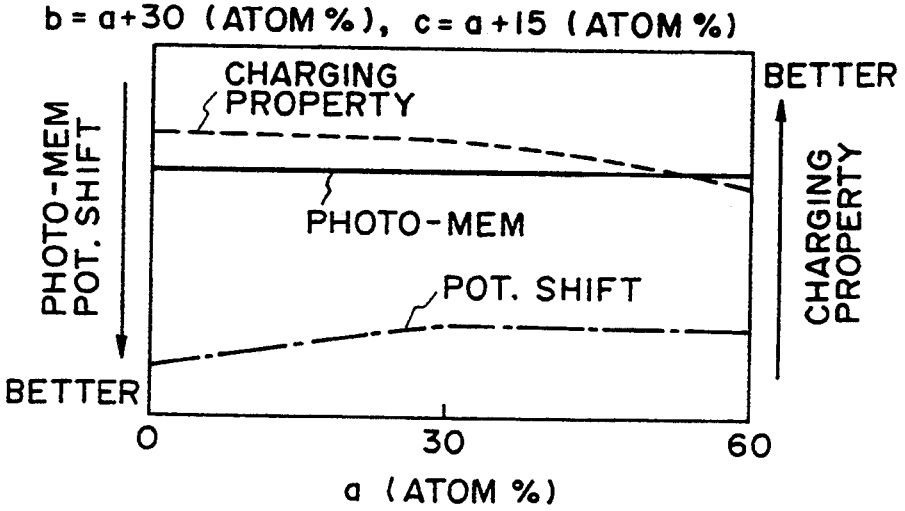

FIGS. 23A, 23B and 23C are concerned with Type 3 shown in FIG. 20C and are graphs showing the test results of the light memory, the charging property and the potential shift in which the carbon atom content (a atomic %) in the portion closes to the surface layer is varied. FIG. 23A is concerned with the case in which the content (a+b atomic %) between the surface layer and the conductive base is a+5 atomic %, and the carbon atom content (a+c atomic %) in the portion closest to the conductive base is a+2 atomic %; FIG. 23B is concerned with the case in which the content (a+b atomic %) between the surface layer and the conductive base is a+20 atomic %, and the carbon atom content (a+c atomic %) in the portion closest to the conductive base is a+10 atomic %; and FIG. 23C is concerned with the case in which the content (a+b atomic %) between the surface layer and the conductive base is a+30%, and the carbon atom content (a+c atomic %) in the portion closest to the conductive base is a+15 atomic %.

Figure 24:
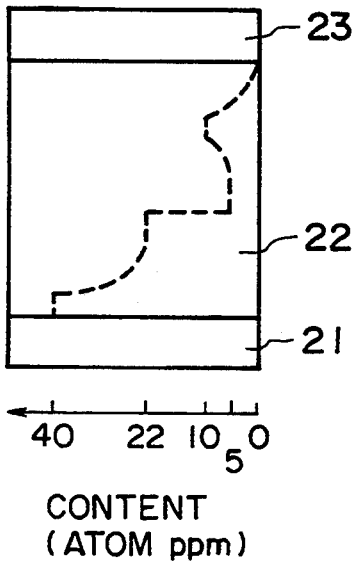

FIG. 24 shows a carbon atom content distribution in a photoconductive layer of the a-Si photosensitive member used in Experiment 9.

Figure 25:
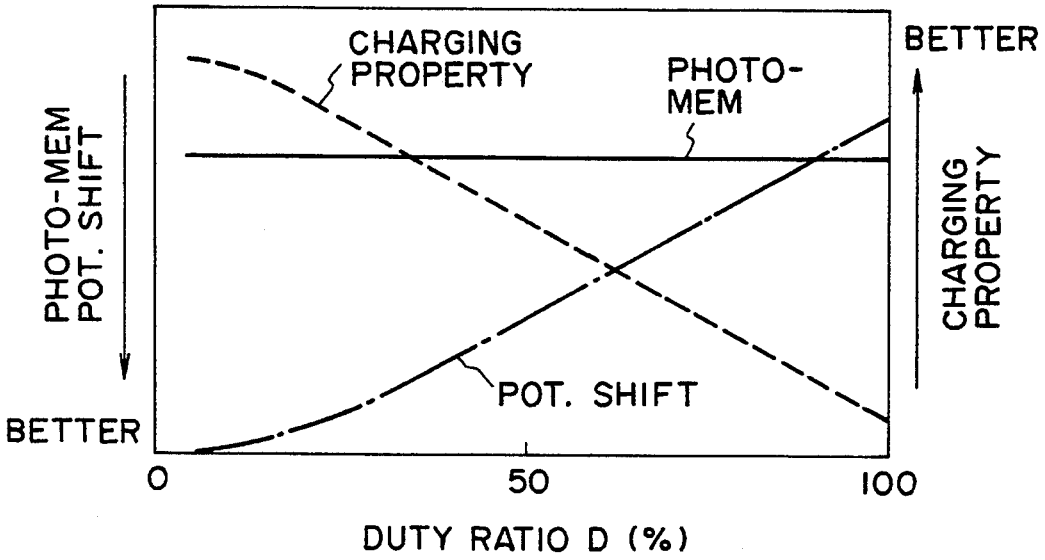

FIG. 25 is a graph showing a result of Experiment 9.

Figure 26:
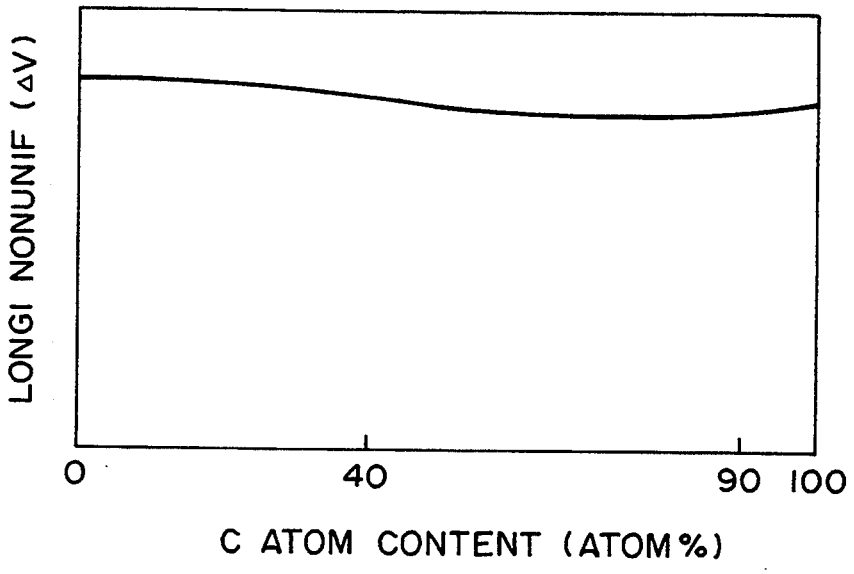

FIG. 26 is a graph showing a result of Experiment 10.

Figure 27A:
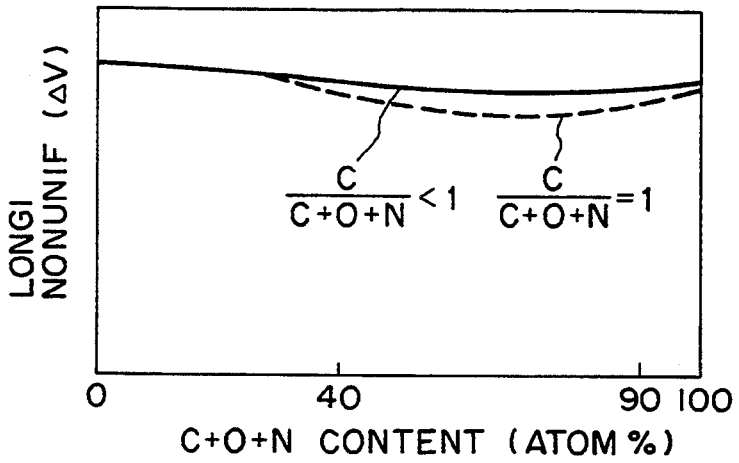
Figure 27B:
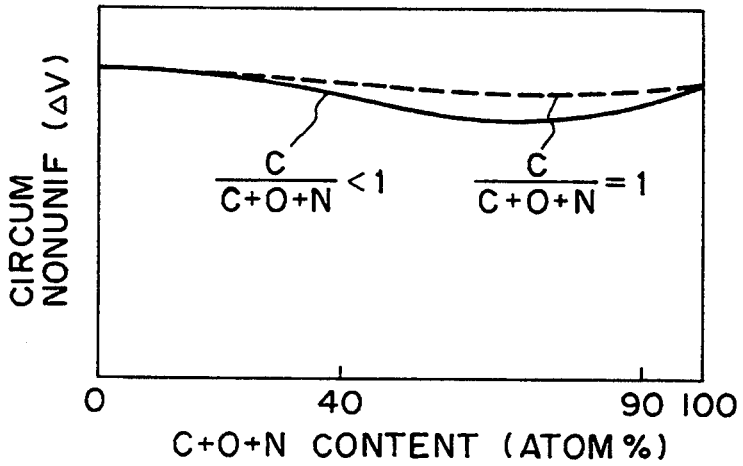
Figure 27C:
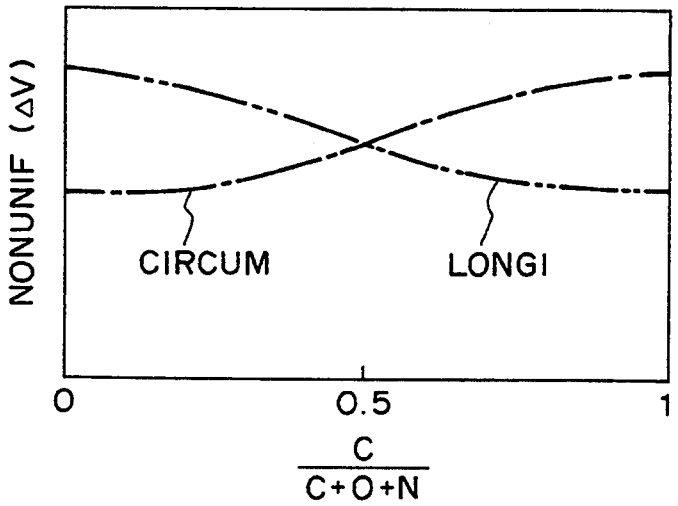

FIGS. 27A, 27B and 27C are concerned with Experiment 11. FIG. 27A is a graph showing a test result of a potential unevenness along the generating line of an a-Si photosensitive member when a sum of carbon, nitrogen and oxygen atom contents (C+N+O) in the surface layer is varied; FIG. 27B is a graph showing a test result of a potential unevenness along the circumference of an a-Si photosensitive member when a sum of carbon, nitrogen and oxygen atom contents (C+N+O) in the surface layer is varied; and FIG. 27C is a graph showing a test result of a potential unevenness along the generating line and along the circumference of an a-Si photosensitive member when a ratio of a carbon atom content to a sum of the carbon atom content and nitrogen and oxygen atom contents (C/(C+N+O)) in the surface layer is varied.

Figure 1A:
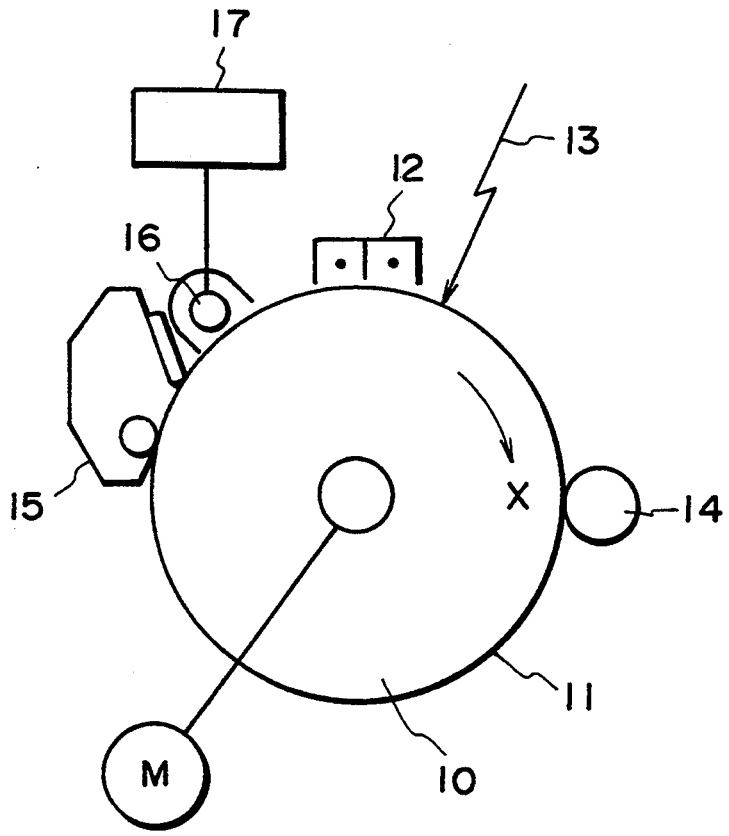
FIG. 1A is a sectional view of an electrophotographic apparatus using an amorphous silicon photosensitive member according to an embodiment of the present invention.
Figure 28A:
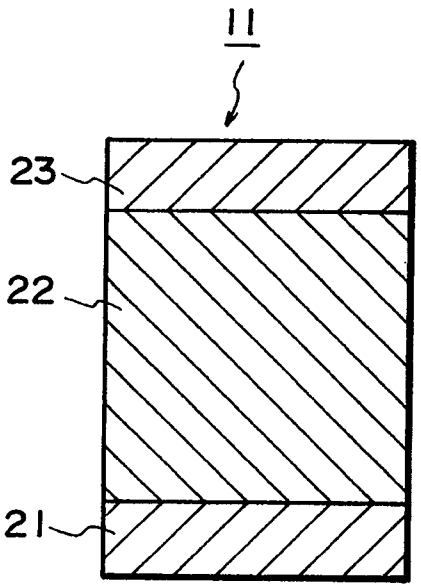

FIG. 28A shows a structure of the a-Si photosensitive member shown in FIG. 1A.

Figure 28B:
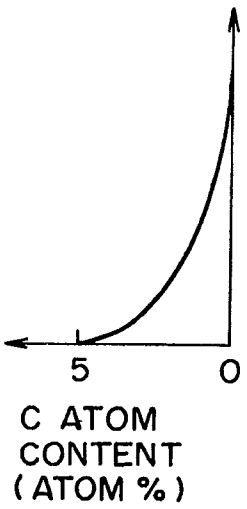

FIG. 28B shows a carbon atom content in the photoconductive layer of FIG. 28A photosensitive member.

Figure 28C:
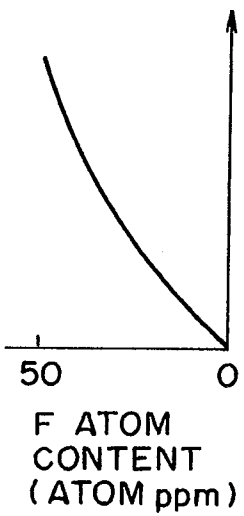

FIG. 28C shows a fluorine atom content in the photoconductive layer of FIG. 28A photosensitive member.

Figure 29A:
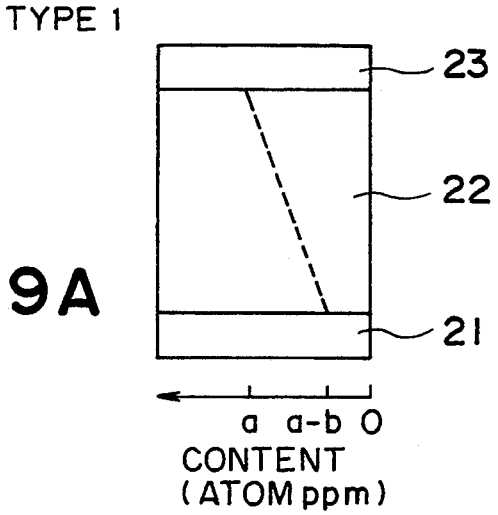
Figure 29B:
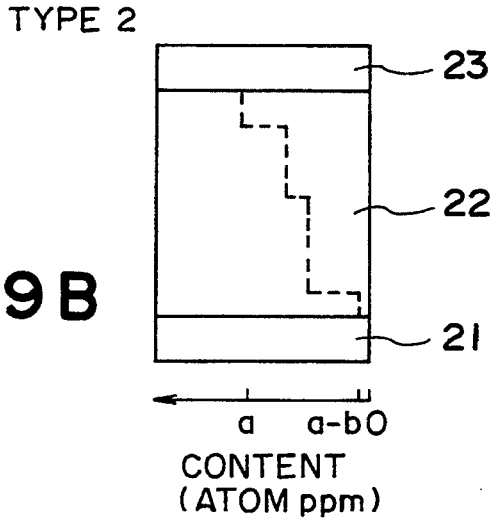
Figure 29C:
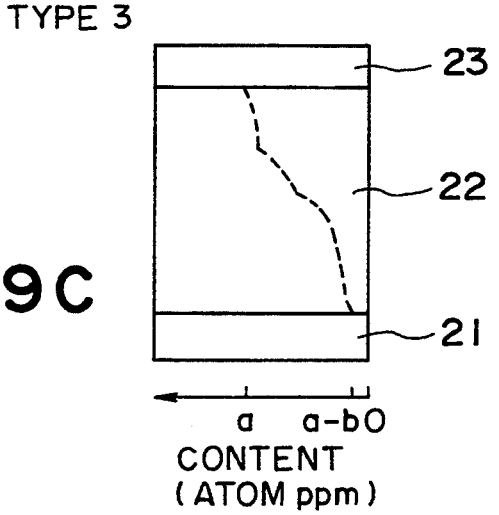

FIGS. 29A, 29B and 29C are concerned with Experiment 12 and show the distribution of the carbon atom contents in the photoconductive layers of the a-Si photosensitive layers of Types 1, 2 and 3 photosensitive members, respectively.

Figure 30A:
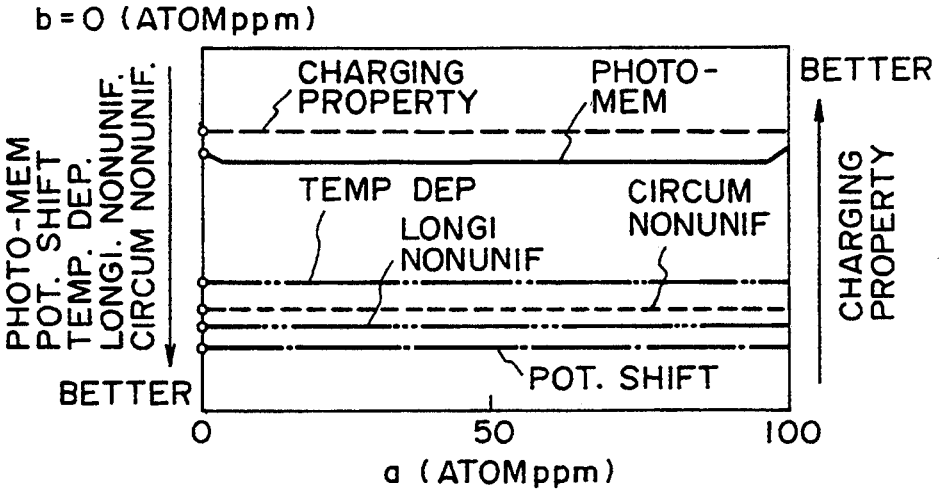
Figure 30B:
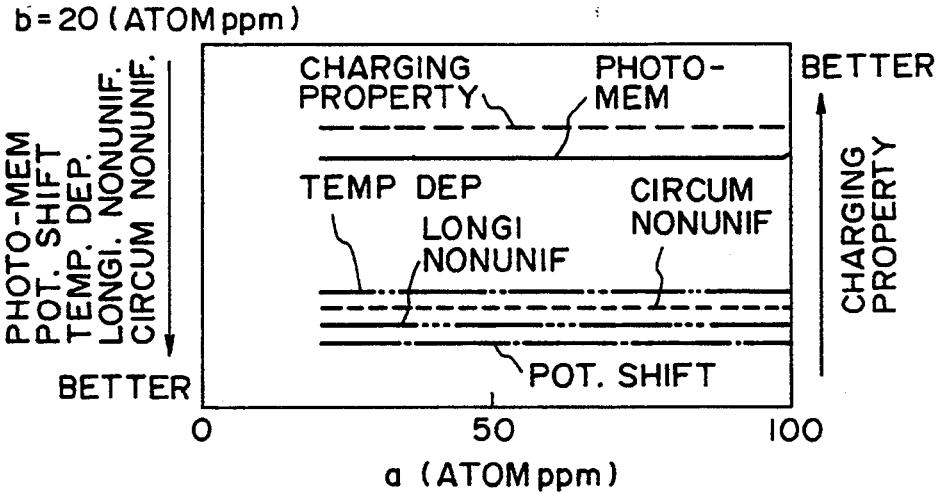
Figure 30C:
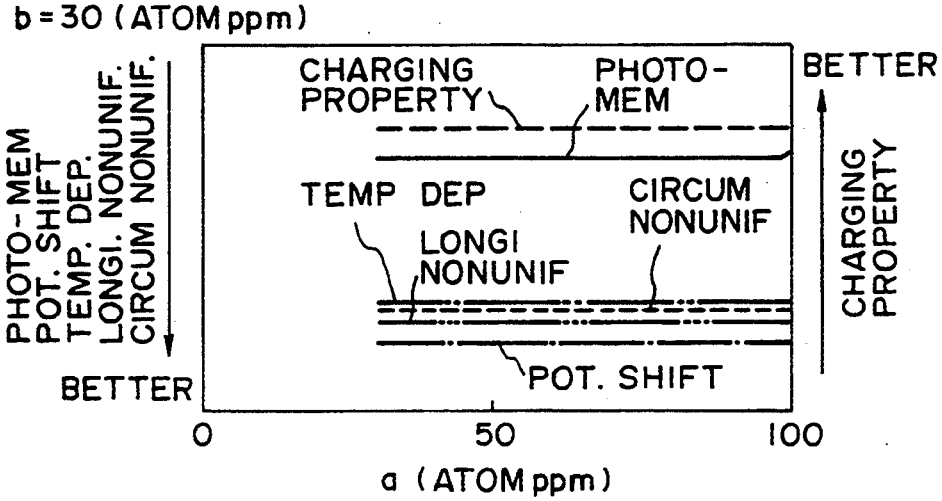

FIGS. 30A, 30B and 30C are concerned with Type 1 shown in FIG. 29A when a fluorine atom content (atomic ppm) in the portion closest to the surface layer is varied. FIG. 30A shows a test result when the fluorine atom content (a−b atomic ppm) in the portion closest to the conductive base is a atomic ppm; FIG. 30B shows a test result when the fluorine atom content (a−b atomic ppm) in the portion closest to the conductive base is a−20 atomic ppm; and FIG. 30C shows a test result when the fluorine atom content (a−b atomic ppm) in the portion closest to the conductive base is a−30 atomic ppm.

Figure 31A:
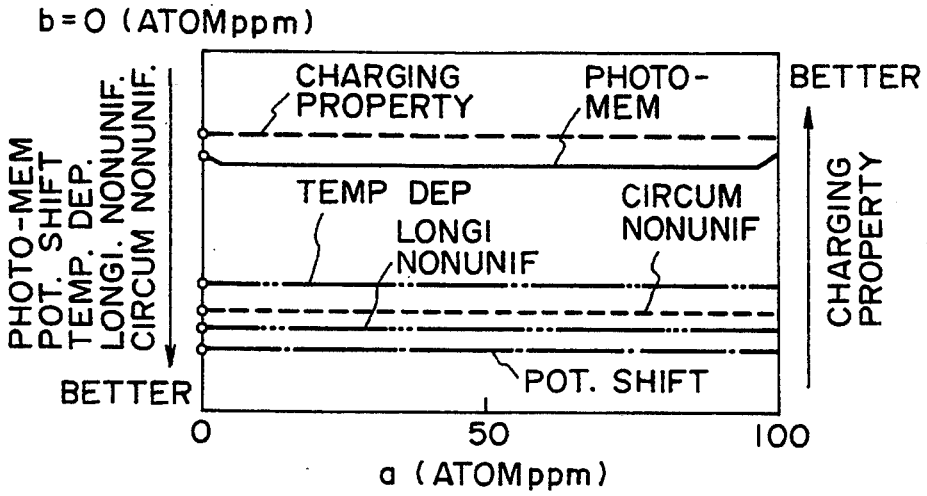
Figure 31B:
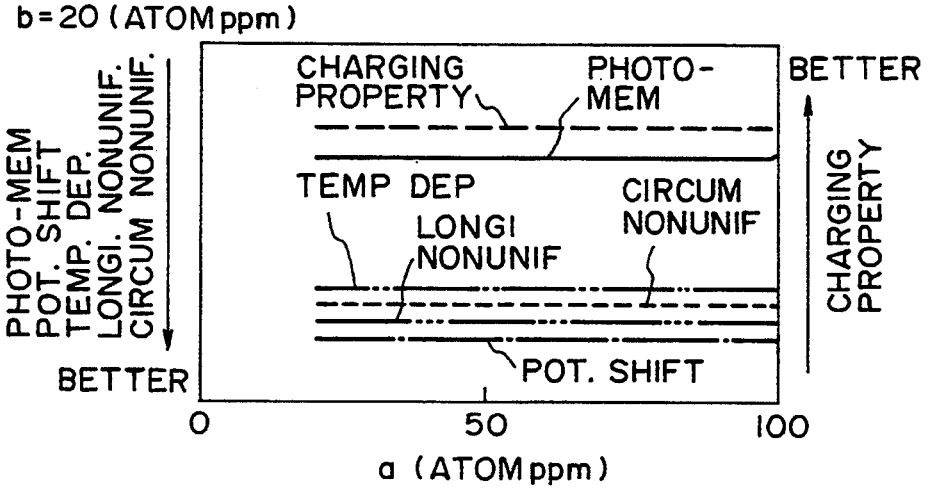
Figure 31C:
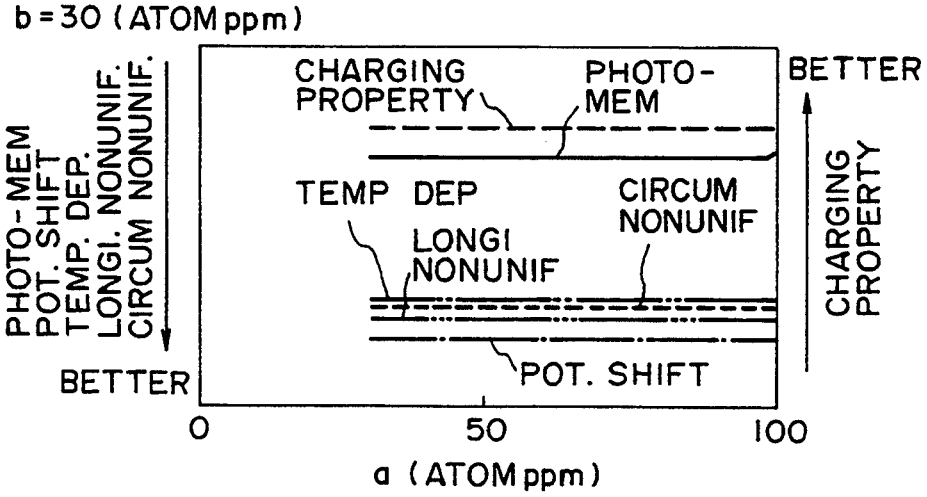

FIGS. 31A, 31B and 31C are concerned with Type 2 shown in FIG. 29B when a fluorine atom content (atomic ppm) in the portion closest to the surface layer is varied. FIG. 31A shows a test result when the fluorine atom content (a−b atomic ppm) in the portion closest to the conductive base is a atomic ppm; FIG. 31B shows a test result when the fluorine atom content (a−b atomic ppm) in the portion closest to the conductive base is a−20 atomic ppm; and FIG. 31C shows a test result when the fluorine atom content (a−b atomic ppm) in the portion closest to the conductive base is a−30 atomic ppm.

Figure 32A:
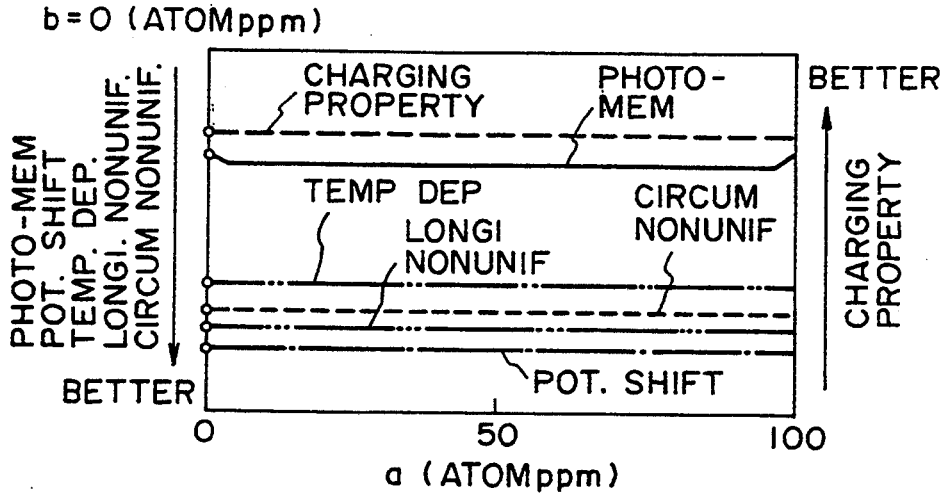
Figure 32B:
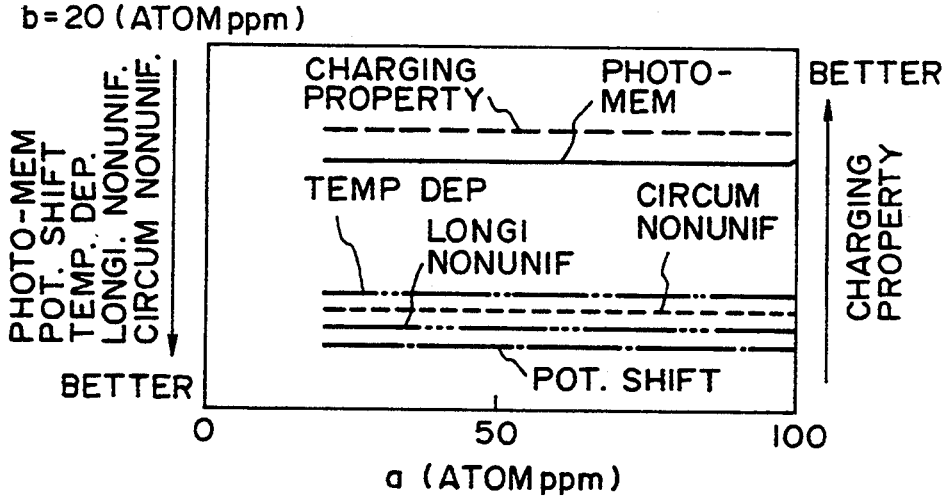
Figure 32C:
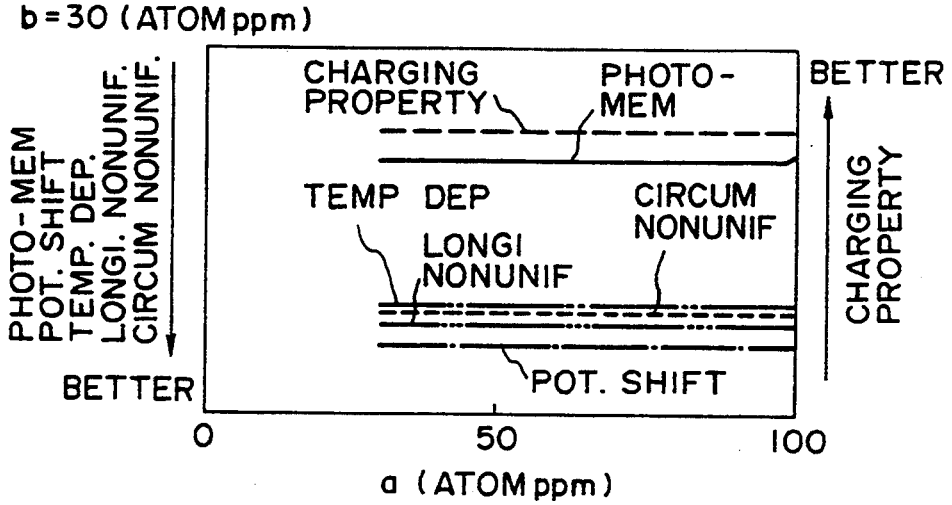

FIGS. 32A, 32B and 32C are concerned with Type 3 shown in FIG. 29C when a fluorine atom content (atomic ppm) in the portion closest to the surface layer is varied. FIG. 32A shows a test result when the fluorine atom content (a−b atomic ppm) in the portion closest to the conductive base is a atomic ppm; FIG. 32B shows a test result when the fluorine atom content (a−b atomic ppm) in the portion closest to the conductive base is a−20 atomic ppm; and FIG. 32C shows a test result when the fluorine atom content (a−b atomic ppm) in the portion closest to the conductive base is a−30 atomic ppm.

Figure 33A:
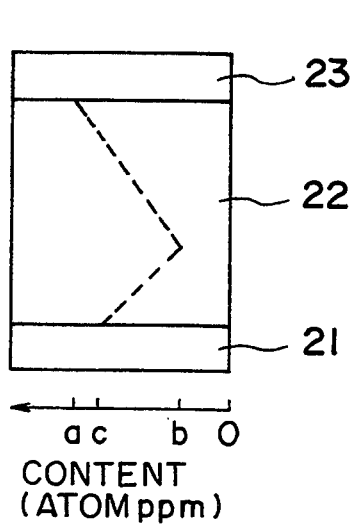
Figure 33B:
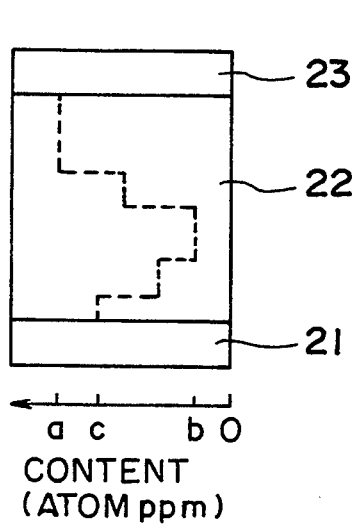
Figure 33C:
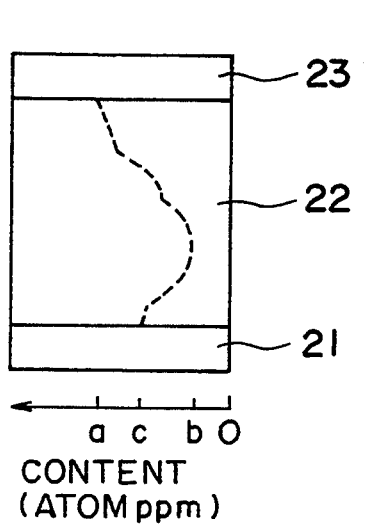

FIGS. 33A, 33B and 33C are concerned with Experiment 13 and show the distribution of the carbon atom contents in the photoconductive layers of the a-Si photosensitive layers of Types 1, 2 and 3 photosensitive members, respectively.

Figure 34A:
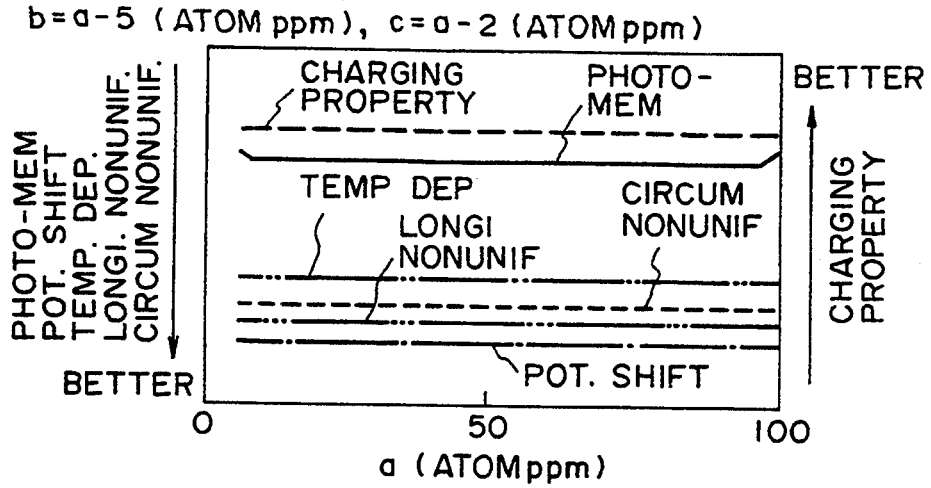
Figure 34B:
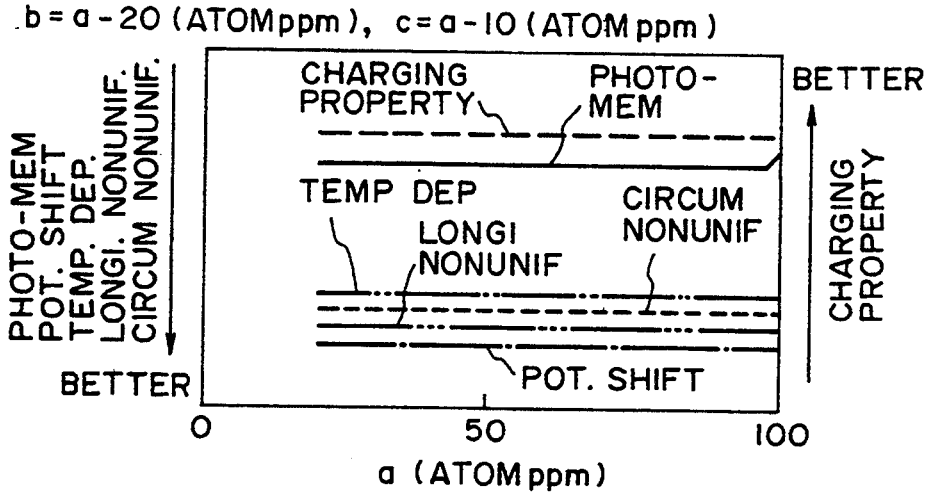
Figure 34C:
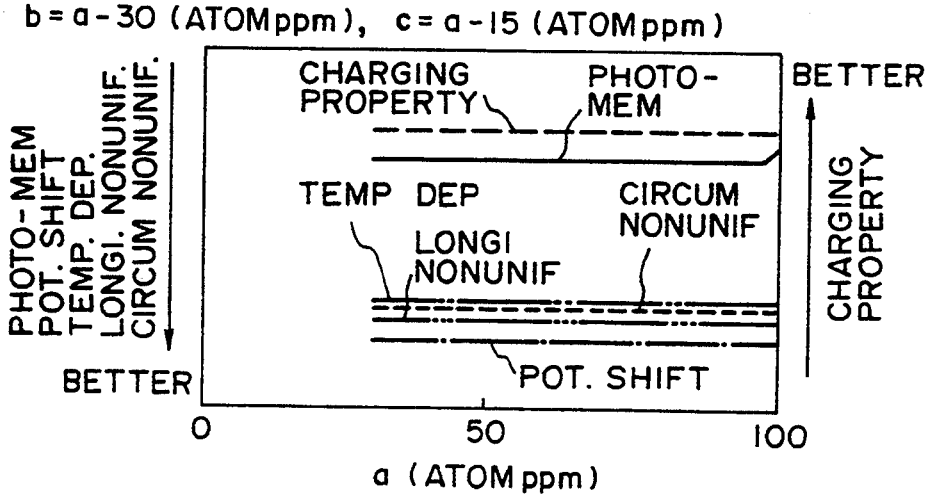

FIGS. 34A, 34B and 34C are concerned with Type 1 of FIG. 33A in which the fluorine atom content a in the portion closest to the surface layer is changed. FIG. 34A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 34B is a graph showing a result of the test in which the fluorine atom content between the surface layer and the conductive base (a−b atomic ppm) is a−20 atomic ppm, and the fluorine atom content in the portion closes to the conductive base (a−c atomic ppm)

is a−10 atomic ppm; and FIG. 34C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm.

Figure 35A:
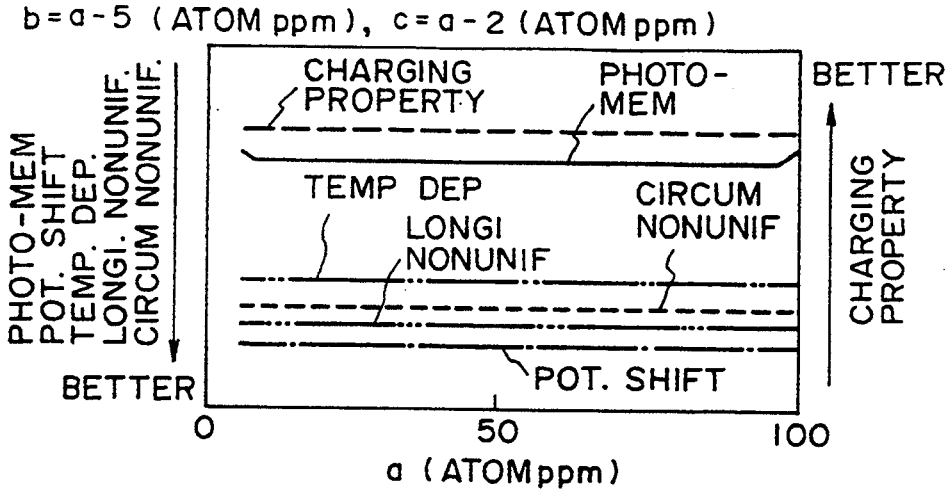
Figure 35B:
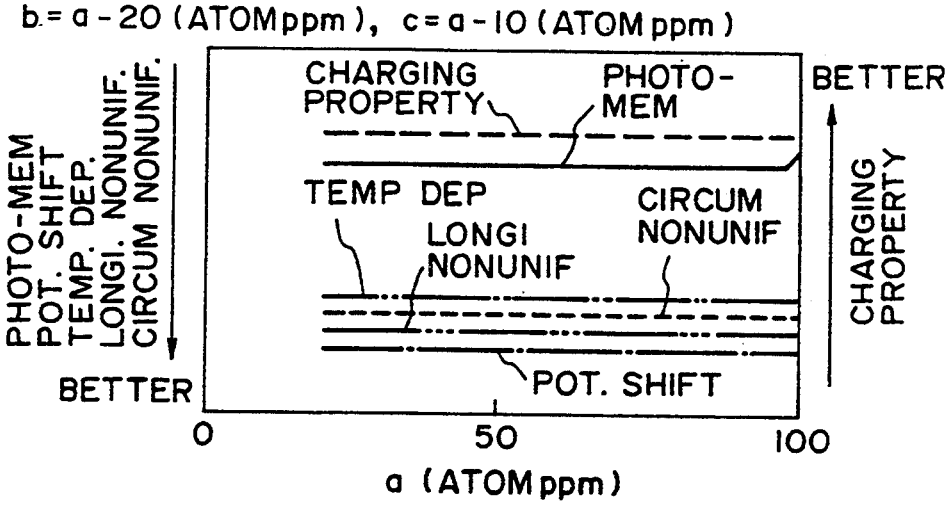
Figure 35C:
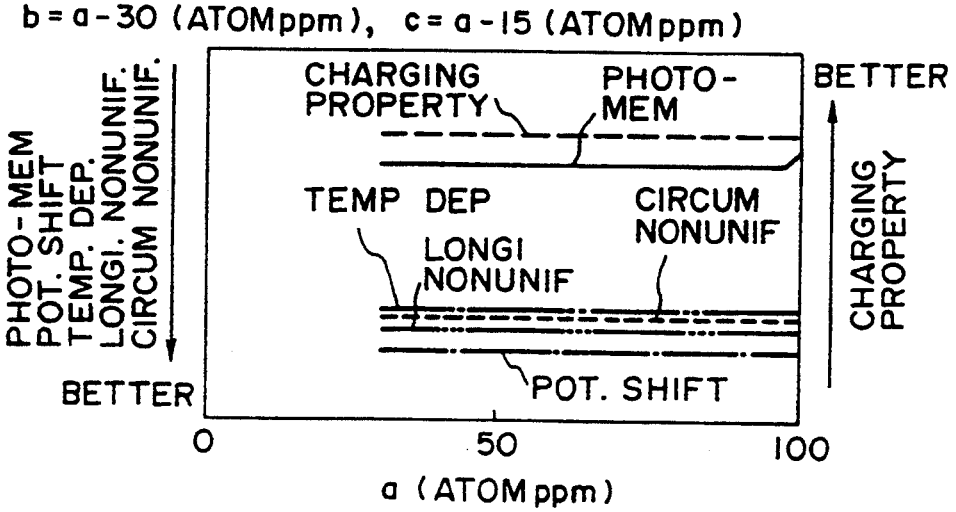

FIGS. 35A, 35B and 35C are concerned with Type 2 of FIG. 33B in which the fluorine atom content a in the portion closest to the surface layer is changed. FIG. 35A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 35B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 35C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm.

Figure 36A:
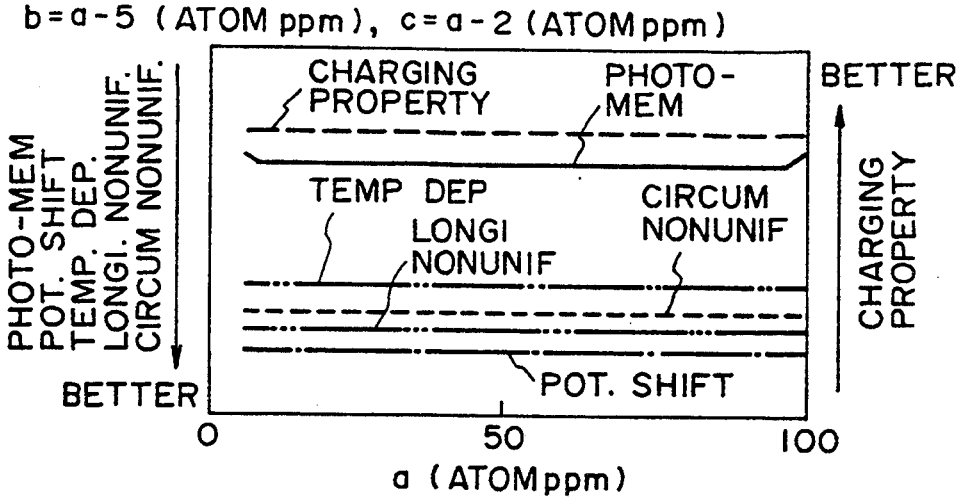
Figure 36B:
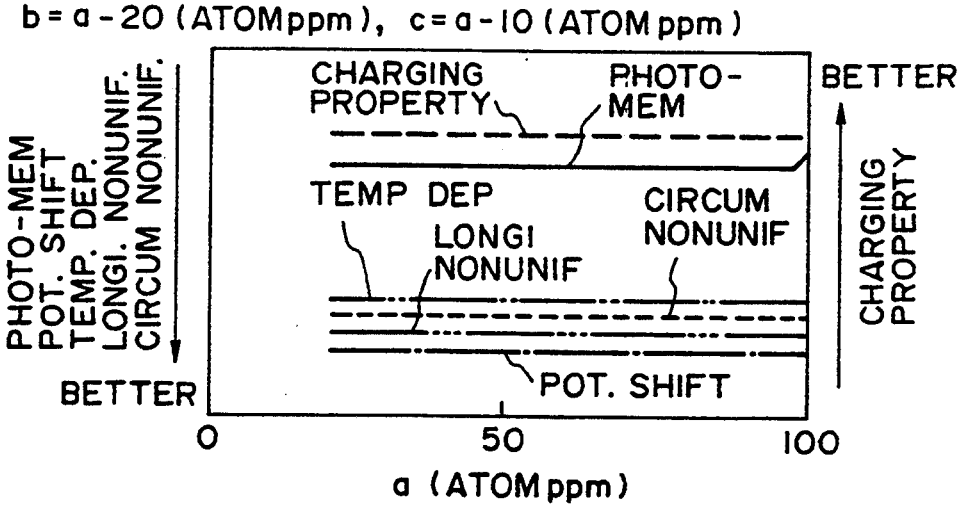
Figure 36C:
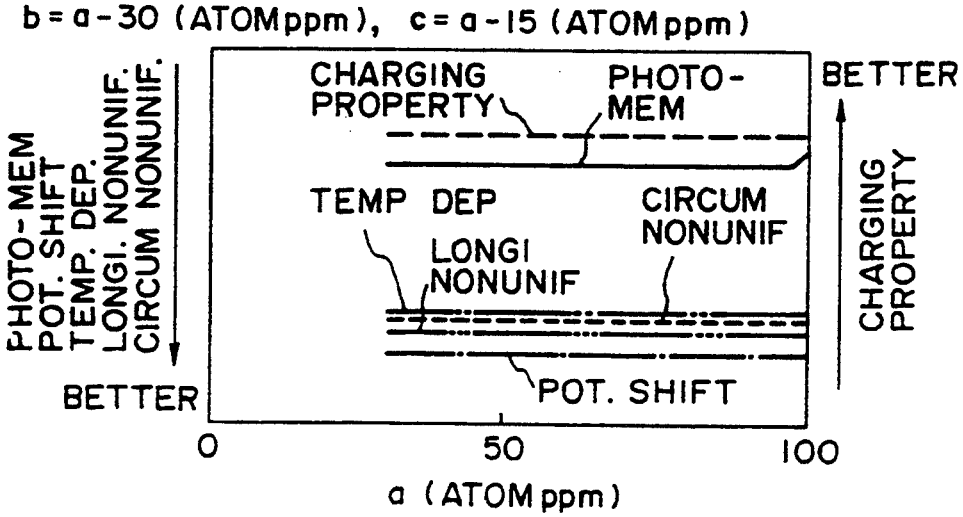

FIGS. 36A, 36B and 36C are concerned with Type 3 of FIG. 33C in which the fluorine atom content a in the portion closest to the surface layer is changed. FIG. 36A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 36B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 36C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm.

Figure 37:
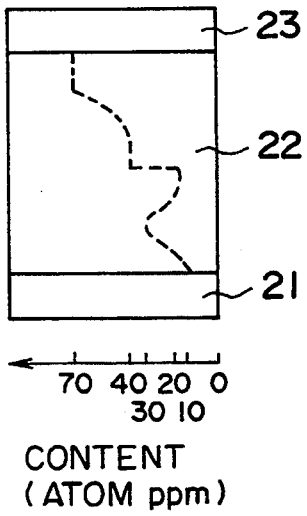

FIG. 37 shows a fluorine atom content in the photoconductive layer of the a-Si photosensitive member used in Experiment 14.

Figure 38:
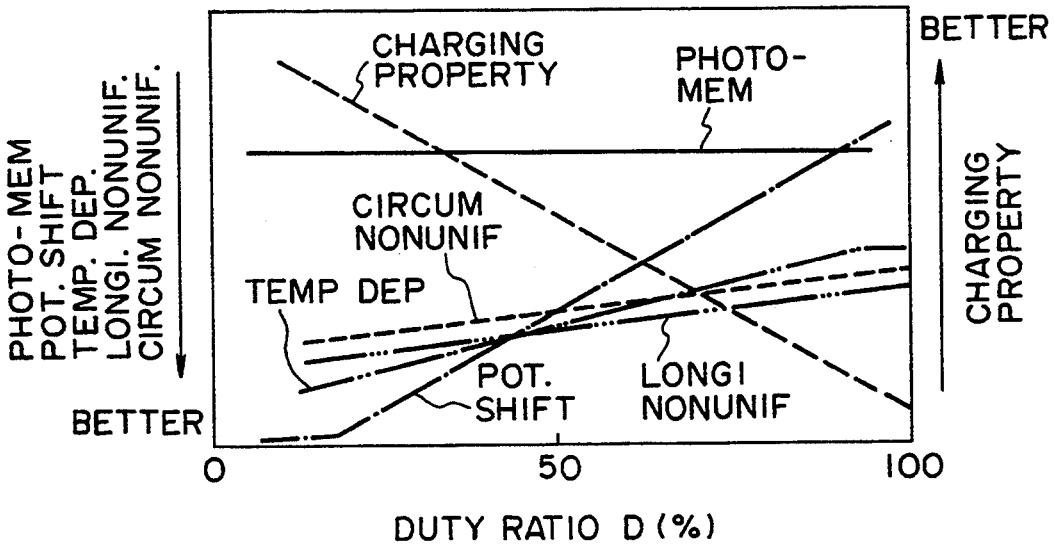

FIG. 38 is a graph showing a result of Experiment 14.

Figure 39A:
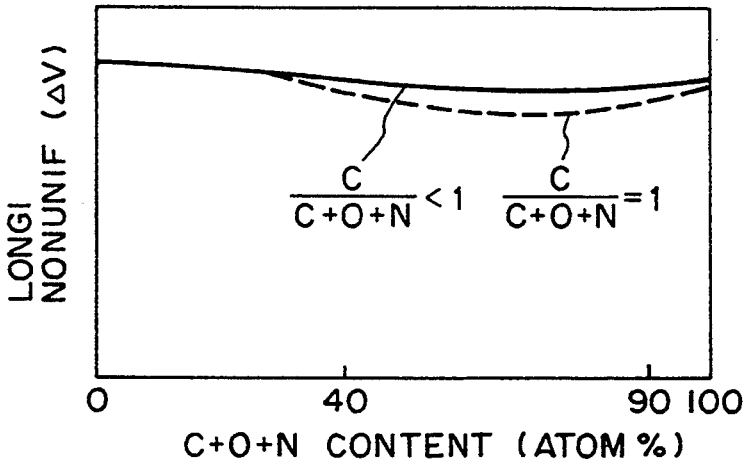
Figure 39B:
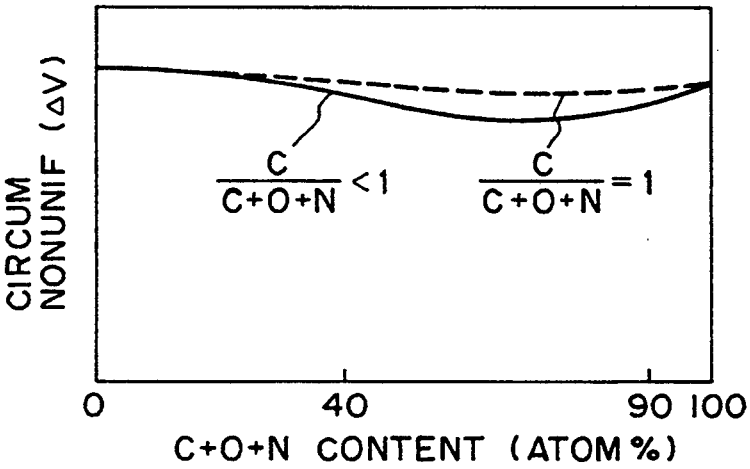
Figure 39C:
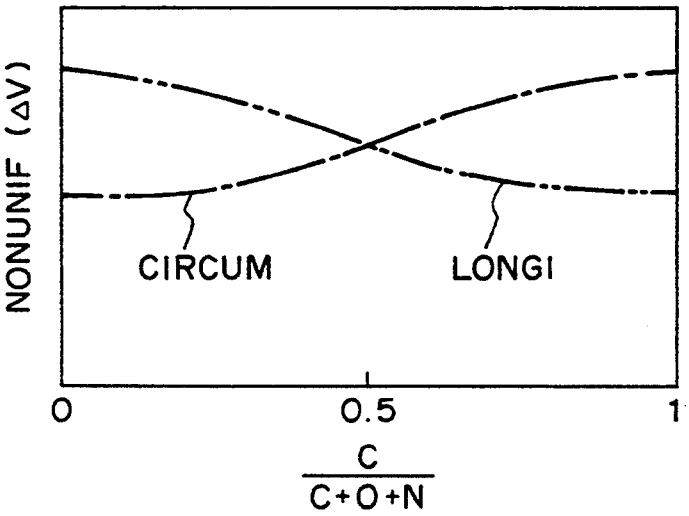

FIGS. 39A, 39B and 39C are concerned with Experiment 15. FIG. 39A is a graph showing a test result of a potential unevenness along the generating line of an a-Si photosensitive member when a sum of carbon, nitrogen and oxygen atom contents (C+N+O) in the surface layer is varied; FIG. 39B is a graph showing a test result of a potential unevenness along the circumference of an a-Si photosensitive member when a sum of carbon, nitrogen and oxygen atom contents (C+N+O) in the surface layer is varied; and FIG. 39C is a graph showing a test result of a potential unevenness along the generating line and along the circumference of an a-Si photosensitive member when a ratio of a carbon atom content to a sum of the carbon atom content and nitrogen and oxygen atom contents (C/(C+N+O)) in the surface layer is varied.

Figure 40A:
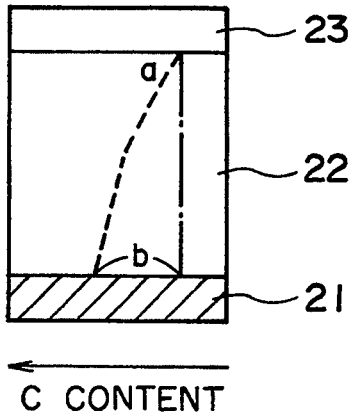
Figure 40B:
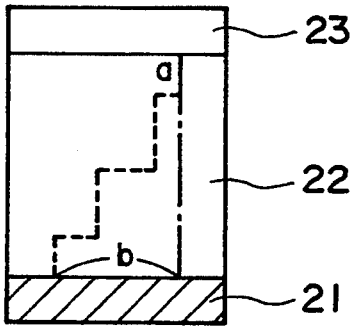
Figure 40C:
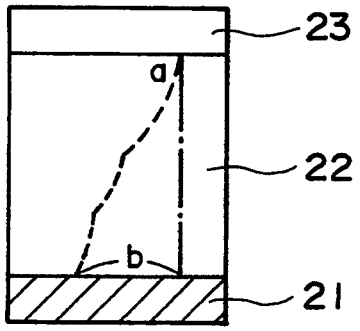

FIGS. 40A, 40B and 40C show layer structures of an a-Si photosensitive member used in this invention and carbon content change patterns in the photoconductive layer.

Figure 41A:
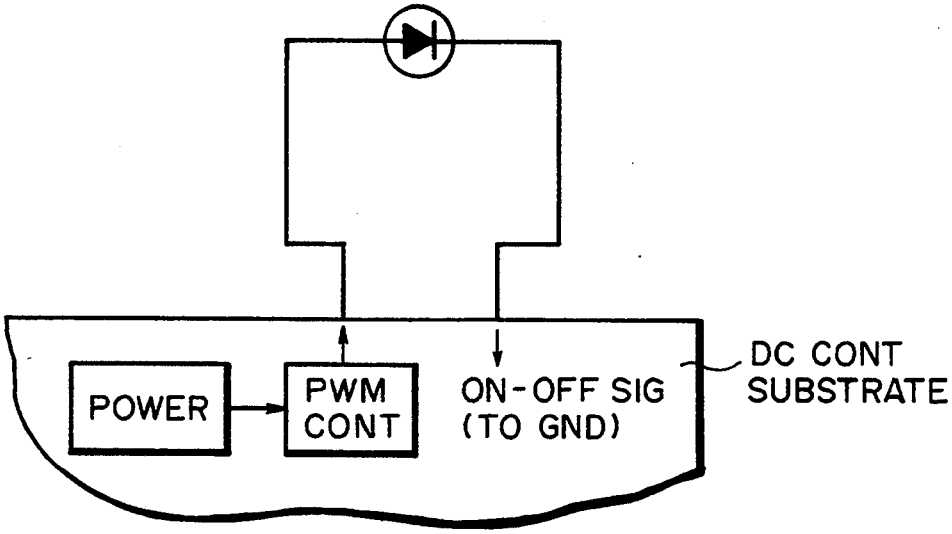

FIG. 41A shows an example of a circuit for main discharge light source actuation used in this embodiment.

Figure 41B:
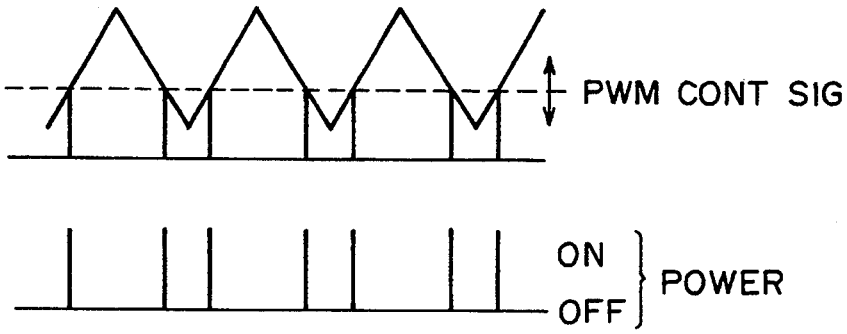

FIG. 41B shows the general idea of pulse width modulation (PWM).

Figure 42:
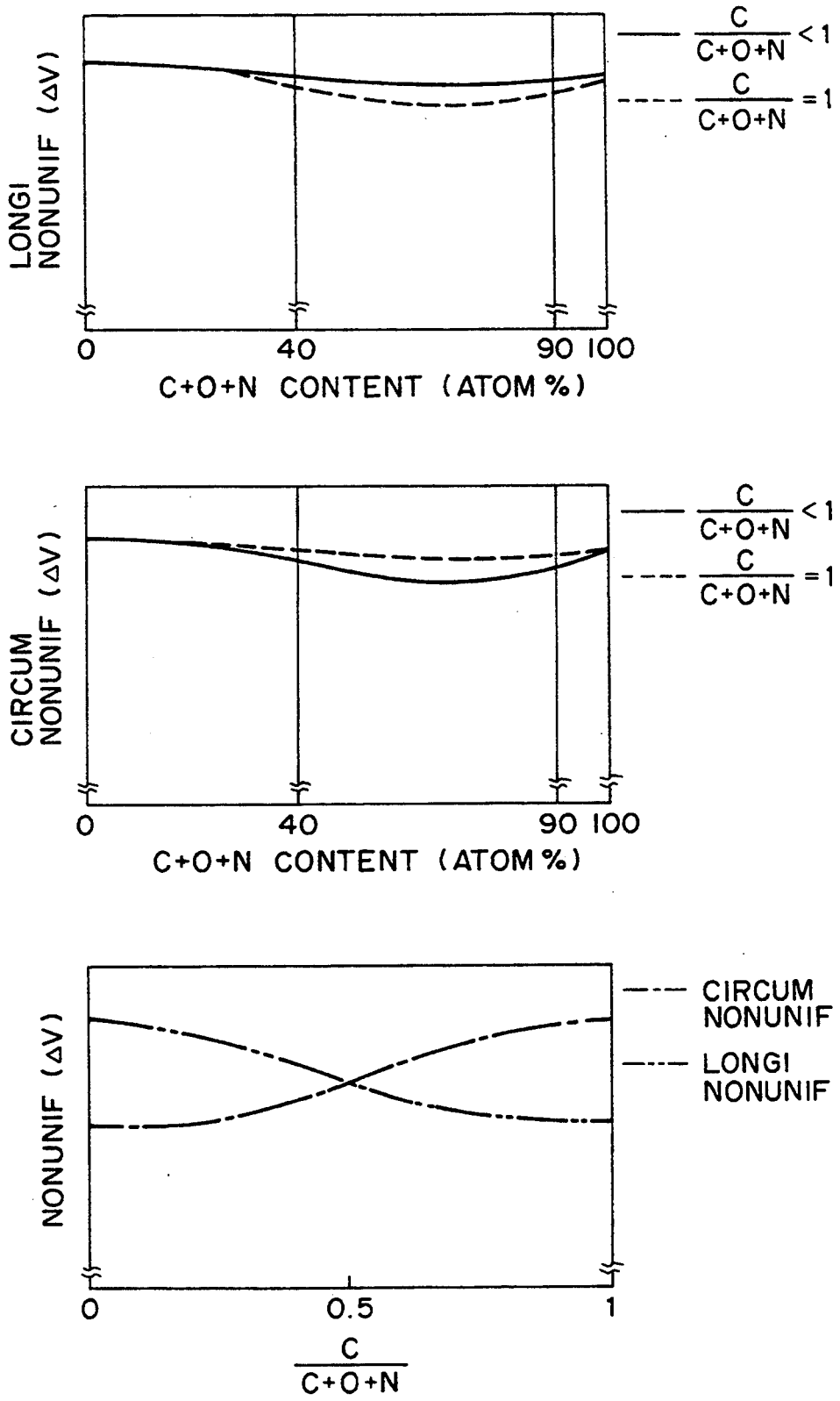

FIG. 42 is graphs showing dependencies of a potential unevenness in the direction of the generating line (longitudinal unevenness) and a potential unevenness in the circumferential direction (circumferential unevenness) on a sum of contents of carbon atoms, nitrogen atoms and oxygen atoms and on a ratio of a carbon atom content to a sum of the contents of the carbon atoms, nitrogen atoms and oxygen atoms.

Figure 43:
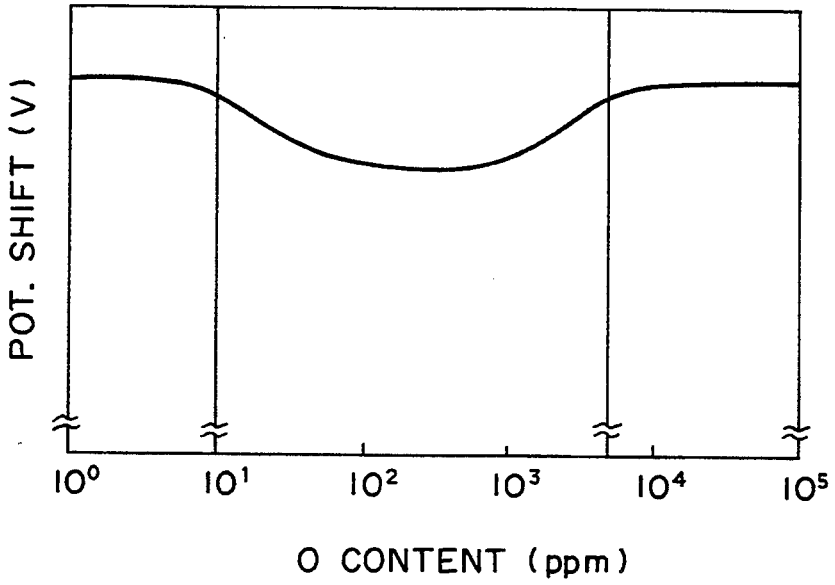

FIG. 43 is a graph showing a change of the potential shift depending on a change of the oxygen atom content in the photoconductive layer.

Figure 44:
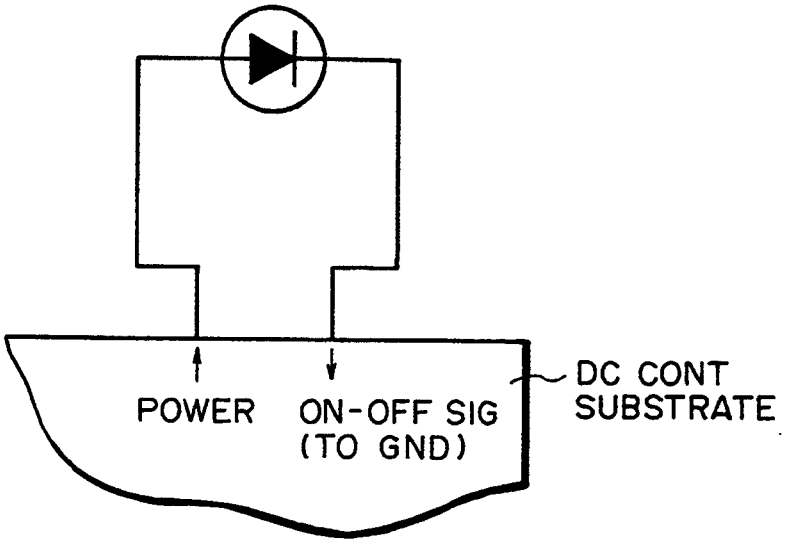

FIG. 44 is a circuit diagram of a conventional main discharging light actuating system.

FIG. 45 is a schematic view of a carbon content change pattern in a photoconductive layer.

Figure 46A:
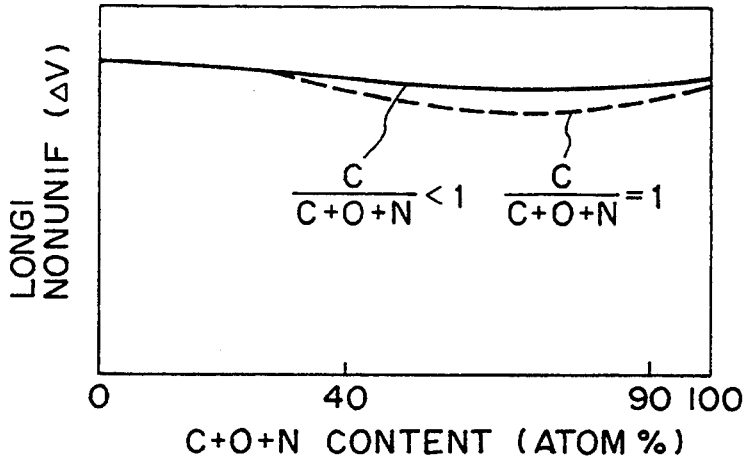
Figure 46B:
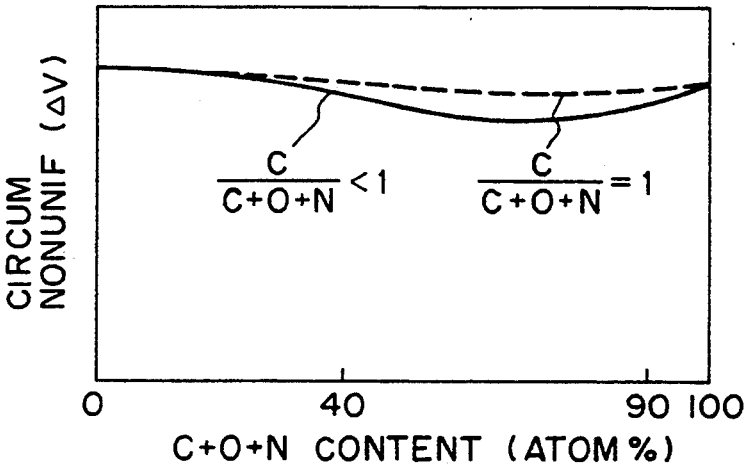
Figure 46C:
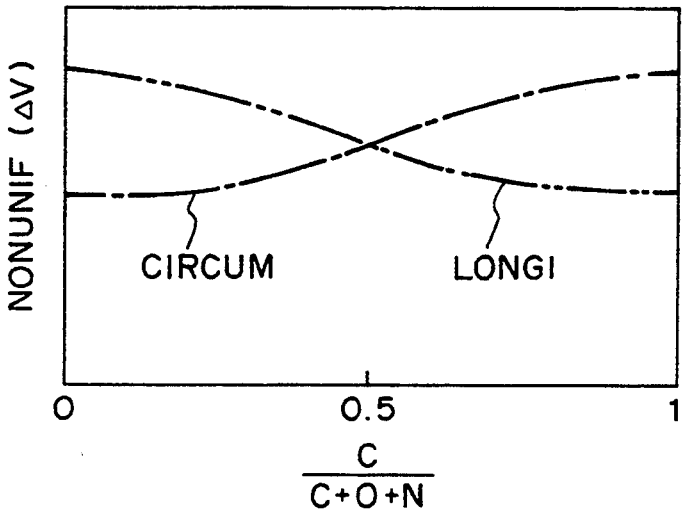

FIGS. 46A, 46B and 46C are concerned with Experiment 18. FIG. 46A is a graph showing a test result of a potential unevenness along the generating line of an a-Si photosensitive member when a sum of carbon, nitrogen and oxygen atom contents (C+N+O) in the surface layer is varied; FIG. 46B is a graph showing a test result of a potential unevenness along the circumference of an a-Si photosensitive member when a sum of carbon, nitrogen and oxygen atom contents (C+N+O) in the surface layer is varied; and FIG. 46C is a graph showing a test result of a potential unevenness along the generating line and along the circumference of an a-Si photosensitive member when a ratio of a carbon atom content to a sum of the carbon atom content and nitrogen and oxygen atom contents (C/(C+N+O)) in the surface layer is varied.

Figure 47:
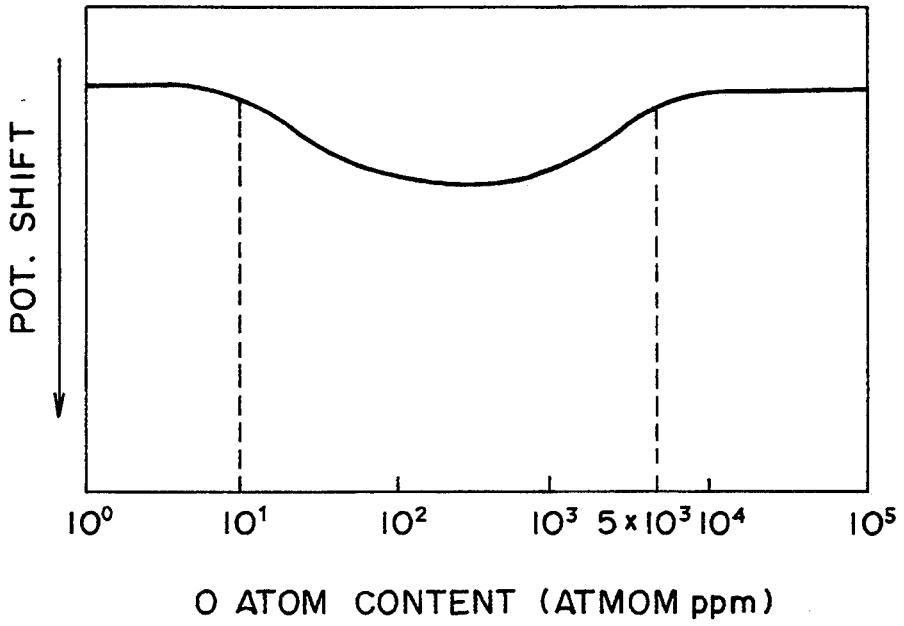

FIG. 47 is a graph showing the potential shift as a result of Experiment 19.

Figure 48A:
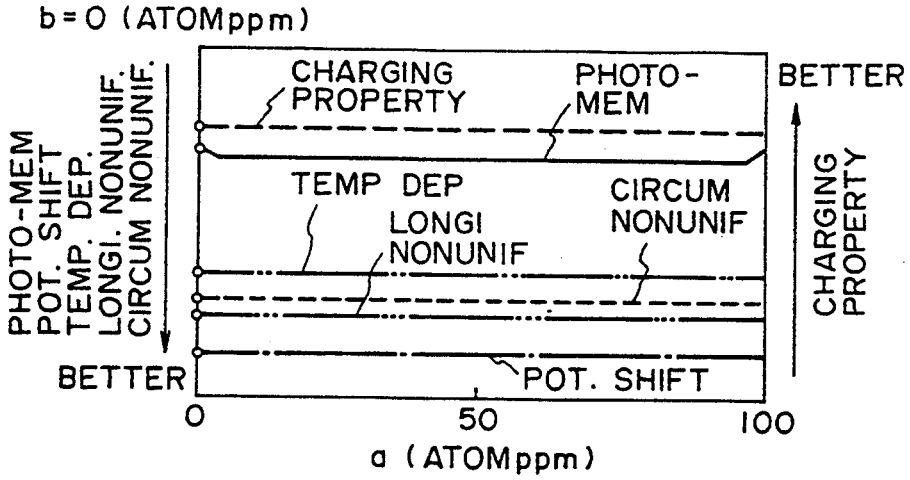
Figure 48B:
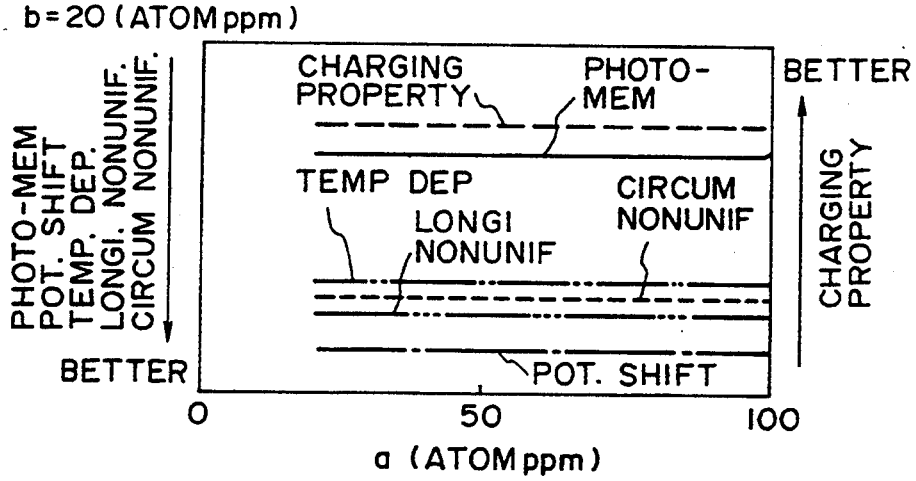
Figure 48C:
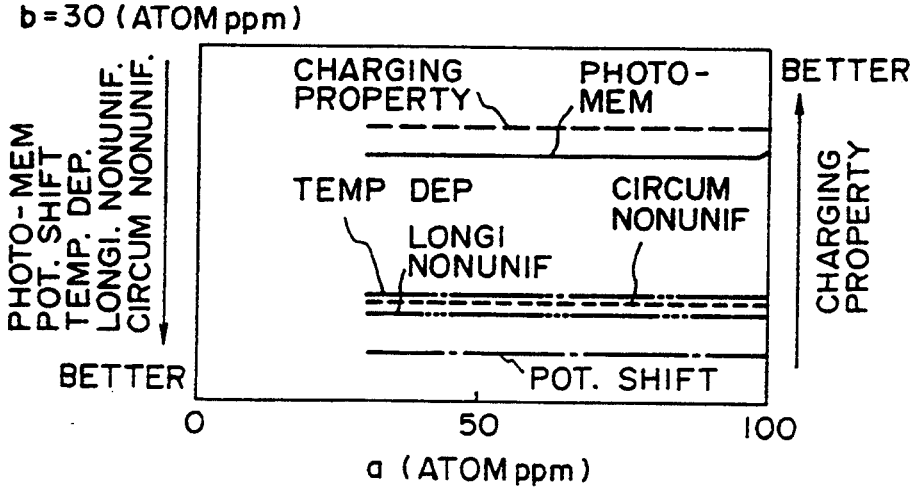
Figure 49A:
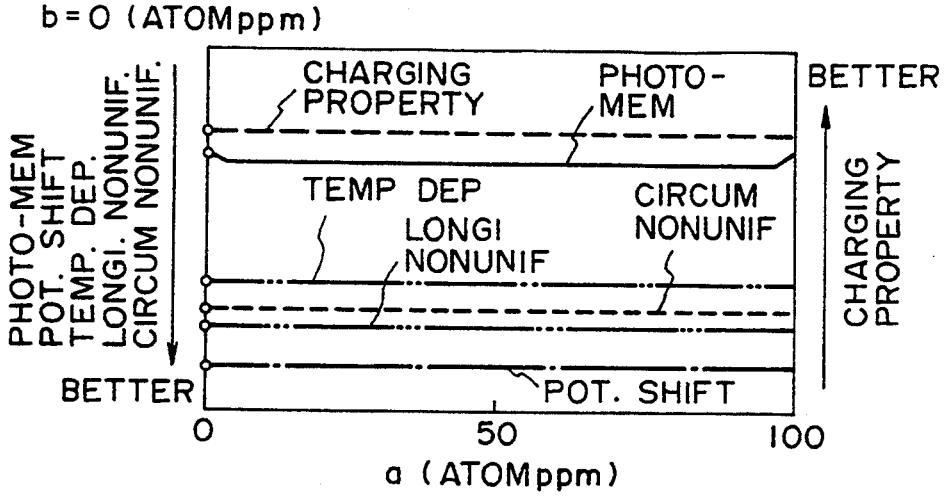
Figure 49B:
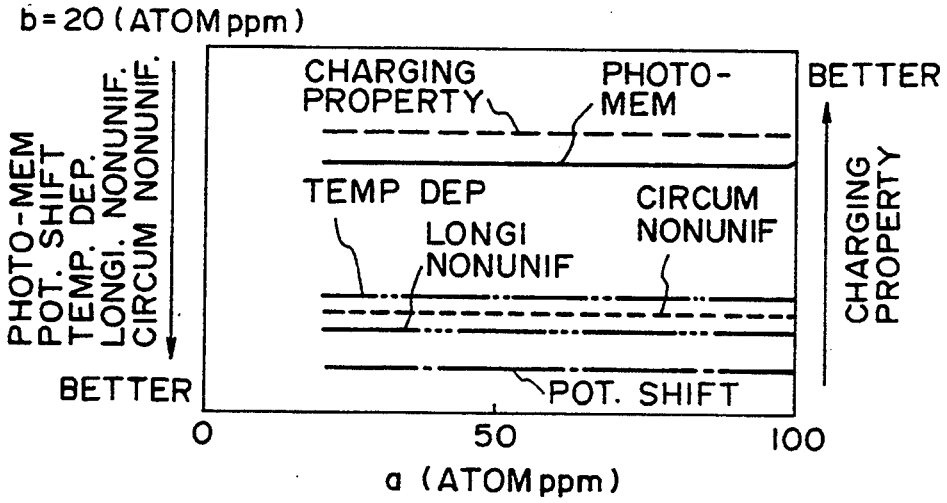
Figure 49C:
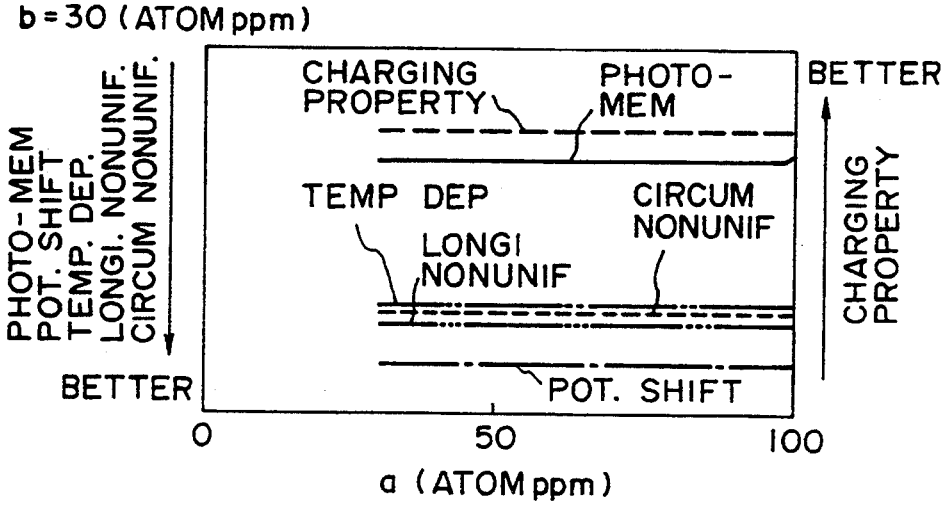
Figure 50A:
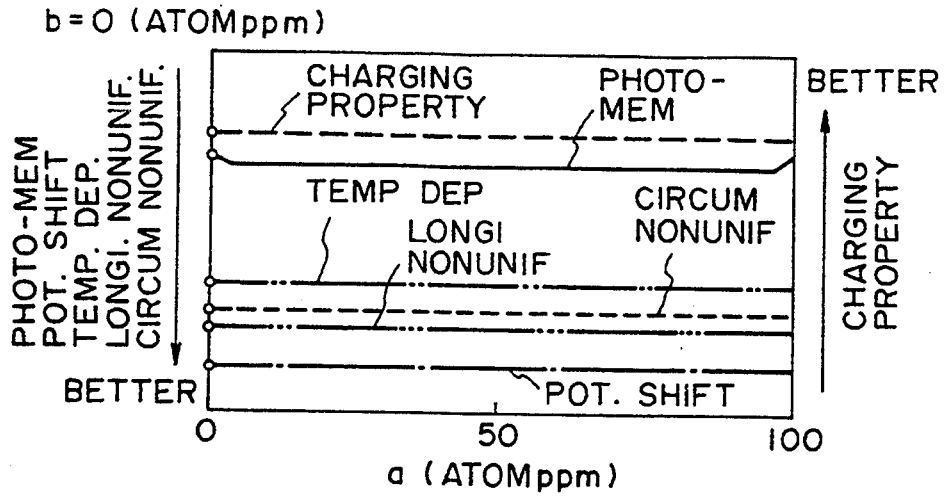
Figure 50B:
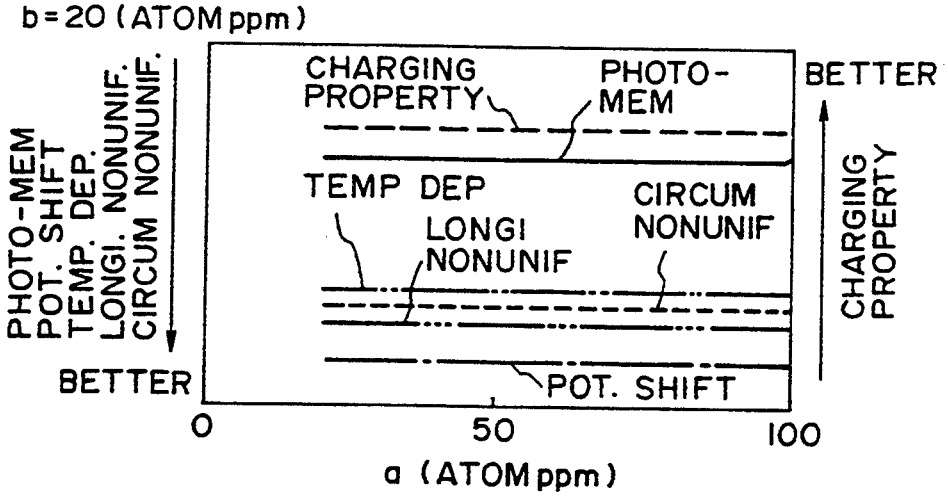
Figure 50C:
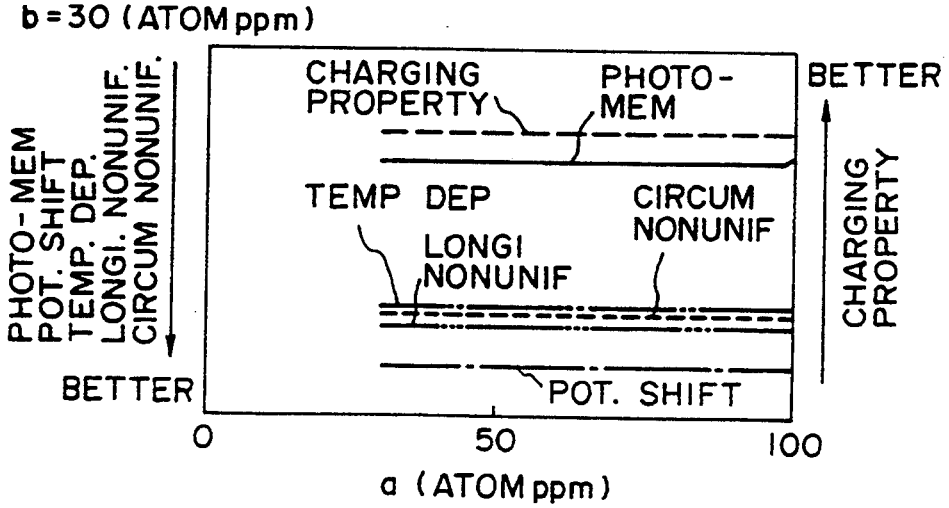

FIGS. 48A, 48B and 48C are concerned with Type 1 shown in FIG. 29A when a fluorine atom content (atomic ppm) in the portion closest to the surface layer is varied, FIG. 48A shows a test result when the fluorine atom content (a−b atomic ppm) in the portion closest to the conductive base is a atomic ppm; FIG. 48B shows a test result when the fluorine atom content (a−b atomic ppm) in the portion closest to the conductive base is a−20 atomic ppm; and FIG. 48C shows a test result when the fluorine atom content (a−b atomic ppm) in the portion closest to the conductive base is a−30 atomic ppm, FIGS. 49A, 49B and 49C are concerned with Type 2 shown in FIG. 29B when a fluorine atom content (atomic ppm) in the portion closest to the surface layer is varied, FIG. 49A shows a test result when the fluorine atom content (a−b atomic ppm) in the portion closest to the conductive base is a atomic ppm; FIG. 49B shows a test result when the fluorine atom content (a−b atomic ppm) in the portion closest to the conductive base is a−20 atomic ppm; and FIG. 49C shows a test result when the fluorine atom content (a−b atomic ppm) in the portion closest to the conductive base is a−30 atomic ppm, FIGS. 50A, 50B and 50C are concerned with Type 3 shown in FIG. 29C when a fluorine atom content (atomic ppm) in the portion closest to the surface layer is varied, FIG. 50A shows a test result when the fluorine atom content (a−b atomic ppm) in the portion closest to the conductive base is a atomic ppm; FIG.

50B shows a test result when the fluorine atom content (a−b atomic ppm) in the portion closest to the conductive base is a−20 atomic ppm; and FIG. 50C shows a test result when the fluorine atom content (a−b atomic ppm) in the portion closest to the conductive base is a−30 atomic ppm.

Figure 51A:
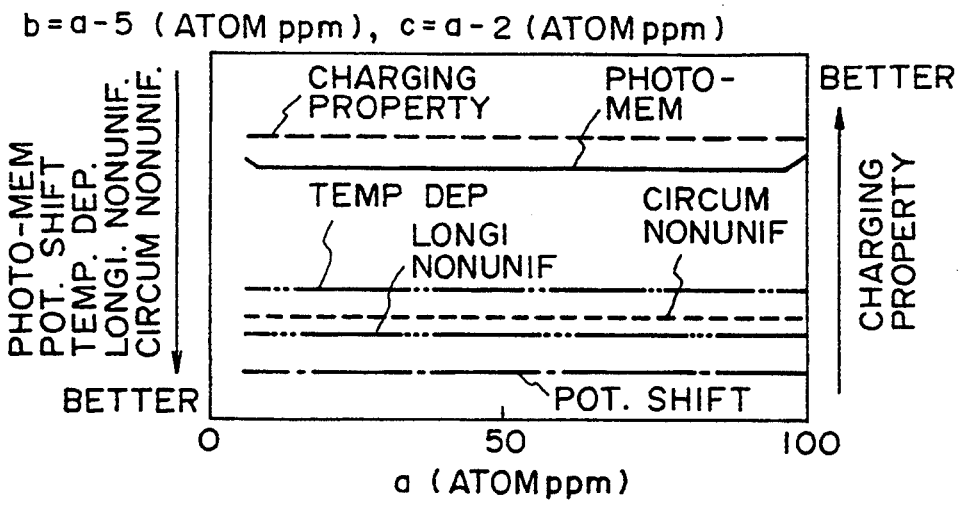
Figure 51B:
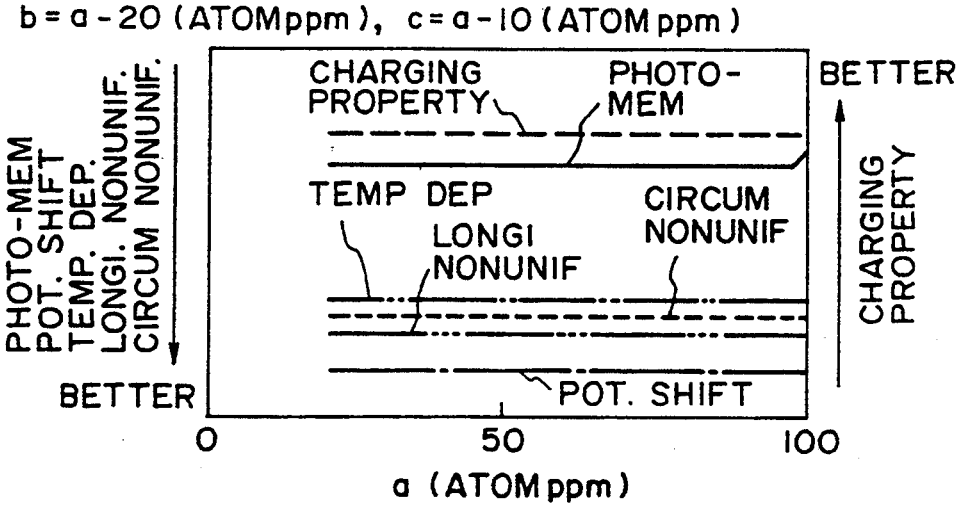
Figure 51C:
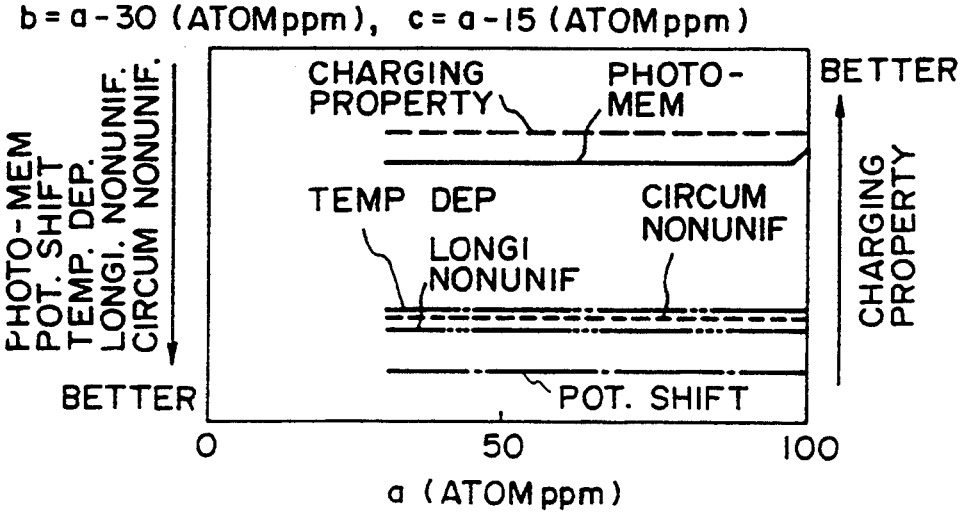

FIGS. 51A, 51B and 51C are concerned with Type 1 shown in FIG. 33A in which the fluorine atom content a in the portion closest to the surface layer is changed. FIG. 51A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 51B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 51C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm.

Figure 52A:
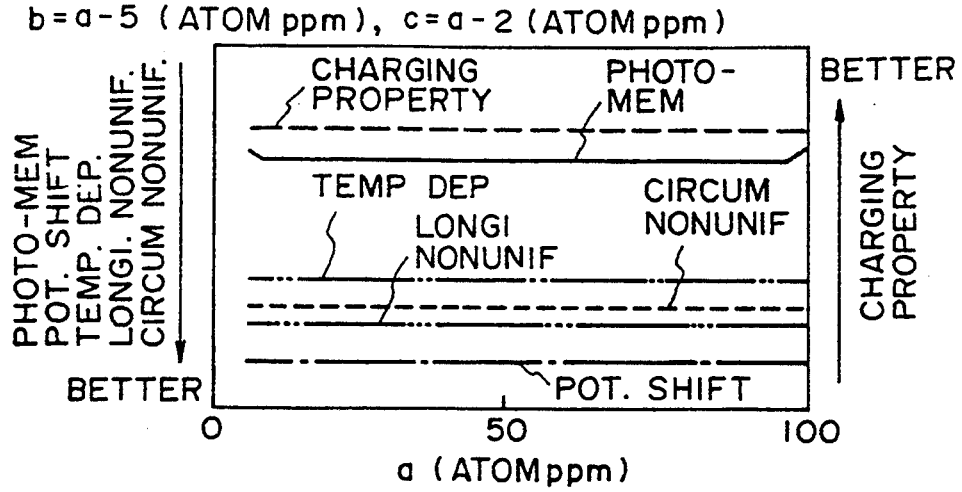
Figure 52B:
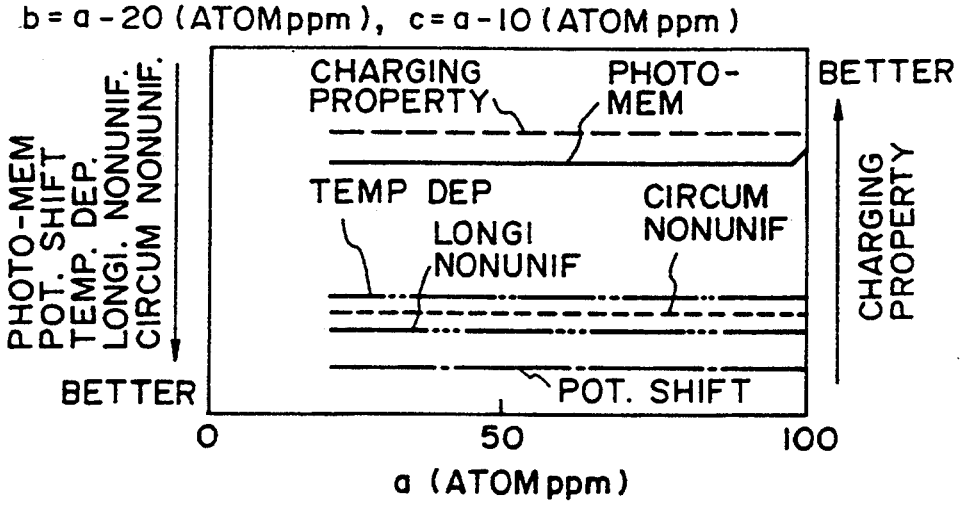
Figure 52C:
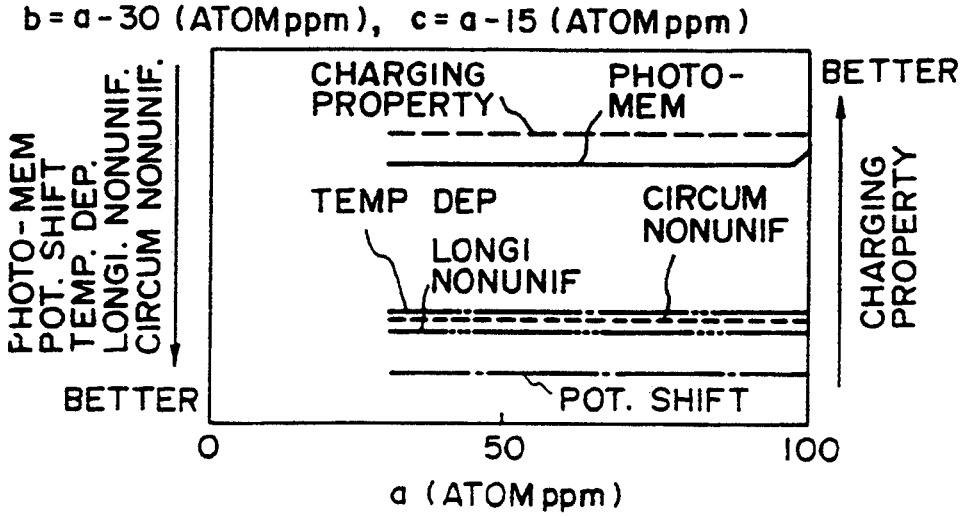

FIGS. 52A, 52B and 52C are concerned with Type 2 shown in FIG. 33B in which the fluorine atom content a in the portion closest to the surface layer is changed. FIG. 52A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 52B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 52C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm.

Figure 53A:
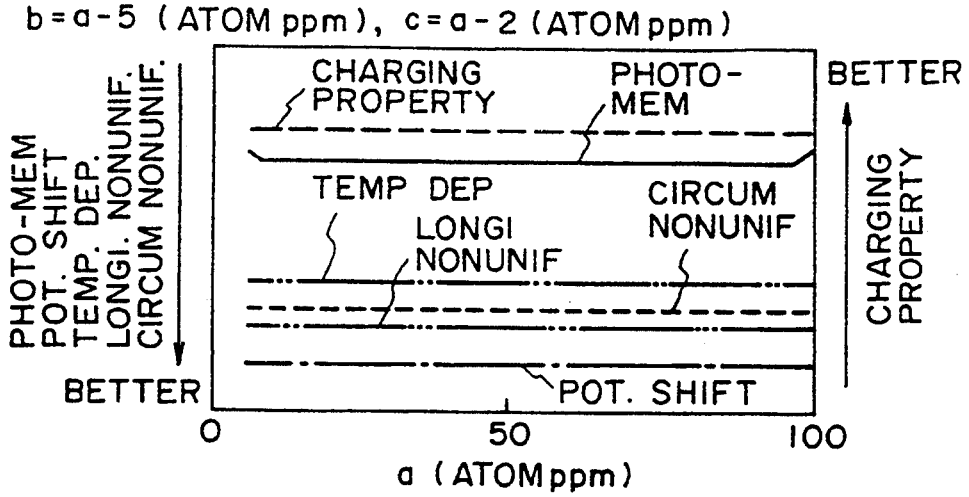
Figure 53B:
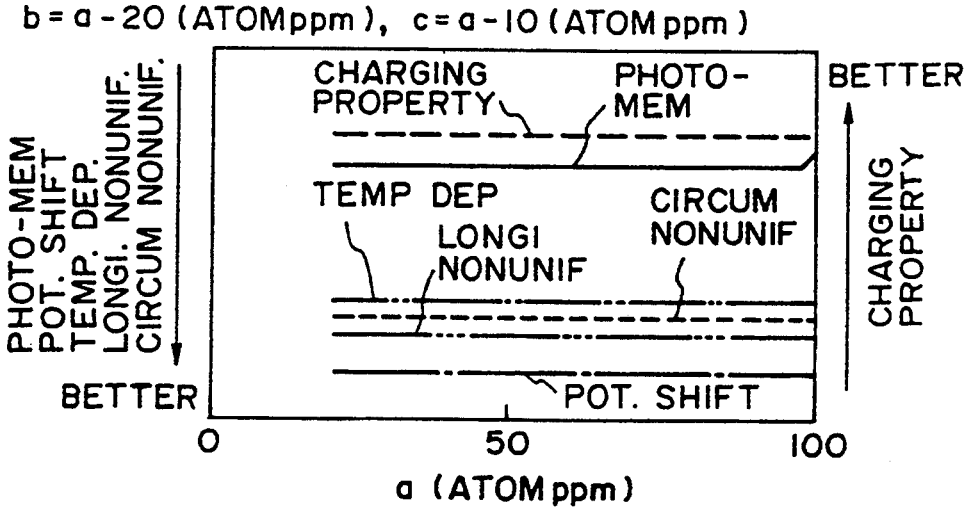
Figure 53C:
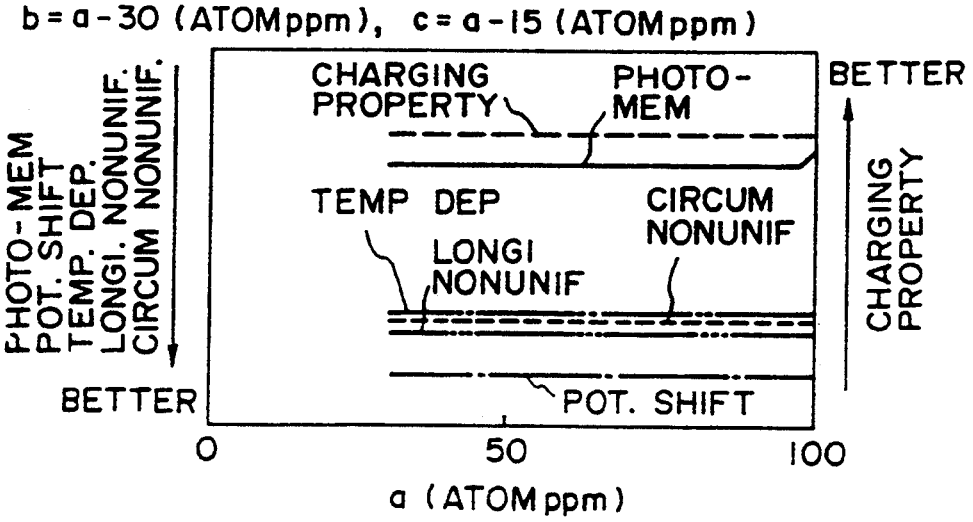

FIGS. 53A, 53B and 53C are concerned with Type 3 shown in FIG. 33C in which the fluorine atom content a in the portion closest to the surface layer is changed. FIG. 53A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 53B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 53C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm.

Figure 54:
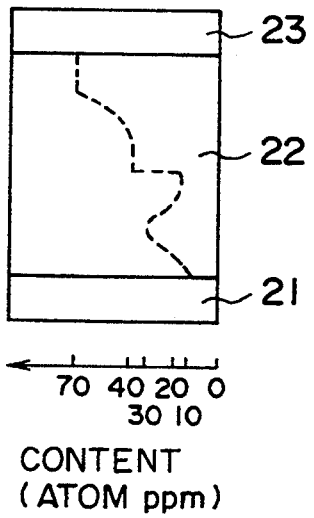

FIG. 54 shows a fluorine atom content distribution in the photoconductive layer of the a-Si photosensitive member used in Experiment 22.

Figure 55:
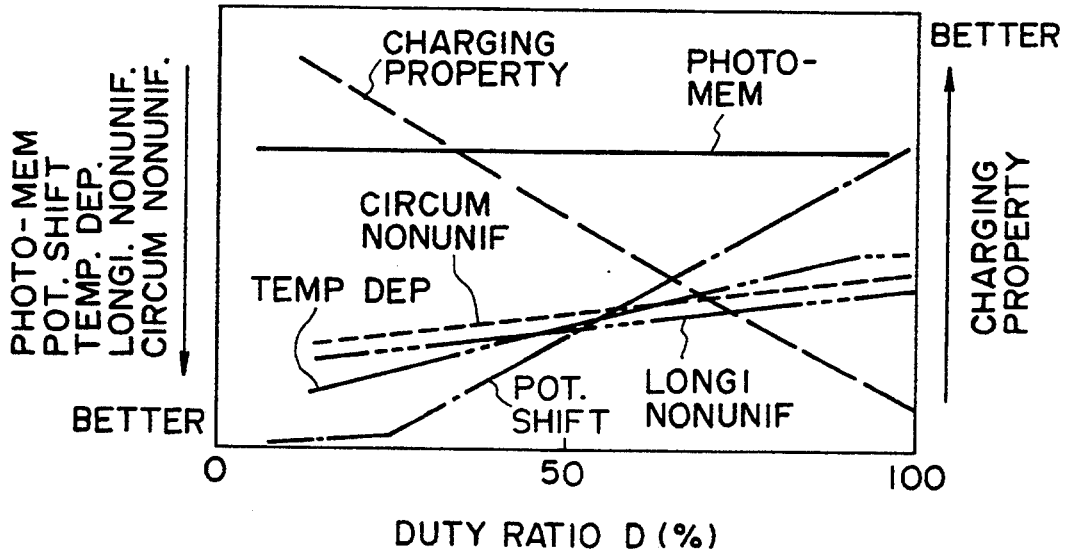

FIG. 55 is a graph showing a result of Experiment 14.

Figure 56:
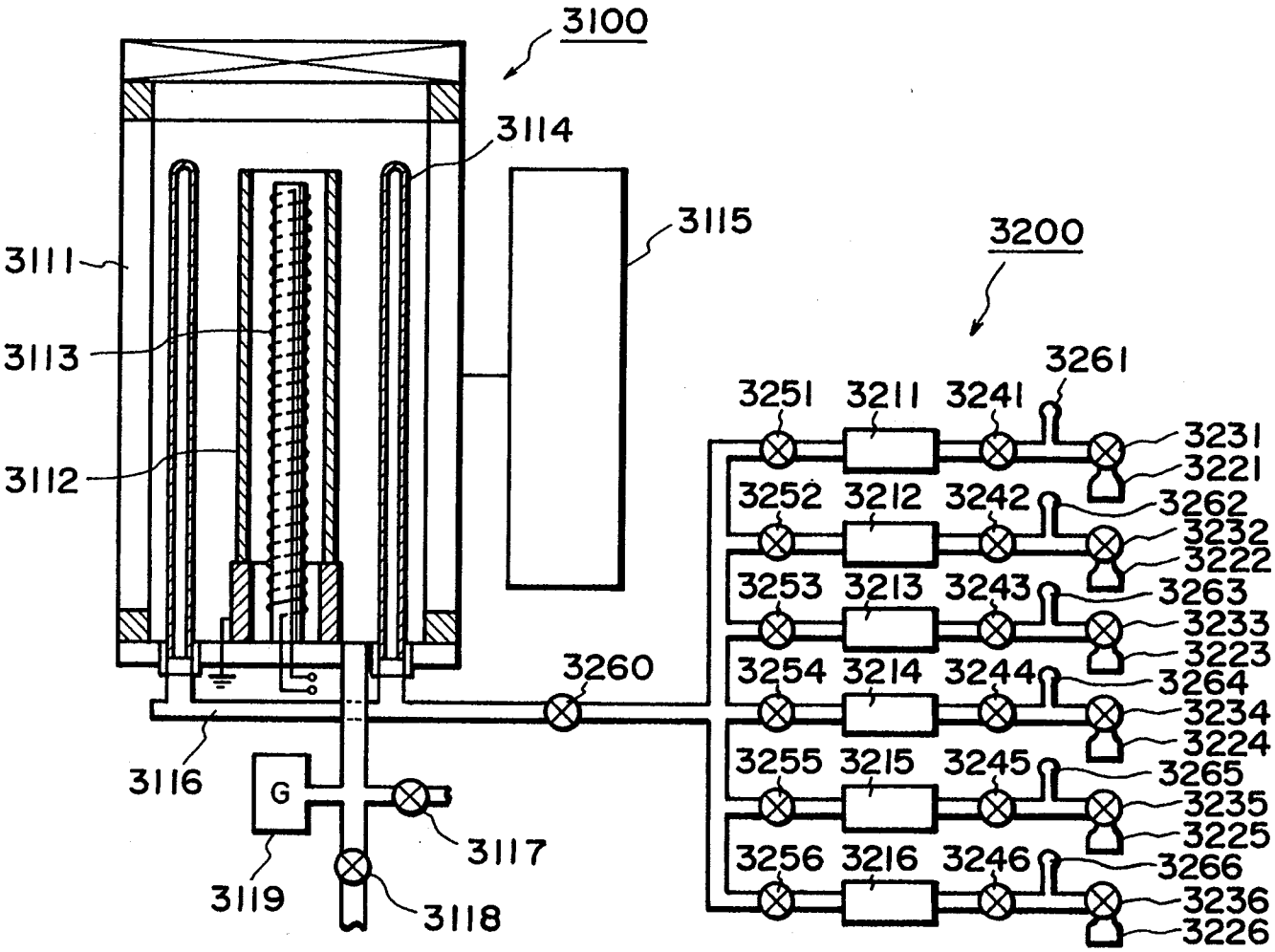

FIG. 56 shows an example of an electrophotographic photosensitive member manufacturing apparatus using RF-PCVD method.

Figure 57:
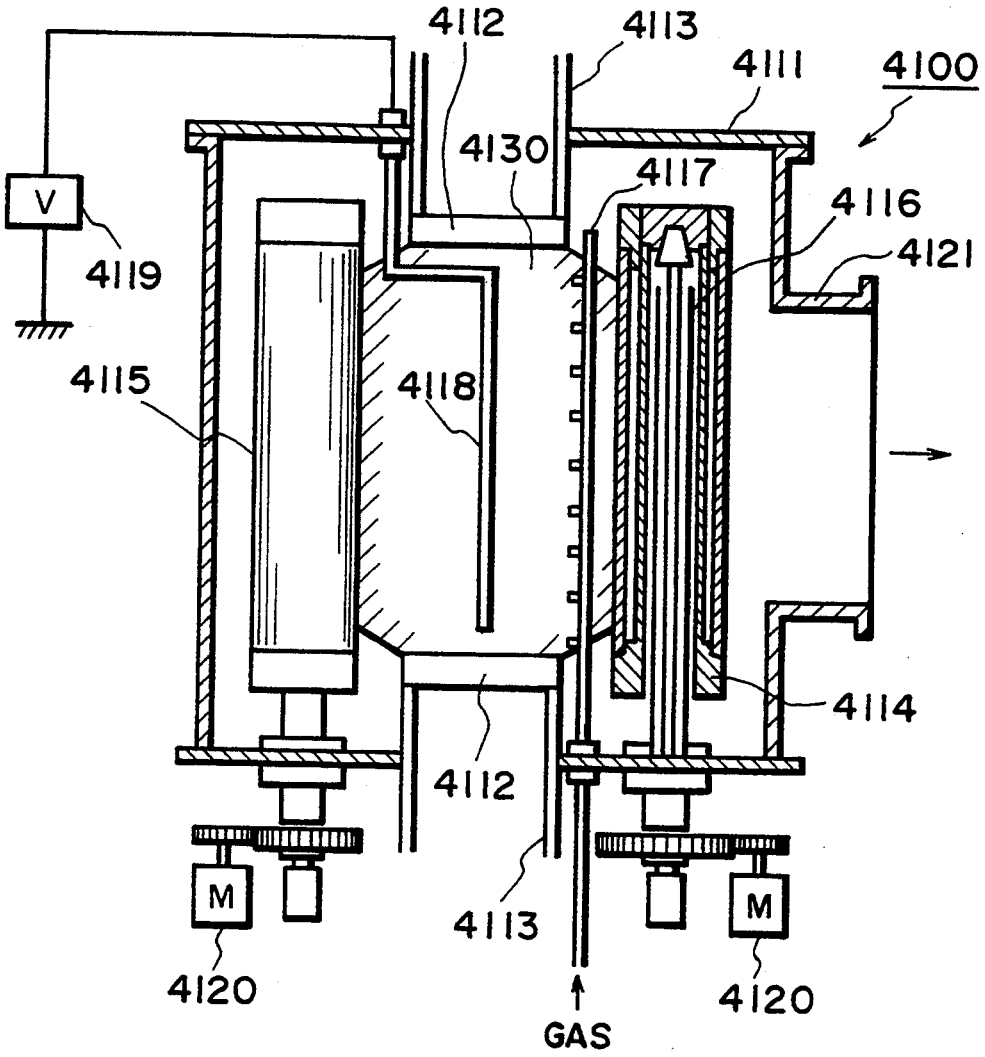

FIG. 57 shows a structure of an example of an accumulation film forming reaction furnace for forming accumulation films for an electrophotographic photosensitive member through μW-PCVD method.

Figure 58:
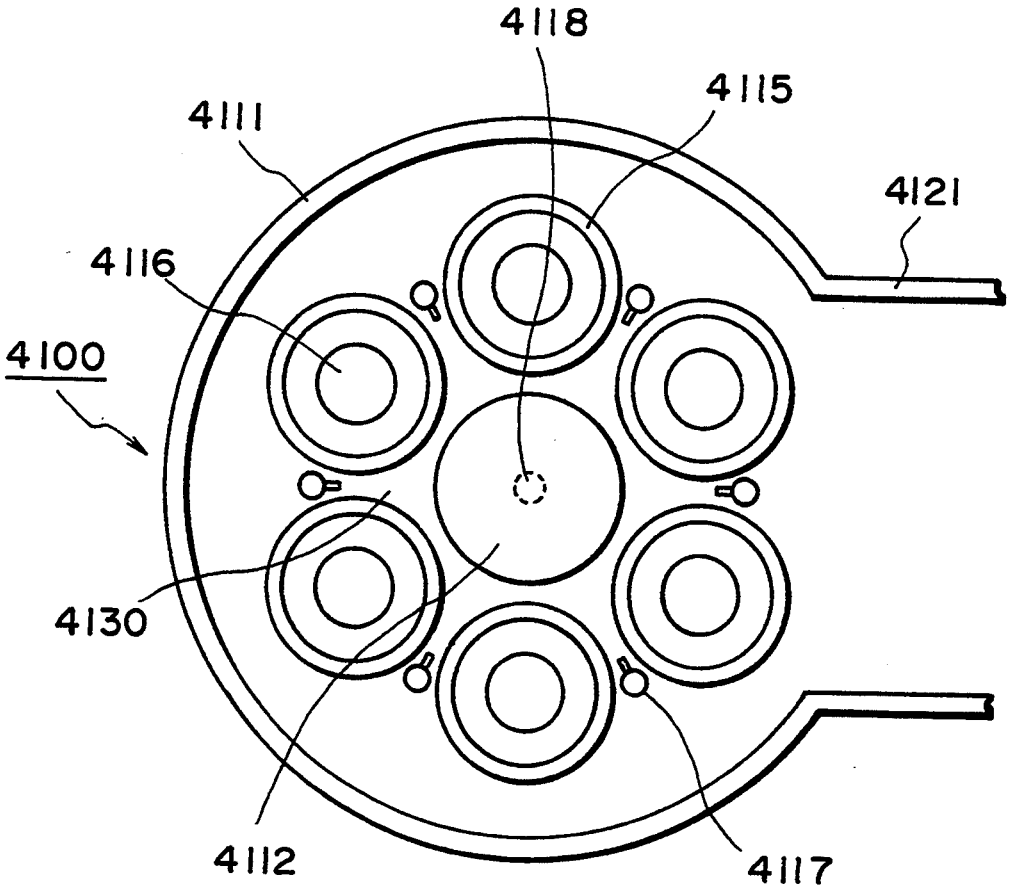

FIG. 58 shows a structure of an example of an accumulation film forming reaction furnace for forming accumulation films of an electrophotographic photosensitive member through μW-PCVD method.

Figure 59:
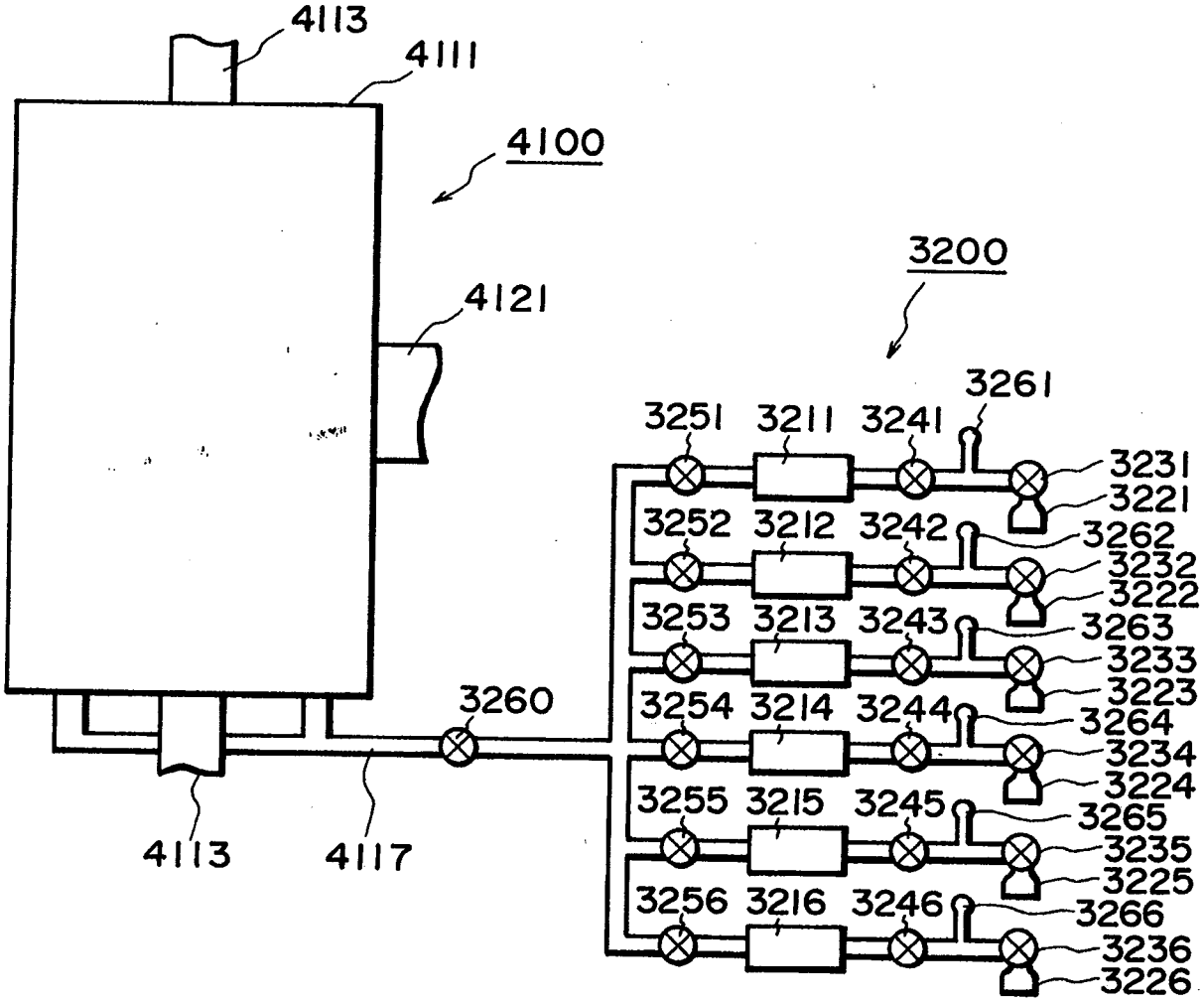

FIG. 59 illustrates an electrophotographic photosensitive member manufacturing apparatus using μW-PCVD method.

Figure 60:
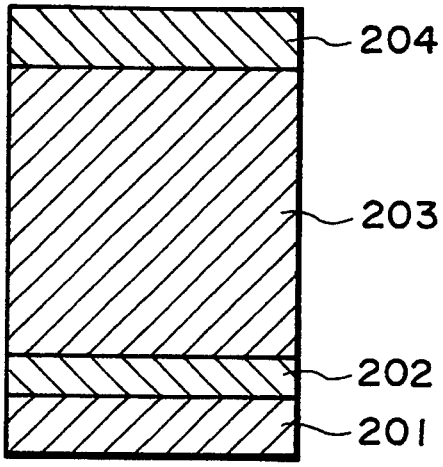

FIG. 60 is a schematic sectional view illustrating structure of a typical amorphous silicon photosensitive member.

Figure 61:
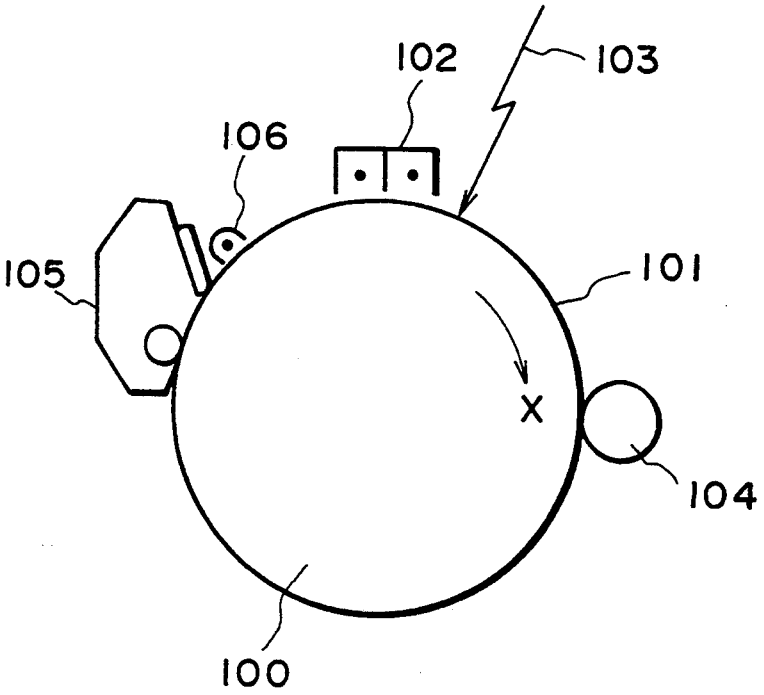

FIG. 61 shows a major part of a conventional example of an electrophotographic apparatus using an amorphous silicon photosensitive member.

DESCRIPTION OF THE PREFERRED EMBODIMENTS

Referring to the accompanying drawings, the embodiments of the present invention will be described.

Embodiment 1

Figure 1B:
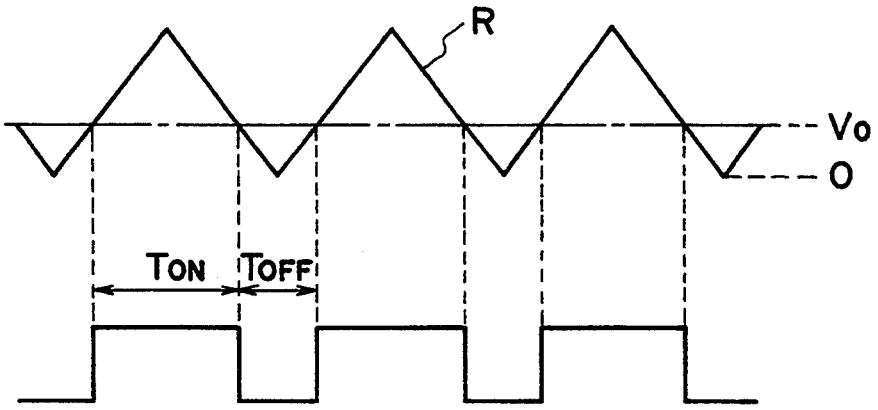
FIG. 1B shows a waveform for illustrating operation of a driving circuit for the apparatus of FIG. 1A.
Figure 2A:
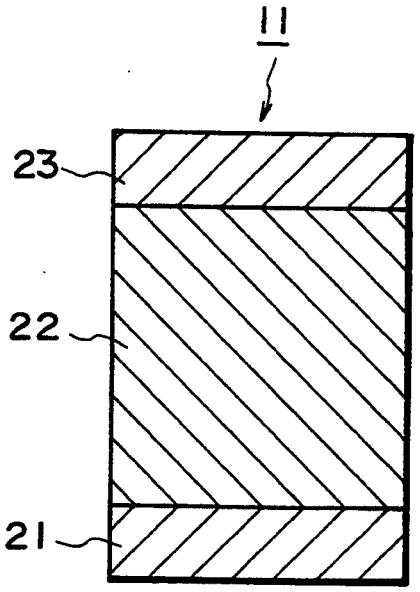
FIG. 2A is a sectional view of an amorphous silicon photosensitive member used in the apparatus of FIG. 1.
Figure 2B:
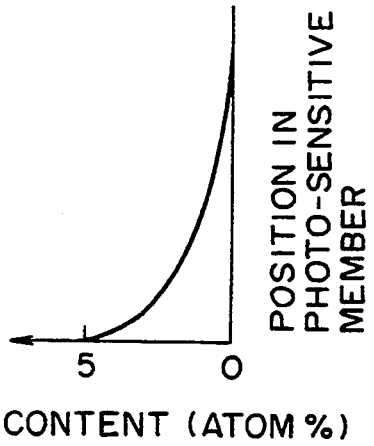
FIG. 2B shows a carbon atom content distribution in the photoconductive layer of the amorphous silicon photosensitive member of FIG. 2A.

Referring to FIG. 1A, there is shown an electrophotographic apparatus using an amorphous silicon photosensitive member according to an embodiment of the present invention. FIG. 1B is a graph explaining operation of a driving circuit 17 shown in FIG. 1A. FIG. 2A is a sectional view showing a structure of the a-Si photosensitive member 11. FIG. 2B shows the carbon atom content distribution in a photoconductive layer 22 of the photosensitive member of FIG. 2A.

The description will be made as to the difference of the electrophotographic apparatus of FIG. 1A from the conventional electrophotographic apparatus shown in FIG. 61.

In a first case:

(1) Apparatus comprises a main discharging light source 16 including LED elements which are disposed close to the surface of the a-Si photosensitive member 11 and are driven through a pulse width modulation system (PWM) using a reference wave R of not more than 10 kHz. The a-Si photosensitive member 11 surface passes by the illumination area at such a speed that the movement speed divided by the reference wave frequency is not more than 1 mm. The main discharging light source 16 is driven by the driving circuit 17 which produces a rectangular wave produced with saw-teeth reference wave R shown in FIG. 1B and having a frequency not more than 10 kHz. The drum 10 is driven by an unshown drum driving device (not shown) including a motor M so as to rotate the drum 10 at such a peripheral speed that the peripheral speed (mm/sec) divided by the frequency of the reference wave R is not more than 1 mm. The main discharging light source may be a laser in place of LED.

(2) The photoconductive layer 22 of the a-Si photosensitive member 11 shown in FIG. 2A contains carbon atoms at a content distribution in which the content is minimum at the interface with the surface layer 23, that is, the portion closest to the surface layer 23. In other words, the content distribution of the carbon atom in the photoconductive layer 22 is such that the content is 0 atomic % at the interface with the surface layer 23 as shown in FIG. 2B, and it is 5 atomic % at the interface with the conductive supporting base 21, that is, the portion closest to the conductive base 21. The distribution continuously changes in parabolicly.

(3) The surface layer 23 of the a-Si photosensitive member 11 contains 40–90 atomic % of carbon atoms.

In a second case (the same apparatus as explained (1) above is used, and a second photosensitive member is used):

(1) The surface layer 23 of the a-Si photosensitive member 11 contains the carbon atoms, nitrogen atoms and oxygen atoms, and a sum of the contents is 40–90 atomic %.

Here, the pulse width modulation energizing system using the reference wave R having the frequency not more than 10 kHz, is itself disclosed in U.S. Pat. No. 4,758,127, and has been used for controlling image exposure light quantity in an electrophotographic apparatus using a laser beam as the image exposure beam. In this embodiment, the pulse width modulation system is used for controlling the quantity of light emitting from the main discharging light source 16. The purpose and the effects are essentially different from those in the case of the image exposure beam.

The pulse width modulation system using the reference wave R having the frequency not more than 10 kHz will be described briefly. As shown in FIG. 1B, by the driving circuit 17, the comparison is made between the reference wave R and the pulse width control signal Vo in their levels, and on the basis of the comparison, a rectangular wave shown in FIG. 1C is produced, and the rectangular wave is supplied to the main discharging light source 16. When the level of the rectangular wave is high, the main discharging light is emitted from the main discharging light source 16. At this time, by changing the level of the pulse width control signal Vo, the ratio between a time duration Ton in which the main discharging light is emitted and a time duration Toff in which the main discharging light is not emitted, that is, Ton/(Ton+Toff), which will hereinafter be called "duty ratio D", can be changed.

Experiment 1–4 will be described in which the light memory, the charging property and the potential shift are improved by using the main discharging light source 16 which is controlled through the pulse width modulation system with the use of a reference wave R having the frequency not more than 10 kHz.

In the experiments, the light memory, the charging property and the potential shift were determined in the following manner:

(1) Light memory:

The light memory was measured in the following manner. First, the charging current of the main charger 12 is adjusted so that the dark potential of the photosensitive member at the developing position is 400 V and the actuation voltage for the original illuminating halogen lamp is adjusted so that the light potential is +50 V when the original is a copy sheet of A3 size. The potential difference at the same portion of the photosensitive member between when the halogen lamp is energized for only the leading portion of the image and when the halogen lamp is not energized, that is, the potential difference at the image trailing portion is detected. The potential difference is defined as the light memory potential.

(2) Charging property:

A dark portion potential is detected at the developing device 14 position when a constant current is flown through the main charger 12 the charging property is considered as being better if the dark portion potential is higher.

(3) Potential shift:

A continuous copying operation is carried out with a constant current through the main charger 12. During this continuous operation, the change of the dark portion potential at the position of the developing device 14 is detected. The potential shift property is considered as being better if the dark portion potential change is Smaller.

Experiment 1

The dependency of the light memory, charging property and potential shift on the wavelength of the light of the main discharging lamp was investigated under the following conditions:

Used machine: Electrophotographic machine of FIG. 1:

Drum peripheral speed: 380 mm/sec (by Motor M or the like)

Power to the light source: DC, Duty ratio D=100%

Light quantity thereof: 5.5 $\mu J/cm^2$ (constant)

Wavelength of the light thereof: Varied

Figure 3:
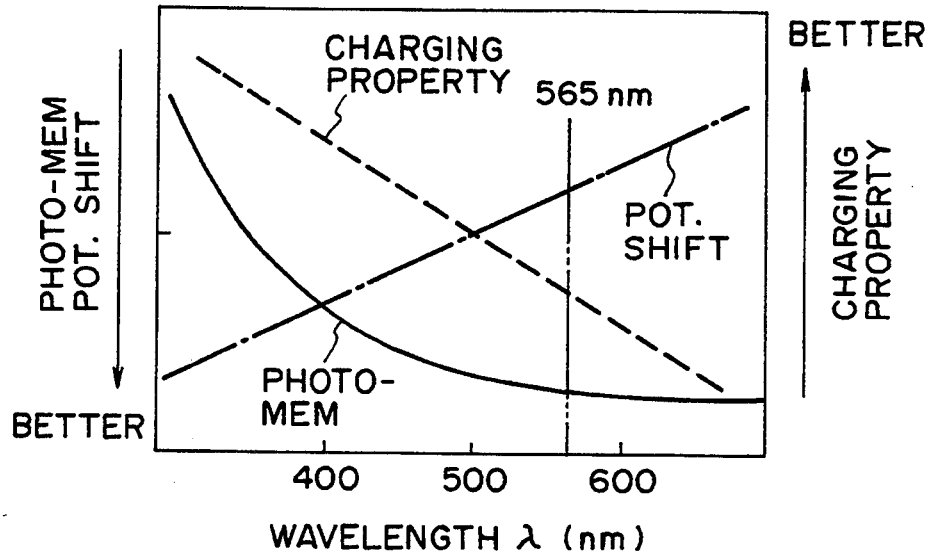
FIG. 3 is a graph showing a result of Experiment 1.

FIG. 3 shows the result of the experiment.

From this result, it is understood, that when the main discharging light source 16 is driven in the same manner has in the continuous DC system, and when the quantity of the light emitted from the main discharging light source 16 is constant, the light memory potential decreases (better light memory prevention) with increase of the wavelength of the main discharging light, whereas the dark portion potential decreases (worse charging property), and the dark portion potential change increases (worse potential shift property) with the increase of the wavelength of the main discharging light.

Experiment 2

The dependency of the light memory, charging property and potential shift on the quantity of light emitted from the main discharging lamp was investigated under the following conditions:

Used machine: Electrophotographic machine of FIG. 1:

Drum peripheral speed: 380 mm/sec

Power to the light source: DC, Duty ratio D=100%

Light quantity thereof: Varied

Wavelength of the light thereof: 565 nm (constant)

Figure 4:
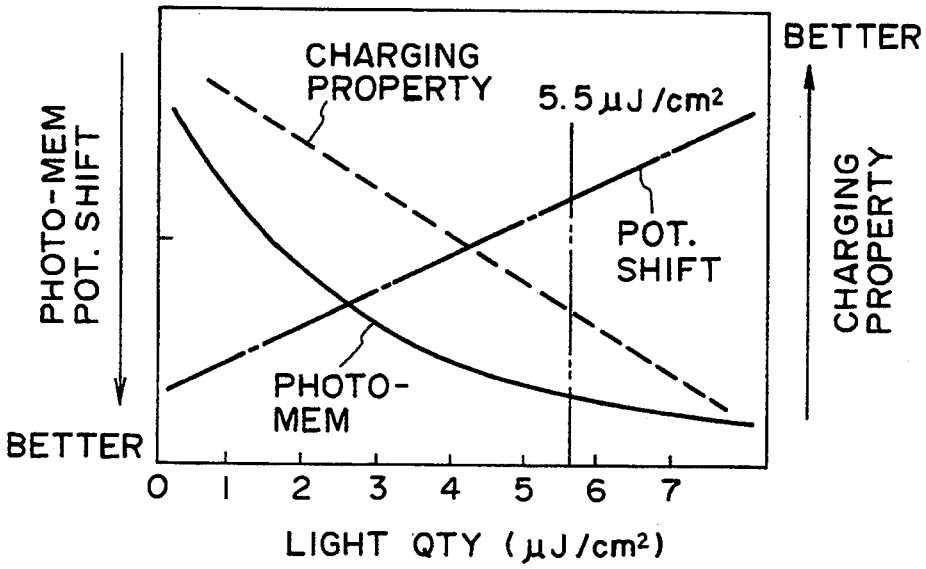
FIG. 4 is a graph showing a result of Experiment 2.

FIG. 4 shows the result of the experiment.

From the result, it is understood that when the main discharging light source 16 is driven in the same manner as in the conventional DC system, and when the wavelength of the main discharging light is constant, the light memory potential decreases (good light memory prevention) with increase of the quantity of the light of the main discharging light source 16, whereas the dark potential decreases (worse charging property), and the dark portion potential change increases (worse potential shift property) with the increase of the light quantity.

Experiment 3

The dependency of the light memory, charging property and potential shift on the duty ratio of the main discharging light was investigated under the following conditions:

Used machine: Electrophotographic machine of FIG. 1:

Drum peripheral speed: 380 mm/sec

Power to the light source: Varied duty ratio D

Light quantity thereof: 5.5 $\mu J/cm^2$ (constant)

Wavelength of the light thereof: 565 nm (constant)

Frequency of reference wave R: 4 KHz (constant)

Figure 5:
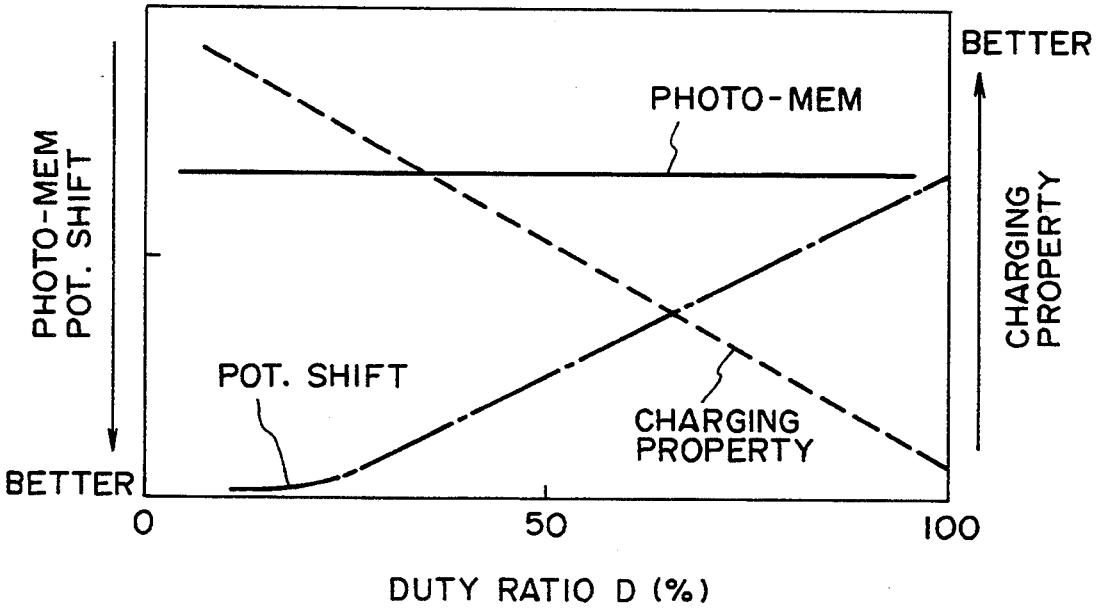
FIG. 5 is a graph showing a result of Experiment 3.

FIG. 5 shows the result of experiments. Here, the change of the duty ratio D of the main discharging light without changing the wavelength, the light quantity and the frequency of the reference wave R of the main discharging light, was effected by changing the illumination intensity of the main discharging light in accordance with the duty ratio D, as shown in FIG. 6A, 6B and 6C.

From the result of the experiments, it is understood that when the light quantity and the wavelength of the main discharging light from the main discharging light source 16 and the frequency of the reference wave R are constant, the light memory potential is substantially the same, no change in the light memory prevention) despite the change of the duty ratio D of the main discharging light, whereas if the duty ratio D of the main discharging light is decreased, the dark portion potential increases (better charging property), and the dark portion potential change decreases (better potential shift property).

Experiment 4

The dependency of the light memory, charging property and potential shift on the reference wave frequency was investigated under the following conditions:

Used machine: Electrophotographic machine of FIG. 1:

Drum peripheral speed: 380 mm/sec

Power to the light source: Duty ratio=25% (constant)

Light quantity thereof: 5.5 $\mu J/cm^2$ (constant)

Wavelength of the light thereof: 565 nm (constant)

FIG. 7 shows the result of the experiments.

From the results of the experiments, when the quantity of light and the wavelength of the main discharging light from the main discharging light source 16 and the duty ratio D are constant, the light memory potential is substantially the same (the same light memory preventing effect) even if the frequency of the reference wave R is changed, whereas there is an upper limit for the frequency of the reference wave R which improves the charging property and the potential shift property from the results of measurements of the dark portion potential and the change thereof. The decrease of the frequency of the reference wave R has revealed that when the value obtained by dividing the drum 10 peripheral speed (mm/sec) by the frequency of the reference wave R exceeds about 1 mm, the uneven light quantity of the main discharging light appears in the circumferential direction of the drum 10, and the therefore, it has been found that the proper frequency of the reference wave R involves a lower limit.

From the foregoing experiments, the following has been found out:

(1) As will be understood from Experiment 1, when the main discharging light of the main discharging light source 16 has the duty ratio D of 100%, that is the energization system for the main discharging light source 16 is the conventional DC system, the dependency of the light memory, the charging property and the potential shift of the wavelength of the main discharging light is as shown in FIG. 3. The light quantity dependency at wavelength $\lambda=565$ nm (chain line) is as shown in FIG. 4. The same tendency is recognized in the other wavelengths. Therefore, the wavelengths range of the main discharging light in which all of the light memory, the charging property and the potential shift can be made satisfactory by controlling the quantity of the light of the main discharging light is 500–700 nm. In this wavelength range, it is not possible to further improve the charging property and the potential shift without changing the light memory level.

(2) From Experiment 3, it has been understood that when the actuation system of the main discharging light source 16 is a pulse width modulation type, if the duty ratio D of the main discharging light from the main discharging light source 16 is decreased, the charging property and the potential shift property may be improved with the light memory level constant (FIG. 5).

(3) From Experiment 4, it has been understood in order to improve the charging property and the potential shift property with the light memory level maintained constant in the case of the pulse width modulation system for the control of the main discharging light source 16, it is desirable that the frequency of the reference wave R is not more than 10 kHz and that the value obtained by dividing the drum peripheral speed (mm/sec) by the frequency of the reference wave R is not more than 1 mm (FIG. 7).

The description will be made as to the Experiment 5–10 in which the light memory, the charging property and the potential shift are investigated with the carbon atom content in the photoconductive layer 11 being changed in the a-Si photosensitive member 11.

Experiment 5

Similarly to Experiment 3, the dependency of the light memory, charging property and potential shift on the duty ratio of the main discharging light was investigated under the following conditions:

Used machine: Electrophotographic machine of FIG. 1:

Drum peripheral speed: 380 mm/sec

Power to the light source: Varied Duty ratio D

Light quantity thereof: 5.5 $\mu J/cm^2$ (constant)

Wavelength of the light thereof: 565 nm (constant)

Frequency of reference wave R: 4 KHz (constant)

Here, the distribution of the carbon atom content in the photoconductive layer 22 was classified into the following types:

(1) As shown in FIGS. 8A, 8C and 8E in broken lines, the carbon atom content is continuously decreased from the conductive base 21 side toward the surface layer 23. FIGS. 8B, 8D and 8F show the result of the measurements.

(2) FIGS. 9A, 9C and 9E in broken lines, the carbon atom content is constant in its thickness detection.

The result of the measurements is shown in FIGS. 9B, 9D and 9F.

(3) As shown in FIGS. 10A, 10C and 10E in broken lines, the carbon atom content is continuously decreased from the surface layer 23 side toward the conductive base 21. FIGS. 10B, 10D and 10F show the result of measurements.

(4) FIGS. 11A, 11C and 11E by broken lines, the carbon atom content is continuously increased from the conductive base 21 side to the surface layer 23, and thereafter, it is decreased. The result of measurements is shown in FIGS. 11B, 11D and 11F.

From these experiments, the following has been found out:

When the comparison is made between the results shown in FIGS. 8 and 11 and the results shown in FIGS. 9 and 10, the results of FIGS. 8 and 11 are better in all of the light memory, charging property and the potential shift property.

Experiment 6

Similarly to Experiment 4, the dependency of the light memory, charging property and potential shift on the reference wave frequency was investigated under the following conditions:

Used machine: Electrophotographic machine of FIG. 1:

Drum peripheral speed: 380 mm/sec

Power to the light source: Constant Duty ratio D of 25%

Light quantity thereof: 5.5 $\mu J/cm^2$ (constant)

Wavelength of the light thereof: 565 nm (constant)

Frequency of reference wave R: Varied

Here, the carbon atom content distribution in the photoconductive layer 22 in the a-Si photosensitive member 11 was classified into the following four types:

(1) As shown in FIGS. 12A, 12C and 12E by broken lines, the carbon atom content is continuously decreased from the conductive base 21 side toward the surface layer 23. The result of measurements is shown in FIGS. 12A, 12B and 12F.

(2) As shown in FIGS. 13A, 13C and 13E by broken lines, the carbon atom content is constant in the thickness direction of the photoconductive layer. The result of measurements is shown in FIGS. 13B, 13D and 13F.

(3) As shown in FIGS. 14A, 14C and 14E, the carbon atom content is continuously decreased from the surface layer 23 side toward the conductive base 21. The result of measurements is shown in FIGS. 14B, 14D and 14F.

(4) As shown in FIGS. 15A, 15C and 15E by broken lines, the carbon atom content is continuously increased from the conductive base 21 side toward the surface layer 23, and thereafter, it is decreased. The result of measurements is shown in FIGS. 15B, 15D and 15F.

From the foregoing experiments, the following has been found out.

When the comparison is made between the results shown in FIGS. 12 and 14 and the results shown in FIGS. 13 and 15, the results of FIGS. 12 and 15 are better in all of the light memory, the charging property and the potential shift property.

Experiment 7

The light memory, charging property and potential shift were investigated under the following conditions:

Used machine: Electrophotographic machine of FIG. 1:

Drum peripheral speed: 380 mm/sec

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 kHz

The carbon atom content distribution in the photoconductive layer 22 of the a-Si photosensitive member was classified into three types, as follows:

(1) Type 1: As shown in FIG. 16A, the carbon atom content was the minimum, i.e., a atomic % at the portion closest to the surface layer, was the maximum, i.e., a+b atomic % at the portion closest to the conductive base, and was changed continuously therebetween:

(2) Type 2: As shown in FIG. 16B, the carbon atom content was the minimum, i.e., a atomic % at the portion closes to the surface layer, was the maximum, i.e., a+b atomic % at the portion closest to the conductive base, and was changed stepwisely therebetween: and (3) Type 3: As shown in FIG. 16C, the carbon atom content was the minimum, i.e., a atomic % at the portion closest to the surface layer, was the maximum, i.e., a+b atomic % at the portion closest to the conductive base, and was changed stepwisely at least at one position and continuously at the other.

FIGS. 17A, 17B and 17C are concerned with Type 1 shown in FIG. 16A and are graphs showing the test results of the light memory, the charging property and the potential shift in which the carbon atom content (a atomic %) in the portion closest to the surface layer is varied. FIG. 17A is concerned with the case of the carbon atom content (a+b atomic %) in the portion closest to the conductive base being a+1 atomic %; FIG. 17B is concerned with the case of the carbon atom content (a+b atomic %) in the portion closest to the conductive base being a+20 atomic %; FIG. 17C is concerned with the case of the carbon atom content (a+b atomic %) in the portion closest to the conductive base being a+30 atomic %. FIGS. 18A, 18B and 18C show the same but for type 2. FIG. 19A, 19B and 19C show the same but for type 3.

From the result of experiments shown in FIGS. 17–19, the light memory, the charging property and the potential shift are hardly dependent on the distribution of the carbon atom content in the photoconductive layer 22 or on the carbon atom content (a atomic %) in the position closest to the surface layer 23.

Experiment 8

The light memory, charging property and potential shift were investigated under the following conditions:

Used machine: Electrophotographic machine of FIG. 1:

Drum peripheral speed: 380 mm/sec

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 kHz (constant)

The carbon atom content distribution in the photoconductive layer 22 of the a-Si photosensitive member was classified into three types, as follows:

(1) Type 1: As shown in FIG. 20A, the carbon atom content was the minimum, i.e., a atomic % at the portion closest to the surface layer, was the maximum, i.e., a+b atomic % between the surface layer 23 and the conductive base, and was a+c atomic % at the portion closest to the conductive base, and was changed continuously therebetween:

(2) Type 2: As shown in FIG. 20B, the carbon atom content was the minimum, i.e., a atomic % at the portion closes to the surface layer, was the maximum, i.e., a+b atomic % between the surface layer 23 and the conductive base, and was a+c atomic % at the portion closest to the conductive base, and was changed stepwisely therebetween: and (3) Type 3: As shown in FIG. 20C, the carbon atom content was the minimum, i.e., a atomic % at the portion closest to the surface layer, was the maximum, i.e., a+b atomic % between the surface layer 23 and the conductive base, and was a+c atomic % at the portion closest to the conductive base, and was changed stepwisely at least at one position and continuously at the other.

FIGS. 21A, 21B and 21C are concerned with Type 1 shown in FIG. 20A and are graphs showing the test results of the light memory, the charging property and the potential shift in which the carbon atom content (a atomic %) in the portion closes to the surface layer is varied. FIG. 21A is concerned with the case in which the content (a+b atomic %) between the surface layer and the conductive base is a+5 atomic %, and the carbon atom content (a+c atomic %) in the portion closest to the conductive base is a+2 atomic %; FIG. 21B is concerned with the case in which the content (a+b atomic %) between the surface layer and the conductive base is a+20 atomic %, and the carbon atom content (a+c atomic %) in the portion closest to the conductive base is a+10 atomic %; and FIG. 21C is concerned with the case in which the content (a+b atomic %) between the surface layer and the conductive base is a+30%, and the carbon atom content (a+c atomic %) in the portion closest to the conductive base is a+15 atomic %. FIGS. 22A, 22B and 22C show the same but for type 2. FIGS. 23A, 3B and 23C show the same but for type 3.

From the results shown in FIGS. 21A–21C, 22A–22C and 23A–23C, it is understood that the light memory, the charging property and the potential shift are hardly dependent on the carbon atom content a atomic % in the portion closest to the surface layer 23, the content a+b atomic % between the surface layer 23 and the conductive base 21, or the carbon atom content a+c atomic % in the portion closest to the conductive base 21.

Experiment 9

The dependency of the light memory, charging property and potential shift on the duty ratio of the main discharging light was investigated under the following conditions:

Used machine: Electrophotographic machine of FIG. 1:

Drum peripheral speed: 380 mm/sec

Power to the light source: Varied duty ratio D

Light quantity thereof: 5.5 $\mu J/cm^2$ (constant)

Wavelength of the light thereof: 565 nm

Frequency of reference wave R: 4 KHz

Here, the carbon atom content distribution in the photoconductive layer 22 of the a-Si photosensitive member 21 is as shown in FIG. 24, that is, it changes stepwisely at least at one position from the surface layer 23 to the conductive base 21, and it changes continuously at the other portions. However, the carbon atom content at the position closest to the surface layer 23 is the minimum, i.e., 0 atomic %. FIG. 25 shows the result of the measurements.

From the result, it is understood that the light memory, the charging property and the potential shift can be made satisfactory by reducing the duty ratio of the main discharging light, even when the carbon atom content distribution in the photoconductive layer 22 is such that the carbon content stepwisely changes at least at one position from the surface layer 23 toward the conductive base 21.

Experiment 10

Carbon atom content distribution in the photoconductive layer 22 of the a-Si photosensitive member 11 was as shown in FIG. 16A (type 1), with a=0 atomic % and b=10 atomic %. The carbon atom content in the surface layer 23 was varied, and the potential unevenness in the direction of the generating line of the a-Si photosensitive member 11 was measured.

The experimental conditions are as follows:

Used machine: Electrophotographic machine of FIG. 1:

Drum peripheral speed: 380 mm/sec

Light source of the main discharger: LED

Power to the light source: Constant Duty ratio of 25%

Light quantity thereof: 5.5 $\mu J/cm^2$ (constant)

Wavelength of the light thereof: 565 nm (constant)

Frequency of reference wave R: 4 KHz (constant)

The potential unevenness in the direction of the generating line of the a-Si photosensitive member was determined in the following manner. The charging current of the main charger 12 is adjusted so as to provide a dark portion potential of 400 V at the position of the developing device (FIG. 1). The actuation voltage for the halogen lamp for emitting the exposure light 13 is adjusted to provide a light portion voltage of 200 V when the original to be copied is a blank copy sheet of A3 size. The light portion potentials are measured at the center of the a-Si photosensitive member 11 in the direction of the generating line thereof, at two portions 7 cm away therefrom in the same direction and at two positions 14 mm away from the center in the same direction. The difference between the maximum and the minimum of the measurements is defined as the potential unevenness in the generating line direction.

FIG. 26 shows the result of the experiments.

From the result, it is understood that the potential evenness in the generating line direction is improved when the carbon atom content in the surface layer 23 is 40–90 atomic %, and it is particularly improved when the carbon atom content is 50–80 atomic %.

From the results of the Experiment 5–10, the following has been found out:

(1) When the main discharging light source 16 (FIG. 1) is driven through a pulse width modulation system with the reference wave R having a frequency not more than 10 kHz, and the photosensitive member is pulse-exposed with high intensity, the charging property and the potential shift property can be improved with the light memory maintained at the satisfactory level.

(2) When the carbon atom content is minimum at a position closest to the surface layer 23 in the photoconductive layer 22 of the a-Si photosensitive member, the above-described advantageous effects are remarkable irrespective of the distribution of the carbon atom content distribution.

(3) When the carbon atom content in the surface layer 23 of the a-Si photosensitive member 11 is 40–90 atomic %, the unevenness of the potential in the generating line direction of the a-Si photosensitive member is reduced.

There is no particular limit in the carbon atom content in the photoconductive layer 22 of the a-Si photosensitive member 11, but it is preferable that the carbon atom content is 0.5–50 atomic % in the photoconductive layer 22 and is 0–40 atomic % in the position closest to the surface layer 23. It is further preferable that it is 1–40 atomic % in the photoconductive layer 22 and is 0–30 atomic % at the position closest to the surface layer 23. The photoconductive layer 22 of the a-Si photosensitive member 11 may contain hydrogen atom and/or halogen atom, if desired. In addition, it may contain one or more group III atoms, group V atoms and group VI atoms. In such a case, each of the atom contents is preferably 1 atomic ppm–40 atomic %.

Experiment 11

The carbon atom content distribution in the photoconductive layer 11 of the a-Si photosensitive member 11 was as shown in FIG. 16A (type 1) with a=0 atomic % and b=10 atomic %. The potential unevenness in the direction of the generating line of the a-Si photosensitive member 11 and the potential unevenness in the circumferential direction thereof were measured while the sum of the carbon atom content, the nitrogen atom content and the oxygen atom content (C+N+O) in the surface layer 23 was changed or while the ratio of the carbon atom content thereto (C/(C+N+O)) was changed.

The experimental conditions are as follows:

Used machine: Electrophotographic machine of FIG. 1:

Drum peripheral speed: 380 mm/sec

Light source of the main discharger: LED

Power to the light source: Constant Duty ratio of 25%

Light quantity thereof: 5.5 $\mu J/cm^2$ (constant)

Wavelength of the light thereof: 565 nm (constant)

Frequency of reference wave R: 4 KHz (constant)

(1) The potential unevenness in the direction of the generating line of the a-Si photosensitive member was determined in the following manner. The charging current of the main charger 12 is adjusted so as to provide a dark portion potential of 400 V at the position of the developing device (FIG. 1). The actuation voltage for the halogen lamp for emitting the exposure light 13 is adjusted to provide a light portion voltage of 200 V when the original to be copied is a blank copy sheet of A3 size. The light portion potentials are measured at the center of the a-Si photosensitive member 11 in the direction of the generating line thereof, at two portions 7 cm away therefrom in the same direction and at two positions 14 mm away from the center in the same direction. The difference between the maximum and the minimum of the measurements is defined as the potential unevenness in the generating line direction.

(2) The potential unevenness in the circumferential direction of the a-Si photosensitive member was determined in the following manner. The light portion potential is adjusted to be 200 V as in the case of the unevenness in the generating line direction. The light portion potentials are measured at circumferentially different positions but at longitudinally the same position. The difference between the maximum and the minimum of the measurements is defined as the potential unevenness in the circumferential direction.

FIG. 27A is a graph showing a test result of a potential unevenness along the generating line of the a-Si photosensitive member when a sum of the carbon, nitrogen and oxygen atom contents (C+N+O) in the surface layer 23 is varied, and FIG. 27B is a graph showing a test result of a potential unevenness along the circumference of the a-Si photosensitive member when a sum of the carbon, nitrogen and oxygen atom contents (C+N+O) in the surface layer 23 is varied. From these results, it has been found that the generating line direction potential unevenness and the circumferential direction potential unevenness are improved when the sum C+N+O of the carbon atom, nitrogen atom and the oxygen atom contents is 40–90 atomic % (particularly, 50–80 atomic %).

FIG. 27C is a graph showing a test result of a potential unevenness along the generating line and along the circumference of the a-Si photosensitive member when the ratio of the carbon atom content to the sum of the carbon atom content and nitrogen and oxygen atom contents (C/(C+N+O)) in the surface layer 23 is varied. From this result, it is understood that either one of the generating line direction potential unevenness and the circumferential direction potential unevenness is improved by selecting the ratio C/(C+N+O).

The electrophotographic apparatus using the a-Si photosensitive member according to this embodiment of the present invention will be compared with the conventional electrophotographic apparatus in the performance.

In the following Examples are on the basis of the embodiment of the present invention, and Comparison Examples are on the basis of the prior art electrophotographic apparatus.

(1) Example 1

Used machine: Electrophotographic machine of FIG. 1:

a-Si photosensitive member: FIG. 2

Drum peripheral speed: 380 mm/sec

Light source of the main discharger: LED array

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 KHz (2) Example 2

The same as Example 1 except that the wavelength of the main discharging light was 610 nm.

(3) Example 3

The same as Example 1 except that the duty ratio D of the main discharging light was 50%.

(4) Example 4

The same as Example 1 except that the quantity of the main discharging light was 3 $\mu J/cm^2$.

(5) Comparison Example 1

The same as Example 1 except that the main discharging light source 16 actuating system was the same as conventional, i.e., DC actuation system.

(6) Comparison Example 2

The same as with Example 1 except that the main discharging light source 16 actuation system was the conventional one, i.e., the DC actuation system and that the wavelength of the main discharging light was 610 nm.

The same experiments as in the foregoing experiments were carried out, and Table 1 shows the evaluations of the light memory, the charging property and the potential shift for the Examples and Comparison Examples.

TABLE 1

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| EX. | | | | | | |
| 1 | 565 | 5 | 25 | G | E | E |
| 2 | 610 | 5 | 25 | E | G | E |
| 3 | 565 | 5 | 50 | G | G | G |
| 4 | 565 | 3 | 25 | F | E | G |
| COMP. EX. | | | | | | |
| 1 | 565 | 5 | 100 | G | F | F |
| 2 | 610 | 5 | 100 | E | NG | F |

(E: Excellent, G: Good, F: Fair, NG: No good)

From Table 1, it will be understood that the total performance is better in the electrophotographic apparatus using the a-Si photosensitive member according to this embodiment of the present invention (Examples) than in the conventional electrophotographic apparatus (Comparison Examples).

Table 2 shows the result of the dependencies of the light memory, the charging property and the potential shift on the main discharging light duty ratio.

TABLE 2

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| EX. | | | | | | |
| 1 | 565 | 5 | 25 | G | E | E |
| 3 | 565 | 5 | 50 | G | G | G |
| COMP. EX. 1 | 565 | 5 | 100 | G | F | F |
| EX. 2 | 610 | 5 | 25 | E | G | E |
| COMP. EX. 2 | 610 | 5 | 100 | E | NG | F |

(E: Excellent, G: Good, F: Fair, NG: No good)

From Table 2, it is understood that when the wavelength and the quantity of the main discharging light from the main discharging light light 16 are constant, the charging property and the potential shift are improved by decreasing the duty ratio of the main discharging light. It is also understood that the light memory does not depend on the duty ratio of the main discharging light.

Table 3 shows the dependencies of the light memory, the charging property and the potential shift on the wavelength of the main discharging light.

TABLE 3

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| EX. | | | | | | |
| 1 | 565 | 5 | 25 | G | E | E |
| 2 | 610 | 5 | 25 | E | G | E |
| COMP. EX. | | | | | | |
| 1 | 565 | 5 | 100 | G | F | F |
| 2 | 610 | 5 | 100 | E | NG | F |

(E: Excellent, G: Good, F: Fair, NG: No good)

From Table 3, it is understood that when the quantity and the duty ratio of the main discharging light from the main discharging light source 16 are constant, the charging property and the potential shift are improved by decreasing the wavelength of the main discharging light, but the light memory property is worsened by decreasing it.

Table 4 shows the dependencies of the light memory, the charging property and the potential shift on the quantity of the main discharging light.

TABLE 4

| EX. | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| 1 | 565 | 5 | 25 | G | E | E |
| 4 | 565 | 3 | 25 | F | E | G |

(E: Excellent, G: Good, F: Fair, NG: No good)

From Table 4, it is understood that when the wavelength and the duty ratio of the main discharging light from the main discharging light source 16 are constant, the charging property and the potential shift are not significantly influenced by reduction of the quantity of the main discharging light, whereas the light memory is worsened by the reduction thereof.

The description will be made as to Example 5 and Comparison Example 3.

(1) Example 5

Used machine: Electrophotographic machine of FIG. 1:

a-Si photosensitive member: FIG. 10A a: 0 atomic %
b: 10 atomic %

Carbon atom content in surface layer 23: 65 atomic %

Drum peripheral speed: 380 mm/sec

Light source of the main discharger: LED

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 KHz (2) Comparison Example 3

The same as Example 5 except that the carbon atom content in the photosensitive layer 22 of the a-Si photosensitive member 11 was 10% atomic % (constant) and that the surface layer 23 contains 5 atomic % of the carbon atoms.

The same experiments as in the foregoing experiments were carried out, and Table 5 shows the evaluations of the light memory, the charging property, the potential shift and the generating line direction potential unevenness.

TABLE 5

| | EXAMPLE 5 | COMP. EXAMPLE 3 |
|---|---|---|
| WAVELENGTH | 565 | 565 |
| LIGHT QUANTITY | 5 | 5 |
| DUTY RATIO | 25 | 25 |
| LIGHT MEMORY | G | G |
| CHARGING PROPERTY, POTENTIAL SHIFT | E | E |
| POTENTIAL EVENNESS | E | G |
| TOTAL | P | E |

(P: Particularly excellent, E: Excellent, G: Good)

From Table 5, it is understood that with Example 5 in which the surface layer 23 of the a-Si photosensitive member 11 contains the carbon atoms, nitrogen atoms and oxygen atoms (the sum of the contents are 60 atomic %), the charging property can be improved and the potential shift can be reduced under the condition that the light memory level is satisfactory. In addition, the potential unevenness in the direction of the generating line is possible.

The description will be made as to the detailed structure of the a-Si photosensitive member 11, the carbon atoms in the photoconductive layer, the carbon atoms, the nitrogen atoms and the oxygen atoms in the surface layer.

Conductive base 21:

The conductive base 21 may be made of metal such as Al, Cr, Mo, Au, In, Nb, To, V, Ti, Pt, Pd or Fe or an alloy of them (stainless steel, for example). A synthetic resin film or sheet of polyester, polyethylene, polycarbonate, cellulose acetate, polypropylene, polyvinylchloride, polystyrene or polyamide or glass or ceramic and another electrically insulative material is usable by treatment for electric conductivity at least on the surface thereof contacted to the photoconductive layer 22 (light receiving layer). In this case, it is preferable that the opposite side surfaces also treated for electric conductivity. The conductive base 21 may be in the form of cylinder or endless belt having a smooth surface or a surface having pits and projections. The thickness thereof may be properly selected to provide a desired electrophotographic photosensitive member. When a flexibility is required when it is used as the electrophotographic photosensitive member, the thickness may be as small as possible, provided that it can function as the supporting base. In view of the manufacturing easiness, easy handling and mechanical strength, it is usually not less than 10 microns.

Where the image is recorded with coherent light such as laser light, the conductive support 21 may have a surface having pits and projections in order to avoid the image deterioration due to the interference stripes in the visualized image. The pits and projections may be produced by known method as disclosed in U.S. Pat. Nos. 4,650,736, 4,696,884 or 4,705,733 in another method to avoid the image deterioration due to the interference stripes, the surface of the conductive base 21 is provided with pits and projections in the form of plural spherical dimples. The pits and projections are finer than the resolution required for the electrophotographic photosensitive member. Such pits and projections provided by the spherical dimples may be formed by a known method as disclosed U.S. Pat. No. 4,735,883, for example.

Photoconductive layer 22:

The photosensitive layer 22 comprises a-SiC (H, F) including silicon atoms and carbon, hydrogen and fluorine atoms from the conductive base 21 side. The layer exhibits a desired photoconductive property, more particularly a charge retention property, a charge generating property and a charge conveying property. The content of the carbon atoms in the photoconductive layer 22 has a distribution in which the content is substantially uniform in any plane parallel to the surface of the conductive base 21, but is non-uniform in the direction of the thickness of the photoconductive layer. The content is higher adjacent the conductive base 21, and is lower adjacent the surface layer 23. If the content of the carbon atoms is not more than 0.5 atomic % at the surface close to the conductive base 21 or in the neighborhood thereof, the close contactness and the charge injection preventing function relative to the conductive base 21 are deteriorated. In addition, the charging property improvement by the reduction of the electrostatic capacity is not expected. If the content is not less than 50 atomic %, the residual charge occurs. In view of these, the carbon content is practically 0.5–50 atomic %, preferably 1–40 atomic % and further preferably 1–30 atomic %.

The photoconductive layer 22 contains the hydrogen atoms to compensate for the dangling bonds of the silicon atoms, thus improving the layer quality, particularly the photoconductive property and the charge retention property. When the carbon atoms are contained, a larger amount of hydrogen atoms are required to maintain the film quality, and therefore, it is desirable that the hydrogen atom content is adjusted in relation to the carbon atom content. Accordingly, the hydrogen atom content at the surface %, of the conductive base 21 is desirably 1–40 atomic preferably 5–35 atomic %, further preferably 10–30 atomic %.

As regards the fluorine atoms contained in the photoconductive layer 22, they are effective to limit coagulation of the carbon and hydrogen atoms in the photoconductive layer 22 and to reduce the local level density in the band gap, and therefore, they improve the ghost and roughness of the image and improve the uniformity of the layer quality. If the content of the fluorine atoms is less than 1 atomic ppm, the ghost and roughness prevention is not enough, but if it exceeds 95 atomic ppm, the film quality is deteriorated with the result of ghost image. Therefore, the fluorine atom content is practically 1–95 atomic ppm, preferably 5–80 atomic ppm, and further preferably 10–70 atomic ppm. When the carbon atom content in the photoconductive layer 22 is as disclosed above, the photoconductive property, the image and the durability are remarkably improved by selecting the fluorine atom content in the range. This has been empirically confirmed.

The photoconductive layer 22 is produced by vacuum accumulation film forming method in which various film formation parameters are selected to provide the desired properties. More particularly, the thin film accumulating methods include a glow discharge method (an AC discharge CVD method such as a low frequency CVD method, a high frequency CVD method or a microwave CVD method, or a DC discharge CVD method), a sputtering method, a vacuum evaporation method, an ion plating method, light CVD method and a heat CVD method. The selection is made in consideration of the manufacturing conditions, a plant and equipment investment, manufacturing scale, the properties required for the electrophotographic photosensitive member or the like. However, in view of the relative easiness in the control of various conditions in the manufacturing of the electrophotographic photosensitive member, the glow discharge method, sputtering method and the ion plating method are preferable. These methods may be used concurrently. In the case of formation of the a-SiC (H, F) photoconductive layer through the glow discharge method, basically, Si supply gas for supplying the silicon atoms (Si), C supply gas for supplying the carbon atoms (C), H supply gas for supplying the hydrogen atoms (H) and F supply gas for supplying the fluorine atoms (F), are introduced in desired gas states in a pressure-reducible reactor container. Then, the glow discharge is started in the reactor to form the a-SiC (H, F) layer on a surface of the conductive base 21 already set in place.

The usable Si supplying gases include gasified or gasfiable silicon hydride (silane) such as $SiH_4$, $Si_2H_6$, $Si_3H_8$ or $Si_4H_{10}$. From the standpoint of the easy handling in the layer formation, Si supply efficiency or the like, $SiH_4$ and $Si_2H_6$ are preferable. The Si supplying gas may be diluted with $H_2$, He, Ar, Ne or the like.

The carbon atom (C) supplying material is preferably the one which is in the gas state at the normal temperature and pressure or which is easily gasified at least under the layer forming conditions. The starting material for supplying the carbon atoms (C) include saturated hydrocarbons having 1 to 5 carbon atoms, ethylenic hydrocarbons having 2 to 4 carbon atoms, and acetylenic hydrocarbons having 2 to 3 carbon atoms. More particularly, the saturated hydrocarbons include methane ($CH_4$), ethane ($C_2H_6$), propane ($C_3H_8$), n-butane (n-$C_4H_{10}$) and pentane ($C_5H_{12}$). The ethylenic hydrocarbons include ethylene ($C_2H_4$), propylene ($C_3H_6$), butene-1 ($C_4H_8$), butene-2 ($C_4H_8$), isobutyrene ($C_4H_8$), pentene ($C_5H_{10}$). The acetylenic hydrocarbons include acetylene ($C_2H_2$), methyl acetylene ($C_3H_4$), butine ($C_4H_6$). The gas having Si and C has the constituent atoms, includes $Si(CH_3)_4$, $Si(C_2H_5)$ or another another alkyl silanes. From the standpoint of capability of supplying the fluorine atoms in addition to the carbon atoms (C), fluorine carbon compound such as $CF_4$, $CF_3$, $C_2F_6$, $C_3F_8$ or $C_4H_8$ is usable.

The usable fluorine supplying gases include fluorine gas, fluoride, fluorine containing halide, silane derivatives substituted with fluorine or another gasified or gasifiable fluorine compound. As for other usable materials, there are fluorine atom containing silicon fluorides which has silicon atoms and fluorine atoms as the constituent atoms and which are gasified or gasifiable. The preferable fluorine compounds include halides such as fluorine gas ($F_2$), BrF, ClF, $ClF_3$, $BrF_3$, $BrF_5$, $IF_3$, $IF_7$. The fluorine containing silicon compound, i.e., the silane derivatives substituted with the fluorine atoms, includes $SiF_4$, $Si_2F_6$ or another silicon fluoride. When the electrophotographic photosensitive member is produced by the glow discharge using the fluorine atom containing silicon compound, the a-Si (H, F) photoconductive layer 22 containing the fluorine atoms can be formed on the conductive base 21 without using the silicon hydride gas as the Si supplying gas. However, in order to easily control the hydrogen atom content in the photoconductive layer 22 formed, these gases are preferably mixed with the hydrogen gas and the silicon compound gas containing the hydrogen atoms in the formation of the layer. The gases may be used as a mixture at a predetermined mixture ratio.

The usable fluorine atom supplying gases are as disclosed above, i.e., the fluorides, the fluorine containing silicon compound. Other examples include the gasified or gasifiable fluorine substituted silicon hydride such as HF, $SiH_3F$, $SiH_2F_2$, $SiHF_3$ as the material for formation of the photoconductive layer. Among those materials, the hydrogen containing fluoride are preferable as the fluorine atom supplying gas because it can introduce the fluorine atoms to the layer during the formation of the photoconductive layer and because the hydrogen atoms which are remarkably effective to control the photoelectric or electric properties are introduced.

In order to structurally introducing the hydrogen atoms into the photoconductive layer 22, it is possible that the discharge is produced in the reactor containing simultaneously $H_2$ or silicon hydride such as $SiH_4$, $Si_2H_6$, $Si_3H_6$ or $Si_4H_{10}$ and the Si supplying silicon or silicon compound.

In order to control the contents of the carbon atoms, the hydrogen atoms and the fluorine atoms in the photoconductive layer 22, the electric discharge power and/or the quantities of the materials for supplying the carbon atoms, the hydrogen atoms and the fluorine atoms in the reactor container and/or the temperature of the conductive base 21.

It is preferable that the photoconductive layer 22 contains atoms (M) for controlling the conductivity as desired. The atoms capable of controlling the conductivity may be uniformly distributed all over the photoconductive layer, or they may be non-uniformly distributed in the layer thickness direction. The atoms controlling the conductivity include impurities in the semiconductor manufacturing field. They may be the group III atoms for the p-conductivity and group V atoms for n-conductivity. In the group III atoms, B (boron), Al (aluminum), Ga (gallium), In (indium), Tl (thallium), are usable. Among them, B, Al, Ga are preferable. The group V atoms include P (phosphorous), As (arsenic), Sb (antimony), Bi (bismuth). Among them, P, As are preferable. The contents of the atoms (M) for controlling the conductivity in the photoconductive layer 22 is preferably $1\times10^{-3}$ -$5\times10^{4}$ atomic ppm, preferably $1\times10^{2}$-$1\times10^{4}$ atomic ppm, further preferably, $1\times10^{-1}$-$5\times10^{3}$ atomic ppm. Particularly, if the carbon atom (C) content in the photoconductive layer 21 is not more than $1\times10^{3}$ atomic ppm, the content of the atoms (M) in the photoconductive layer 22 is preferably $1\times10^{-3}$-$1\times10^{3}$ atomic ppm. If the carbon atom (C) exceeds $1\times10^{3}$ atomic ppm, the atomic (M) content is preferably $1\times10^{-1}$-$5\times10^{4}$ atomic ppm.

In order to structurally introduce the conductivity controlling atoms (the group III atoms and group IV atoms) into the photoconductive layer 22, the materials for introducing the group III atoms or the materials for introducing the group V atoms is introduced in the state of gas in the reactor container upon the formation of the photoconductive layer 22 in addition to the other gases. As for the material for introducing the group III atoms and the materials for introducing the group V atoms are preferably gasified under normal temperature and normal pressure conditions or easily gasifiable at least under the layer forming conditions. As for the material for introducing the group III atoms (boron atoms), there are $B_2H_6$, $B_4H_{10}$, $B_5H_9$, $B_5H_{11}$, $B_6H_{10}$, $B_6H_{12}$, $B_6H_{14}$ or other boron hydride, $BF_3$, $BCl_3$, $BBr_3$ or another boron halide. Other usable materials are $AlCl_3$, $GaCl_3$, $Ga(CH_3)_3$, $InCl_3$, $TlCl_3$.

Usable materials for introducing the group V atoms (phosphorous atoms), there are $PH_3$, $P_2H_4$ or other phosphorous hydride, $PH_3I$, $PF_3$, $PF_5$, $PCl_3$, $PCl_5$, $PBr_3$, $PBr_5$, $PI_3$ or other phosphorous halide. Other usable materials are $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$. The material for introducing the atoms for controlling the conductivity may be diluted with $H_2$, He, Ar or Ne gas. The photoconductive layer 22 may contain at least one kind of atoms selected from the group Ia atoms, the group IIa atoms, the group IVa atoms and the group VIII. The atoms may be uniformly distributed all over the photoconductive layer 22, or they may be distributed all over the photoconductivity, but partly non-uniform in the layer thickness direction. However, in any case, they are preferably distributed uniformly in a plane parallel to the conductive base 21, since then the polarity becomes uniform. The group Ia atoms include Li (lithium), Na (sodium), K (potassium). The group IIa atoms include Be (beryllium), Mg (magnesium), Ca (calcium), Sr (strontium), Ba (barium). The group VI atoms include Cr (chromium), Mo (molybdenum), W (tungsten). The group VIII atoms include Fe (iron), Co (cobalt), Ni (nickel).

The thickness of the photoconductive layer 22 is properly determined in consideration of the desired electrophotographic property and the economical conditions. It is 5–50 microns, preferably 10–40 microns and further preferably 20–30 microns.

In order to form the a-SiC (H, F) photoconductive layer 22 in the present invention, the temperature of the conductive base 21, the gas pressure in the reactor container are properly determined. The temperature (Ts) of the conductive base 21 is determined in view of the layer design. Normally, it is 20°–500 ° C., preferably 50°–480° C., and further preferably 100°–450° C. The gas pressure in the reactor is properly determined in view of the layer design. Normally it is $1\times10^{-5}$–10 Torr, preferably $5\times10^{-5}$–3 Torr, Further preferably $1\times10^{-4}$– 1 Torr. In the present invention, the temperature of the conductive base 21 and the gas pressure during the formation of the layers, are as described above. However, the layer formation parameters are not independently determined, but are preferably determined in interrelation with each other to form a photoconductive layer 22 having the desired properties.

In the a-Si photosensitive member 11 used in this invention, a layer region in which the composition is continuously changing may be provided between the photoconductive layer 22 and the surface layer 23. The close contact property between the layers can be improved by the provision of such a layer region. In the a-Si photosensitive member 11 used in the present invention, there is preferably disposed at the conductive base side of the photoconductive layer 22 the layer region in which the aluminum atoms, silicon atoms, carbon atoms and hydrogen atoms are distributed non-uniformly in the layer thickness direction.

Surface layer 23:

The surface layer 23 comprises an amorphous material containing the silicon atoms, the carbon atoms, the hydrogen atoms and the halogen atoms as the constituent atoms. The surface layer 23 substantially does not contain the material controlling the electric conductivity, unlike the photoconductive layer 22. The carbon atoms in the surface layer 23 may be distributed uniformly all over the layer. Otherwise, they may be distributed all over the layer thickness but non-uniformly in part. In any case, it is preferable that they are uniformly distributed in a plane parallel to the surface of the conductive support 21 from the standpoint of the uniformity of the properties in the plane.

The carbon atoms contained in the entirety of the surface layer 23 are effective to increase the dark resistance and the hardness. The content of the carbon atoms in the surface layer 23 is 40–90 atomic preferably 45–85 atomic % and further preferably 50–80 atomic %.

The hydrogen atoms and halogen atoms contained in the surface layer 23 are effective to compensate for the dangling bonds in the a-SiC (H, X), and to increase the film quality. Thus, the number of carriers trapped at the interface between the photoconductive layer 22 and the surface layer 23 is decreased, and therefore, the flow of the image can be suppressed. The halogen atoms improve the water repelling property of the surface layer 23, and therefore, the high humidity flow attributable to the dew of the vapor can be reduced. The halogen atom content in the surface layer 23 is not more than 20 atomic %. The sum of the hydrogen atom content and the halogen atom content is 30–70 atomic %, preferably 35–65 atomic % and further preferably 40–60 atomic %.

As to another example of the surface layer 23 which contains the carbon atoms, the nitrogen atoms and the oxygen atoms in the entirety of the layers, these atoms are effective to remarkably increase the dark resistance and the hardness when they are simultaneously contained. The carbon atom content in the surface layer 23 is 40–90 atomic %, preferably 45–85 atomic % and further preferably 50–80 atomic %. In order to assure the advantageous effects of the present invention, each of the carbon atom content and the nitrogen atom content is not more than 10 atomic %.

The hydrogen atoms and halogen atoms in the surface layer 23 are effective to compensate for the dangling bonds in the a-SiC, O, N (H, X), thus improving the film quality. Therefore, the number of carriers trapped at the interface between the photoconductive layer 22 and the surface layer 23 is decreased, so that the flow of the image can be suppressed.

The surface layer 23 may contain at least one kind of atoms selected from the group Ia, the group IIa, the group VIa and the group VIII atoms. The atoms may be distributed uniformly all over the photoconductive layer 22. Otherwise, they may be distributed all over the photoconductive layer 22 but non-uniformly in the direction of the layer thickness. In any case, however, they may be uniformly distributed in a plane parallel to the surface of the conductive base 21, since then the properties are uniform in the plane. The group Ia atoms include Li (lithium), Na (sodium), K (potassium). The group IIa atoms include Be (beryllium), Mg (magnesium), Ca (calcium), Sr (strontium), Ba (barium). The group VIa atoms include Cr (chrome), Mo (molybdenum), W (tungsten). The group VIII atoms include Fe (iron), Co (cobalt), Ni (nickel).

From the standpoint of the desired electrophotographic properties and the economical standpoint, the layer thickness of the surface layer 23 is preferably 0.01–30 microns, preferably 0.05–20 microns and further preferably 0.1–10 microns.

In order to form a surface layer 23 of a-SiC, O, N (H, X), the vacuum accumulation method as in the photoconductive layer 22 forming method. In order to form the surface layer 23 usable with the present invention, the temperature of the conductive base 21 and the gas pressure are important since they are influential to the properties of the surface layer 23. The temperature of the conductive base 21 is properly selected by one skilled in the art, but generally it is 20°–500° C., preferably 50°–480° C. and further preferably 100°–450° C. The gas pressure in the reactor is also properly selected by one skilled in the art, but generally it is $1\times10^{-5}$–10 Torr, preferably $5\times10^{-5}$–3 Torr and further preferably $1\times10^{14}-1$ Torr. The temperature of the conductive base 21 and the gas pressure for the formation of the surface layer 23 are preferably in the range described above. However, the parameters are not determined independently from each other. However, it is preferable that they are properly determined in consideration of the interrelation between them to provide the surface layer 23 having the desired properties.

As Described in the foregoing, the following advantageous effects are provided by the photosensitive member according to this embodiment of the present invention.

(1) The main discharging light source is actuated through the pulse width modulation system and projects the light pulse at high intensity, and the amorphous silicon photosensitive member has the photoconductive layer containing the minimum amount of carbon atoms at the interface with the surface layer and has the surface layer containing 40–90 atomic % of the carbon atoms, and therefore, the reduction of the charging property, the potential shift can be minimized with decreased general line direction potential unevenness, while the light memory level is suppressed in the satisfactory level. Thus, the total performance can be improved.

(2) As an unexpected effect, the residual potential level can be maintained low even before the temperature of the amorphous silicon photosensitive member reaches the predetermined level, and therefore, the foggy background of the copy image can be prevented even before the temperature reaches the predetermined temperature, as contrasted to the case of the conventional apparatus.

(3) The image transfer efficiency when the developer visualized the image on the amorphous silicon photosensitive member is transferred onto a transfer member, is increased, and therefore, the consumption of the developer can be saved, and/or the potential of the latent image can be decreased, thus permitting reduction of the charging current and the contamination of the charging wire.

(4) The main discharging light source is actuated through the pulse width modulation system and projects the pulse light at high intensity, and the amorphous silicon photosensitive member has the conductive layer containing the minimum carbon atoms at the interface with the surface layer, and has the surface layer in which the sum of the carbon atom, nitrogen atom and oxygen atom contents is 40–90 atomic %, and therefore, the reduction of the charging property and the potential shift can be minimized with the potential unevenness reduced, while the light memory is maintained at the satisfactory level, thus improving the total performance.

(5) The image transfer efficiency when the developer on the amorphous silicon photosensitive member is transferred onto the transfer material, is improved, and therefore, the developer consumption can be saved, and/or the potential level of the latent image can be reduced, so that the charging current may be decreased, and the contamination of the charging wire is reduced.

Embodiment 2

In place of the first and second photosensitive members of Embodiment 1, third and fourth photosensitive members are prepared. The driving systems for Embodiment 2 are the same as in Embodiment 1.

In the third photosensitive member;

(1) the photoconductive layer 22 of the a-Si photosensitive member 11 contains the flow line atoms at maximum content in the portion closest to the surface layer 23.

In other words, the fluorine atom content distribution in the photoconductive layer 22 is as shown in FIG. 28C, in which it is 50 atomic ppm at the interface with the surface layer 23 and is 0 atomic ppm at the interface with the conductive base 21, and changes paraboricly therebetween; and (2) the surface layer 23 of the a-Si photosensitive member 11 contains 40–90 atomic % of the carbon atoms.

In the fourth photosensitive member, (1) the photoconductive layer 22 is the same as in the third photosensitive member; and (2) the surface layer 23 of the a-Si photosensitive member 11 contains carbon atoms, nitrogen atoms and oxygen atoms in which a sum of the contents thereof is 40–90 atomic %.

The description will be made as to Experiment 12–14 on the third and fourth photosensitive members. Here, the fluorine atom content distribution in the photoconductive layer 22 of the a-Si photosensitive member 11 was changed to investigate the light memory, the charging property, the potential shift, the potential unevenness in the direction of the generating line and the temperature dependency.

Experiment 12

The above-described various properties were investigated under the following conditions:

Used machine: Electrophotographic machine of FIG. 1:

Drum peripheral speed: 380 mm/sec

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 KHz (constant)

The temperature dependency was determined in the following manner. The temperature of the a-Si photosensitive member is controlled to be a predetermined level (approx. 45° C.). The charging current of the main charger 12 is adjusted so as to provide a dark portion potential of 400 V at the position of the developing device (FIG. 1). The actuation voltage for the halogen lamp for emitting the exposure light 13 is adjusted to provide a light portion voltage of 200 V when the original to be copied is a blank copy sheet of A3 size. The temperature Th of the photosensitive member 11 is measured, and the heater is switched off. When the temperature becomes 35° C., the light portion potential is measured. The temperature dependency is defined as the difference of the potential Vth at Th and that at 35° C. divided by the temperature difference (Th-35).

The fluorine atom content distribution in the photoconductive layer 22 of the a-Si photosensitive member 11 was classified into three types, as follows:

(1) Type 1: As shown in FIG. 29A, the fluorine atom content was the maximum, i.e., a atomic % at the portion closest to the surface layer, was the minimum, i.e., a−b atomic % at the portion closest to the conductive base, and was changed linearly therebetween:

(2) Type 2: As shown in FIG. 29B, the fluorine atom content was the maximum, i.e., a atomic % at the portion closes to the surface layer, was the minimum, i.e., a−b atomic % at the portion closest to the conductive base, and was changed stepwisely therebetween: and (3) Type 3: As shown in FIG. 29C, the fluorine atom content was the maximum, i.e., a atomic % at the portion closest to the surface layer, was the minimum, i.e., a−b atomic % at the portion closest to the conductive base, and was changed stepwisely at least at one position and continuously at the other.

FIGS. 30A, 30B and 30C are concerned with Type 1 shown in FIG. 29A when a fluorine atom content (atomic ppm) in the portion closest to the surface layer is varied. FIG. 30A shows a test result when the fluorine atom content (a−b atomic ppm) in the portion closest to the conductive base is a atomic ppm; FIG. 30B shows a test result when the fluorine atom content (a−b atomic ppm) in the portion closest to the conductive base is a−20 atomic ppm; and FIG. 30C shows a test result when the fluorine atom content (a−b atomic ppm) in the portion closest to the conductive base is a−30 atomic ppm. FIGS. 31A, 31B and 31C show the same but for type 2. FIG. 32A, 32B and 32C show the same but for type 3.

From the results shown in FIGS. 30A, 30B, 30C, 31A, 31B, 31C, 32A, 32B and 32D, it is understood that when the fluorine atom content distribution in the photoconductive layer 22 is decreased from the surface layer 23 side toward the conductive base 21, the light memory, the charging property, the potential shift, the generating line direction potential unevenness and the temperature dependency are hardly influenced by the fluorine atom content (a atomic ppm) at the portion closest to the surface layer 23 or on the fluorine atom content (a−b atomic ppm) at the position closest to the conductive base 21, and therefore, the effects of the present invention are sufficiently provided.

Experiment 13

Similarly to Experiment 12, the abovedescribed various properties were investigated under the following conditions:

Used machine: Electrophotographic machine of FIG. 1:

Drum peripheral speed: 380 mm/sec

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 KHz (constant)

The fluorine atom content distribution in the photoconductive layer 22 of the a-Si photosensitive member 11 was classified into three types, as follows:

(1) Type 1: As shown in FIG. 33A, the fluorine atom content was the maximum, i.e., a atomic % at the portion closest to the surface layer, was the minimum, i.e., a−b atomic % between the surface layer 23 and the conductive base 21, and was a−c atomic ppm at the portion closest to the conductive base, and was changed continuously therebetween:

(2) Type 2: As shown in FIG. 33B, the fluorine atom content was the maximum, i.e., a atomic % at the portion closes to the surface layer, was the minimum, i.e., a−b atomic % between the surface layer 23 and the conductive base 21, and was a−c atomic ppm at the portion closest to the conductive base, and was changed stepwisely therebetween: and (3) Type 3 : As shown in FIG. 33C, the fluorine atom content was the maximum, i.e., a atomic % at the portion closest to the surface layer, was the minimum, i.e., a−b atomic % between the surface layer 23 and the conductive base 21, and was a−c atomic ppm at the portion closest to the conductive base, and was changed stepwisely at least at one position and continuously at the other.

FIGS. 34A, 34B and 34C are concerned with Type 1 of FIG. 33A in which the fluorine atom content a in the portion closest to the surface layer is changed. FIG. 34A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 34B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 34C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm. FIGS. 35A, 35B and 35C shows the same but for type 2. FIGS. 36A, 36B and 36C show the same but for type 3.

From the test results shown in FIGS. 34A, 34B, 34C, 35A, 35B, 35C, 36A, 36B and 36C, is understood that even when the fluorine atom content distribution in the photoconductive layer 22 is as shown in FIG. 31, the light memory, the charging property, the potential shift, the generating line direction potential unevenness and the temperature dependency, are hardly influenced by the fluorine atom content (a atomic ppm) at the position closest to the surface layer 23, the content a−b atomic ppm between the surface layer 23 and the conductive base 21 or the fluorine atom content a−c atomic ppm at the position closest to the conductive base 21, and therefore, the advantageous effects of the present invention are sufficient provided.

Experiment 14

The above-described various proportions were investigated under the following conditions:

Used machine: Electrophotographic machine of FIG. 1:

Drum peripheral speed: 380 mm/sec

Power to the light source: Varied Duty ratio D

Light quantity thereof: 5.5 $\mu J/cm^2$ (constant)

Wavelength of the light thereof: 565 nm (constant)

Frequency of reference wave R: 4 KHZ (constant)

Here, the fluorine atom content distribution in the photoconductive layer 22 of the a-Si photosensitive member 11, as shown in FIG. 37, was such that it is maximum at the position closest to the surface layer 23, i.e., 70 atomic ppm, and it was the minimum at the position closest to the conductive base 21, i.e., 10 atomic ppm, and the content of the fluorine atoms was irregularly changed.

FIG. 38 shows the result of the experiments.

From these results, it is understood that the light memory, the charging property, the potential shift, the generating line direction potential unevenness and the temperature dependency are satisfactory by reducing the duty ratio D of the main discharging light even if the fluorine atom content distribution in the photoconductive layer 22 is as shown in FIG. 27.

From the Experiment 12–14, the following has been found in addition to the results from the Experiment 5–11 in Embodiment 1:

(1) When the carbon atom content in the photoconductive layer 22 of the a-Si photosensitive member 11 is the minimum at the position closest to the surface layer 23 and the fluorine atom content in the photoconductive layer 22 thereof is the maximum at the position closest to the surface layer 23, the above-described advantageous effects are particularly remarkable irrespective of the distributions of the carbon atom and the fluorine atom contents, and in addition, the temperature dependency is reduced.

There is no limit to the fluorine atom content in the photoconductive layer 22 of the a-Si photosensitive member 11, but it is preferably 1–95 atomic ppm in the photoconductive layer 22, and it is 10–100 atomic ppm at the position closest to the surface layer 23, and further preferably 10–70 atomic ppm in the photoconductive layer 22 and 20–80 atomic ppm at the position closest to the surface layer 23. In addition, the photoconductive layer 22 of the a-Si photosensitive member 11 may contain hydrogen atoms and/or halogen atoms, as desired.

Experiment 15

The carbon atom content distribution in the photoconductive layer 22 of the a-Si photosensitive member 11 was such that a=0 atomic %, and b=10 atomic % in the structure shown in FIG. 16A. The generating line direction potential unevenness and the circumferential potential unevenness of the a-Si photosensitive member 11 were investigated while changing the sum of the carbon, nitrogen and oxygen atom contents (C+N+O) in the surface layer 23 or while changing the ratio of the carbon atom content to the sum (C/(C+N+O)).

The experimental conditions were as follows:

Used machine: Electrophotographic machine of FIG. 1:

Drum peripheral speed: 380 mm/sec

Light source of the main discharger: LED

Power to the light source: Constant Duty ratio D of 25%

Light quantity thereof: 5.5 $\mu J/cm^2$ (constant)

Wavelength of the light thereof: 565 nm (constant)

Frequency of reference wave R: 4 KHZ (constant)

The potential unevenness in the direction of the generating line of the a-Si photosensitive member 11 and the potential unevenness in the circumferential direction thereof were measured in the following manner:

(1) The generating line direction unevenness:

The potential unevenness in the direction of the generating line of the a-Si photosensitive member was determined in the following manner. The charging current of the main charger 12 is adjusted so as to provide a dark portion potential of 400 V at the position of the developing device (FIG. 1). The actuation voltage for the halogen lamp for emitting the exposure light 13 is adjusted to provide a light portion voltage of 200 V when the original to be copied is a blank copy sheet of A3 size. The light portion potentials are measured at the center of the a-Si photosensitive member 11 in the direction of the generating line thereof, at two portions 7 cm away therefrom in the same direction and at two positions 14 mm away from the center in the same direction. The difference between the maximum and the minimum of the measurements is defined as the potential unevenness in the generating line direction.

(2) Circumferential direction potential unevenness:

The potential unevenness in the circumferential direction of the a-Si photosensitive member was determined in the following manner. The light portion potential is adjusted to be 200 V as in the case of the unevenness in the generating line direction. The light portion potentials are measured at circumferentially different positions but at longitudinally the same position. The difference between the maximum and the minimum of the measurements is defined as the potential unevenness in the circumferential direction.

FIGS. 39A, 39B and 39C are concerned with Experiment 15. FIG. 39A is a graph showing a test result of a potential unevenness along the generating line of an a-Si photosensitive member when a sum of carbon, nitrogen and oxygen atom contents (C+N+O) in the surface layer is varied; FIG. 39B is a graph showing a test result of a potential unevenness along the circumference of an a-Si photosensitive member when a sum of carbon, nitrogen and oxygen atom contents (C+N+O) in the surface layer is varied; and FIG. 39C is a graph showing a test result of a potential unevenness along the generating line and along the circumference of an a-Si photosensitive member when a ratio of a carbon atom content to a sum of the carbon atom content and nitrogen and oxygen atom contents (C/(C+N+O)) in the surface layer is varied.

From these results, it is understood that the generating line direction potential unevenness and the circumferential direction unevenness are improved particularly when the sum of the carbon atom, nitrogen atom and oxygen atom contents (C+N+O) in the surface layer 23 is 40–90 atomic % (particularly 50–80 atomic %).

It is also understood from FIG. 39C that either one of the generating line direction potential unevenness and the circumferential direction unevenness is improved by selecting the ratio C/(C+N+O).

In addition to the finding from the Experiment 12–14, it has also be found that the generating line direction potential unevenness and the circumferential direction potential unevenness are reduced when the sum of the carbon atom, nitrogen atom and oxygen atom contents in the surface layer 23 of the a-Si photosensitive member 11 is 40–90 atomic %.

The electrophotographic apparatus using the a-Si photosensitive member of this embodiment and the conventional electrophotographic apparatus will be described in the performance.

Example 6 and Comparison Example 4 will be described.

(1) Example 6

Used machine: Electrophotographic machine of FIG. 1:

Drum peripheral speed: 380 mm/sec

Light source of the main discharger: LED

Power to the light source: Constant duty ratio D of 25%

Light quantity thereof: 5.5 $\mu J/cm^2$ (constant)

Wavelength of the light thereof: 565 nm (constant)

Frequency of reference wave R: 4 KHz (constant)

The structure of the a-Si photosensitive member 11 was as shown in FIG. 16A and the carbon atom distribution in the photoconductive layer 22 was a=0 atomic % and b=10 atomic %. The fluorine atom distribution in the photoconductive layer was as shown in FIG. 29A, in which a=40 atomic ppm and b=35 atomic ppm. The carbon atom content in the surface layer 23 was 60–70 atomic %.

(2) Comparison Example 4

The carbon atom content in the photoconductive layer 22 was constant (10 atomic %), and the fluorine atom content in the photoconductive layer 22 was constant (50 atomic ppm). The carbon atom content in the surface layer 23 was 5 atomic %. The conditions were the same as in Example 6 in the other respects.

Table 6 shows the evaluations of the light memory, the charging property, the potential shift, the generating line direction unevenness and the temperature dependency.

TABLE 6

| | EXAMPLE 6 | COMP. EXAMPLE 4 |
|---|---|---|
| WAVELENGTH | 565 | 565 |
| LIGHT QUANTITY | 5 | 5 |
| DUTY RATIO | 25 | 25 |
| LIGHT MEMORY | G | G |
| CHARGING PROPERTY, POTENTIAL SHIFT | E | E |
| POTENTIAL EVENNESS | E | G |
| TEMP. DEPENDENCY | E | G |
| TOTAL | P | E |

(P: Particularly excellent, E: Excellent, G: Good)

From this table, it is understood that in Example 6, the charging property can be improved and the potential shift can be reduced with the good light memory level, and the generating line direction potential unevenness and the temperature dependency can be reduced.

Example 7 and Comparison Example 5 will be described.

(1) Example 7

The experimental conditions are as follows:

Used machine: Electrophotographic machine of FIG. 1:

Drum peripheral speed: 380 mm/sec

Light source of the main discharger: LED

Power to the light source: Constant Duty ratio of 25%

Light quantity thereof: 5.5 $\mu J/cm^2$ (constant)

Wavelength of the light thereof: 565 nm (constant)

Frequency of reference wave R: 4 KHz

The carbon atom distribution in the photoconductive layer 22 of the a-Si photosensitive member 11 was as shown in FIG. 16A (type 1) with a=0 atomic % and b=10 atomic %. The fluorine atom distribution in the photoconductive layer 22 was as shown in FIG. 28A (type 1) with a=40 atomic ppm and b=35 atomic ppm. The carbon, nitrogen and oxygen atom contents in the surface layer 23 were 40 atomic %, 10 atomic % and 10 atomic %, respectively.

(2) Comparison Example 5

The carbon atom content in the photoconductive layer 22 was constant (10 atomic %), and the fluorine atom content in the photoconductive layer 22 was constant (50 atomic ppm). The carbon atom content in the surface layer 23 was 5 atomic %. In the other respects, the conditions are the same as in Example 7.

Table 7 below shows the evaluation in the light memory, the charging property, the potential shift, the potential unevenness (both in the generating line direction and circumferential direction) and the temperature dependency.

TABLE 7

| | EXAMPLE 7 | COMP. EXAMPLE 5 |
|---|---|---|
| WAVELENGTH | 565 | 565 |
| LIGHT QUANTITY | 5 | 5 |
| DUTY RATIO | 25 | 25 |
| LIGHT MEMORY | G | G |
| CHARGING PROPERTY, POTENTIAL SHIFT | E | E |
| POTENTIAL EVENNESS | E | G |
| TEMP. DEPENDENCY | E | G |
| TOTAL | P | E |

(P: Particularly excellent, E: Excellent, G: Good)

From the above Table 7, it will be understood that in Example 7, the charging property can be increased and the potential shift can be decreased with the good level of light memory, and in addition, the potential unevenness (both in the generating line direction and the circumferential direction) and the temperature dependency can be decreased.

Referring to FIG. 2, the description will be made as to the features of the third and fourth photosensitive members. The common features with the first and second photosensitive members are omitted for the sake of simplicity.

(1) Photoconductive layer 22

The fluorine atoms are so distributed as to have the maximum content at the interface with the surface layer 23, and therefore, it is possible to ease the interval stress between the conductive base 21 and the surface layer 23 resulting from the varying carbon atom content in the direction of the layer thickness. This is effective to reduce defects in the accumulating layer, and therefore, the film quality is improved. As a result, the temperature dependency of the a-Si photosensitive member 11 is reduced.

(2) Surface layer 23

The surface layer 23 simultaneously contains silicon atoms, carbon atoms, nitrogen atoms and oxygen atoms, and further hydrogen atoms and halogen atoms to constitute an amorphous material. The surface layer 23 substantially does not contain a material controlling conductivity unlike the photoconductive layer 22. The carbon atoms, nitrogen atoms and oxygen atoms may be uniformly distributed all over, or they may be distributed all over in the layer thickness direction but non-uniformly distributed in that direction in a part of parts. However, in any case, it is desirable that they are distributed uniformly and all over in a plane parallel to the surface of the conductive base 21, since then the uniformity of the properties in a plane is assured.

The carbon atoms, the nitrogen atoms and the oxygen atoms distributed in the entirety of the surface layer 23 are effective to increase the dark resistance and the hardness when they are simultaneously contained. The sum of the carbon atom, nitrogen atom and oxygen atom contents in the surface layer 23 is preferably 40–90 atomic %, further preferably 45–80 atomic %, and even further preferably 50–80 atomic %. In order to assure the advantageous effects of the present invention, it is preferable that the oxygen atom content and the nitrogen atom content are not more than 10 atomic %.

The nitrogen atoms and halogen atoms contained in the surface layer 23 are effective to compensate for the dangling bonds in a-SiC (H, X), thus, improving the film quality. They are also effective to reduce the carriers trapped in the interface between the photoconductive layer 22 and the surface layer 23, and therefore, "flow" of the image is suppressed. The halogen atoms are effective to improve the water repelling property of the surface layer 23, and therefore, to suppress the high humidity "flow" attributable to the attraction of the water vapor thereto. The halogen atom content in the surface layer 23 is not less than 20 atomic %, and the sum of the nitrogen atom and the halogen atom is preferably 30–70 atomic %, preferably 35–60 atomic %, and even preferably 40–60 atomic %.

As described in the foregoing, according to this embodiment (the third and fourth photosensitive members), the following advantageous effects are provided:

(1) The main discharging light is pulsewisely projected at high intensity through a pulse width modulation system. The photoconductive layer of the amorphous silicon photosensitive member contains the carbon atoms with the maximum content in the position closest to the surface layer and fluorine atoms with the content maximum in the position closest to the surface layer; and the surface layer contains 40–90 atomic % of the carbon atoms. Then, the charging property decrease and the potential shift can be minimized with the light memory level being satisfactorily low. In addition, the generating line direction potential unevenness and the temperature dependency can be decreased. Therefore, the total performance can be improved.

(2) As an unexpected effect, the residual potential can be maintained low before the temperature of the amorphous silicon photosensitive member reaches the predetermined level. Therefore, the background fog of the copy image can be reduced even before the temperature of the amorphous silicon photosensitive member reaches the predetermined level.

Embodiment 3

In this embodiment, a fifth a-Si photosensitive member was prepared. This photosensitive member is different from the above-described second photosensitive member in that the photoconductive layer contains the carbon atoms with content which is the minimum in the position closest to the surface layer and 10–5000 atomic ppm of the oxygen atoms. The surface layer is the same as in the second photosensitive member, that is, the sum of the carbon atom, the nitrogen atom and the oxygen atom contents is 40–90 atomic %.

Experiment 16

The structure was as shown in FIG. 40 (type 1) with a=0 atomic % and b=10 atomic %. The generating line direction unevenness and the circumferential direction unevenness were investigated while the some of carbon atom content, the nitrogen atom content and the oxygen atom content in the surface layer (C+N+O) was changed or while the ratio of the carbon atom content to the sum, C/(C+N+O). The oxygen atom content in the photoconductive layer was substantially 0 atomic ppm.

The experimental conditions are as follows:

Used machine: Electrophotographic machine of FIG. 1:

Drum peripheral speed: 380 mm/sec
Light source of the main discharger: LED
Power to the light source: PWM (FIG. 41), Duty ratio of 25%
Light quantity thereof: 5 $\mu J/cm^2$
Wavelength of the light thereof: 565 nm (peak)

The generating line direction evenness was measured in the following manner: The potential unevenness in the direction of the generating line of the a-Si photosensitive member was determined in the following manner. The charging current of the main charger 12 is adjusted so as to provide a dark portion potential of 400 V at the position of the developing device. The actuation voltage for the halogen lamp for emitting the exposure light is adjusted to provide a light portion voltage of 200 V when the original to be copied is a blank copy sheet of A3 size. The light portion potentials are measured at five positions, i.e., at the center of the a-Si photosensitive member in the direction of the generating line thereof, at two portions 7 cm away therefrom in the same direction and at two positions 14 mm away from the center in the same direction. The difference between the maximum and the minimum of the measurements is defined as the potential unevenness in the generating line direction.

Circumferential direction unevenness was measured in the following manner: The potential unevenness in the circumferential direction of the a-Si photosensitive member was determined in the following manner. The light portion potential is adjusted to be 200 V as in the case of the unevenness in the generating line direction. The light portion potentials are measured at circumferentially different positions but at longitudinally the same position. The difference between the maximum and the minimum of the measurements is defined as the potential unevenness in the circumferential direction.

FIG. 42 shows the result of the experiments. As will be understood from this Figure, the advantageous effects of the present invention with respect to the generating line direction and circumferential direction unevenness in the potential is confirmed when the sum of the carbon atom, nitrogen atom and oxygen atom contents in the surface layer of the a-Si photosensitive member is 40–90 atomic %, particularly 50–80 atomic %. It has also been found that whether the generating line direction unevenness or the circumferential direction unevenness is improved, or the balance therebetween, is determined by ratio of carbon atoms content to the sum of the carbon, oxygen and nitrogen contents (C/(C+O+N)).

Experiment 17

The photosensitive member is of the structure shown in FIG. 40 (type 1) with a=0 atomic % and b=10 atomic %. The carbon atom content in the surface layer was 40 atomic %; the nitrogen atom content, 10 atomic %; the oxygen atom content 10 atomic %. Various properties were investigated while changing the oxygen atom content in the photoconductive layer.

As a result, it has been found that the potential shift is dependent on the oxygen atom content in the photoconductive layer, but the other properties are substantially independent therefrom.

FIG. 43 shows a relation between the oxygen atom content in the photoconductive layer and the potential shift. From this Figure, it is understood that the potential shift can be further decreased if the oxygen atom content in the photoconductive layer is 10–5000 ppm.

From the foregoing experiments, the following has been found. By actuating the main discharging light source through a pulse width modulation (PWM) system and projecting a high intensity pulse light, the charging property and the potential shift can be improved with the light memory maintained at a satisfactory level. When the carbon atom content in the photoconductive layer of the photosensitive member is minimum at the position closest to the surface layer, and it is changed continuously or stepwisely in the direction of the thickness of the film, they are further improved. When the sum of the carbon atom, the nitrogen atom and the oxygen atom contents in the surface layer is 40–90 atomic %, the generating line direction unevenness and the circumferential direction unevenness in the potential can be reduced. If the oxygen atom content in the photoconductive layer is 10–5000 atomic ppm, the potential shift can be decreased without influencing the other properties.

There is no particular limit to the carbon atom content in the photoconductive layer, but it is preferably 0.5–50 atomic % in the photoconductive layer, 0–40 atomic % at the position closest to the surface layer, further preferably 1–40 atomic % in the photoconductive layer and 0–30 atomic % in the position closest to the surface layer. The photoconductive layer may contain hydrogen atoms and/or halogen atoms. In addition, as desired, the group III atoms, the group V atoms and/or the group VI atoms may be contained. Preferably, the sum of the contents of the group III atoms, group V atoms and group VI atoms is 1 atomic ppm–40 atomic %.

Examples of this embodiment will be described.

(Example 8)

Figure 6:
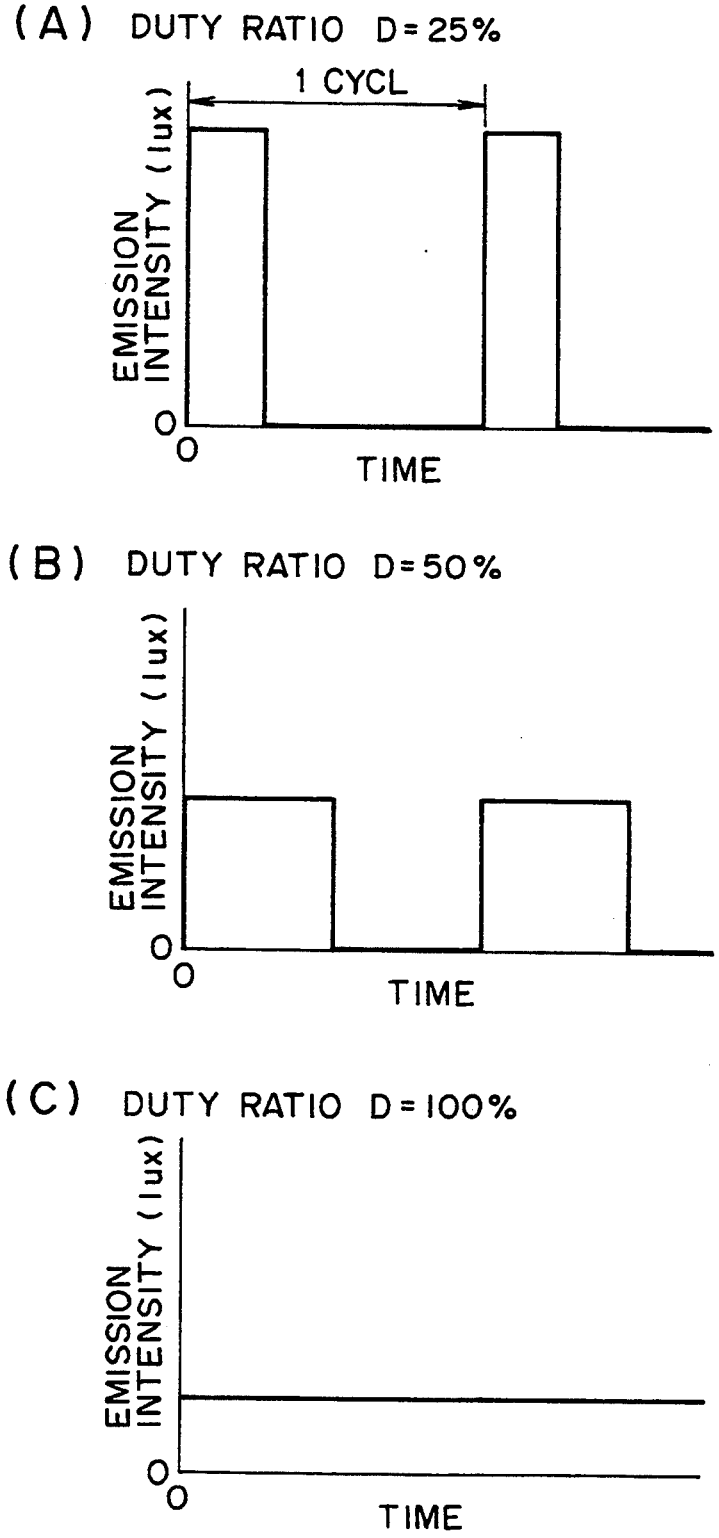
FIG. 6 includes graphs explaining a method of changing a duty ratio D without changing the wavelength and the quantity of light of the main discharging light.

The light memory, charging property and potential shift were investigated under the following conditions:

Used machine: Electrophotographic machine of FIG. 1:
Drum peripheral speed: 380 mm/sec
Light source of the main discharger: LED
Power to the light source: PWM (FIG. 41), Duty ratio of 25%
Light quantity thereof: 5 $\mu J/cm^2$
Wavelength of the light thereof: 565 nm (peak)
Photosensitive member: FIG. 6
Oxygen content in photoconductive layer: substantially 0 atomic ppm In the pulse width modulation system, the reference wave (saw teeth wave) as shown in FIG. 41B is used, and control signals are compared with this reference wave, and on the basis of the comparison the power supply to the main discharging light source is on-off-controlled.

In this embodiment, the reference wave had the frequency of 4 kHz.

The light memory was measured in the following manner. First, the charging current of the main charger 12 is adjusted so that the dark potential of the photosensitive member at the developing position is 400 V and the actuation voltage for the original illuminating halogen lamp is adjusted so that the light potential is +50 V when the original is a copy sheet of A3 size. The potential difference at the same portion of the photosensitive member between when the halogen lamp is energized for only the leading portion of the image and when the halogen lamp is not energized, that is, the potential difference at the image trailing portion is detected. The potential difference is defined as the light memory potential.

The charging property was discriminated on the basis of the dark potential at the position of the developing device when a constant current is supplied to the main charger.

The potential shift was determined on the basis of the dark potential at the position of the developing device when the continuous copying operation is carried out with a constant current supplied to the main charger.

The result is shown in Table 8 (Tables 8-1, 8-2 and 8-3 deals with the duty, wavelength and light quantity dependencies). It will be understood that the charging property and the potential shift are improved with the light memory level maintained satisfactory.

(Comparison Example 6)

The light memory, charging property and potential shift were investigated under the following conditions:

Used machine: Electrophotographic machine of FIG. 1:

Drum peripheral speed: 380 mm/sec

Power to the light source: DC (FIG. 44)

Light quantity thereof: 5 $\mu J/cm^2$

Wavelength of the light thereof: 565 nm (peak)

Photosensitive member: Same as Example 8

The result is also shown in Table 8 (the duty, wavelength and light quantity dependencies are also shown in Tables 8-1, 8-2and 8-3, respectively). The light memory level is equivalent to Example 8 but the charging property and the potential shift are not satisfactory.

(Example 9)

The light memory, charging property and potential shift were investigated under the following conditions:

Used machine: Electrophotographic machine of FIG. 1:

Drum peripheral speed: 380 mm/sec

Power to the light source: PWM (FIG. 41), Duty ratio of 25%

Light quantity thereof: 5 $\mu J/cm^2$

Wavelength of the light thereof: 660 nm (peak)

Frequency of reference wave R: 4 KHz

The used reference wave had the frequency of 4 kHz.

The same measuring method were used as in Example 8.

The result is also shown in Table 8 (the duty ratio, wavelength and light quantity dependencies are contained in Tables 8-1, 8-2 and 8-3, respectively). It will be understood that the charging property is improved, and the potential shift is decreased with the light memory level maintained at the satisfactory level.

Comparison Example 7)

The light memory, charging property and potential shift were investigated under the following conditions:

Used machine: Electrophotographic machine of FIG. 1:

Drum peripheral speed: 380 mm/sec.

Power to the light source: DC (FIG. 44)

Light quantity thereof: 5 $J/cm^2$

Wavelength of the light thereof: 610 nm (peak)

The same measuring method as in Comparison Example 6 was used.

The result is shown in Table 8 (the duty, wavelength and light quantity dependencies are contained in Tables 8-1, 8-2and 8-3, respectively). It will be understood that the light memory is equivalent to the Example 9, but the charging property and the potential shift are not satisfactory.

(Example 10)

The light memory, charging property and potential shift were investigated under the following conditions:

Used machine: Electrophotographic machine of FIG. 1:

Drum peripheral speed: 380 mm/sec

Light source of the main discharger: LED

Power to the light source: PWM (FIG. 41), Duty ratio of 50%

Light quantity thereof: 5 $\mu J/cm^2$

Wavelength of the light thereof: 565 nm

The reference wave used had the frequency of 4 kHz.

The measurement method was the same as in Example 8.

The result is also shown in Table 8 (the duty, wavelength and light quantity dependencies are contained in Tables 8-1, 8-2and 8-3, respectively). It is understood that the charging power and the potential shift are improved with the light memory maintained at the satisfactory level.

(Example 11)

The light memory, charging property and potential shift were investigated under the following conditions:

Used machine: Electrophotographic machine of FIG. 1:

Drum peripheral speed: 380 mm/sec

Light source of the main discharger: LED

Power to the light source: PWM (FIG. 41), Duty ratio of 25%

Light quantity thereof: 3 $\mu J/cm^2$

Wavelength of the light thereof: 565 nm (peak)

The used reference wave had the frequency of 4 kHz.

The measurement method was the same as in Example 8.

The result is shown in Table 8 (the duty ratio, wavelength and the light quantity dependencies are contained in Tables 8-1, 8-2and 8-3, respectively). It is understood that the charging property and the potential shift are improved with the light memory level maintained at the satisfactory level.

TABLE 8

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| EX. | | | | | | |
| 8 | 565 | 5 | 25 | G | E | E |
| 9 | 610 | 5 | 25 | E | G | E |
| 10 | 565 | 5 | 50 | G | G | G |
| 11 | 565 | 3 | 25 | F | E | G |
| COMP. EX. | | | | | | |

TABLE 8-continued

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| 6 | 565 | 5 | 100 | G | F | F |
| 7 | 610 | 5 | 100 | E | NG | F |

(E: Excellent, G: Good, F: Fair, NG: No good)

The description will be made as to the respective parameters.

Table 8 -1 is for the duty dependency. It will be understood that under the condition of the constant wavelength and the light quantity, the charging property and the potential shift are improved with the reduction of the duty. Simultaneously, it will be understood that the light memory is not dependent on the duty.

Table 8 -2 deals with the wavelength dependency. It will be understood that under the condition of the constant light quantity and duty, the charging property and the potential shift are improved with decrease of the wavelength, but the light memory property is worsened with the reduction of the wavelength.

Table 8 -3 deals with the light quantity dependency. It will be understood that under the condition of the constant wavelength and duty, the light memory is worsened but the charging property and the potential shift are not substantially influenced by reduction of the light quantity.

TABLE 8-1

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| EX. | | | | | | |
| 8 | 565 | 5 | 25 | G | E | E |
| 10 | 565 | 5 | 50 | G | G | G |
| COMP. EX. 6 | 565 | 5 | 100 | G | F | F |
| EX. 9 | 610 | 5 | 25 | E | G | E |
| COMP EX. 7 | 610 | 5 | 100 | E | NG | F |

(E: Excellent, G: Good, F: Fair, NG: No good)

TABLE 8-2

| | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| EX. | | | | | | |
| 8 | 565 | 5 | 25 | G | E | E |
| 9 | 610 | 5 | 25 | E | G | E |
| COMP. EX. | | | | | | |
| 6 | 565 | 5 | 100 | G | F | F |
| 7 | 610 | 5 | 100 | E | NG | F |

(E: Excellent, G: Good, F: Fair, NG: No good)

TABLE 8-3

| EX. | WAVE-LENGTH | LIGHT QUANTITY | DUTY RATIO | LIGHT MEMORY | CHARGING PROPERTY, POTENTIAL SHIFT | TOTAL |
|---|---|---|---|---|---|---|
| 8 | 565 | 5 | 25 | G | E | E |
| 11 | 565 | 3 | 25 | F | E | G |

(E: Excellent, G: Good, F: Fair, NG: No good)

(Example 12)

The experimental condition are as follows:

Used machine: Electrophotographic machine of FIG. 1:

Drum peripheral speed: 380 nm/sec

Light source of the main discharger: LED

Power to the light source: PWM (FIG. 41), Duty ratio of 25%

Light quantity thereof: 5 $\mu J/cm^2$

Wavelength of the light thereof: 565 nm (peak)

Frequency of reference wave R: 4 KHz

Photosensitive member: FIG. 40 (a=0 atomic %, b=10 atomic %)

Carbon content in surface layer: 40 atomic %

Nitrogen content in surface layer: 10 atomic %

Oxygen content in surface layer: 400 ppm

The light memory, charging property, potential shift and potential unevenness were investigated.

The frequency of the reference wave was 4 kHz in this Example. The measurement method was the same as in Example 8.

The result is also shown in Table 8, it is understood that the charging property and the potential shift are improved with the light memory level maintained satisfactory. In addition, the potential unevenness is reduced. Particularly, the potential shift data show extremely good results.

(Comparison Example 8)

The light memory, charging property, potential shift and potential unevenness were investigated under the following conditions:

Used machine: Electrophotographic machine of FIG. 1:

Drum peripheral speed: 380 mm/sec

Light source of the main discharger: LED

Power to the light source: PWM (FIG. 4), Duty ratio of 25%

Light quantity thereof: 5 $\mu J/cm^2$

Wavelength of the light thereof: 565 nm (peak)

Figures 45A, 45B, 45C, 45D:
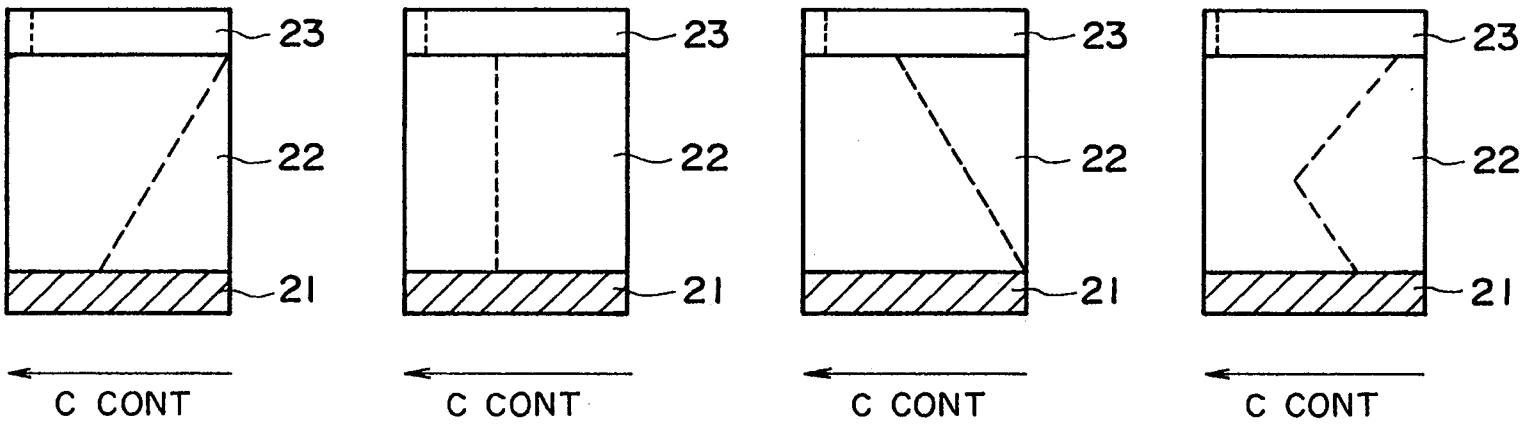

Photosensitive member: FIG. 45B

Carbon content in photoconductive layer: 10 atomic %

Oxygen content in photosensitive layer: Substantially 0 atomic %

Carbon content in surface layer: 5%

The frequency of the reference wave used was 4 kHz. The measurement method was the same as in Example 8. The result is shown in Table 9.

TABLE 9

| | EXAMPLE 12 | COMP. EXAMPLE 8 |
|---|---|---|
| WAVELENGTH | 565 | 565 |
| LIGHT QUANTITY | 5 | 5 |
| DUTY RATIO | 25 | 25 |
| LIGHT MEMORY | G | G |
| CHARGING PROPERTY, POTENTIAL SHIFT | P | E |
| POTENTIAL EVENNESS | E | G |
| TOTAL | P | E |

(P: Particularly excellent, E: Excellent, G: Good)

It will be understood that the charging property and the potential shift property are improved with the light memory level maintained at the satisfactory level. However, the potential unevenness does not decrease. The potential shift improvement is not as good as in Example 12.

Referring to FIG. 2, the features of the fifth a-Si photosensitive member will be described. The features common to the foregoing embodiments will be omitted for the sake of simplicity.

In the fifth photosensitive member, the stress in the accumulated films are effectively eased to suppress the structure defects of the films by the combination effects of the oxygen atoms in the photoconductive layer. Therefore, the mobility of carriers in the A-SiC is improved, and particularly, the potential shift which is a problem with the photoconductive layer of the A-SiC photosensitive member, can be reduced. In addition, the surface potential properties such as the sensitivity and the residual potential or the like, can be improved.

The oxygen atoms may be distributed uniformly all over in the photoconductive layer. It may be distributed non-uniformly in the direction of the layer thickness in part. If the oxygen atom content is less than 10 atomic ppm, the further improvement in the close contactness between films and the further suppress of abnormal development, can not be satisfactorily accomplished with the result of large potential shift. If it exceeds 5000 atomic ppm, the electric characteristics in view of the high speed operation of the electrophotography are not satisfactory. From these standpoints, the content of the oxygen atoms is preferably 10–5000 atomic ppm.

When the photoconductive layer contains the above-described range of the carbon atoms, the photoconductive characteristics, the image property and the durability are remarkably improved if the contents of the fluorine atoms and the content of the oxygen atoms within the above range.

As the starting materials for introduction of the oxygen atom (O), there may be effectively used, for example, oxygen ($O_2$), nitrogen dioxide ($NO_2$), dinitrogen oxide ($N_2O_4$), dinitrogen pentoxide trinitrogen tetraoxide ($N_3O_4$), dinitrogen pentoxide ($N_2O_5$).

In addition introduction of the oxygen atoms as well as the carbon atoms (C), CO, $CO_2$ or the like are usable.

According to Embodiment 3 using the fifth photosensitive member, the main discharging light is actuated through a pulse width modulation (PWM) system, and the pulse light projection is effected at the high light intensity. Therefore, the charging property and the potential shift can be improved with the light memory level is maintained at the conventional good level. In addition, the carbon atom content in the photoconductive layer of the photosensitive member is the minimum at the position closest to the surface layer, and its distribution changes continuously and/or stepwisely, so that the above effects are further remarkable. The surface layer simultaneously contained the carbon atoms, the nitrogen atoms and the oxygen atoms, and the sum of the contents thereof is 40–90 atomic %, by which the potential unevenness can be reduced. In addition, by containing in the conductive layer the oxygen atoms with content of 10–5000 atomic ppm, the potential shift can be further decreased.

Embodiment 4

In this embodiment, a sixth a-Si photosensitive member was prepared. Sixth photosensitive member is different from the fifth photosensitive member in that the photoconductive layer 22 contains fluorine atoms with content which is the maximum at the position closest to the surface layer 23. That is, the distribution of the fluorine atom content in the photoconductive layer 22, is as shown in FIG. 28C, in which it is 50 atomic ppm at the interface with the surface layer 23 and is 0 atomic ppm at the interface with the conductive base 21, and the distribution changes paraboricly and continuously.

The sixth photosensitive member is the same as the fifth photosensitive member in that the surface layer 23 contains the carbon atoms, nitrogen atoms and the oxygen atoms, and the sum of the contents thereof is 40–90 atomic %.

Experiment 18

The a-Si photosensitive member 11 had the structure of FIG. 16A (type 1) in which the carbon atom content in the photoconductive layer 22 is such that a=0 atomic % and b=10 atomic %. The generating line direction potential unevenness and the circumferential direction potential unevenness of the a-Si photosensitive member 11 were investigated while changing the sum of the carbon, nitrogen and oxygen atom contents (C+N+O) in the surface layer or while changing the ratio of the carbon atom content to the sum (C/(C+N+O)).

The experimental conditions are as follows:

Used machine: Electrophotographic machine of FIG. 1:

Drum peripheral speed: 380 mm/sec

Light source of the main discharger: LED
Power to the light source: Constant duty ratio of 25%
Light quantity thereof: 5.5 $\mu J/cm^2$ (constant)
Wavelength of the light thereof: 565 nm (constant)
Frequency of reference wave R: 4 KHz The potential unevenness in the generating line direction and the circumferential direction of the a-Si photosensitive member was measured in the following manner.

(1) Generating line direction unevenness:

The potential unevenness in the direction of the generating line of the a-Si photosensitive member was determined in the following manner. The charging current of the main charger 12 is adjusted so as to provide a dark portion potential of 400 V at the position of the developing device (FIG. 1). The actuation voltage for the halogen lamp for emitting the exposure light 13 is adjusted to provide a light portion voltage of 200 V when the original to be copied is a blank copy sheet of A3 size. The light portion potentials are measured at the center of the a-Si photosensitive member 11 in the direction of the generating line thereof, at two portions 7 cm away therefrom in the same direction and at two positions 14 mm away from the center in the same direction. The difference between the maximum and the minimum of the measurements is defined as the potential unevenness in the generating line direction.

(2) Circumferential direction unevenness:

The potential unevenness in the circumferential direction of the a-Si photosensitive member was determined in the following manner. The light portion potential is adjusted to be 200 V as in the case of the unevenness in the generating line direction. The light portion potentials are measured at circumferentially different positions but at longitudinally the same position. The difference between the maximum and the minimum of the measurements is defined as the potential unevenness in the circumferential direction.

FIGS. 46A, 46B and 46C are concerned with Experiment 18. FIG. 46A is a graph showing a test result of a potential unevenness along the generating line of an a-Si photosensitive member when a sum of carbon, nitrogen and oxygen atom contents (C+N+O) in the surface layer is varied; FIG. 46B is a graph showing a test result of a potential unevenness along the circumference of an a-Si photosensitive member when a sum of carbon, nitrogen and oxygen atom contents (C+N+O) in the surface layer is varied; and FIG. 46C is a graph showing a test result of a potential unevenness along the generating line and along the circumference of an a-Si photosensitive member when a ratio of a carbon atom content to a sum of the carbon atom content and nitrogen and oxygen atom contents (C/(C+N+O)) in the surface layer is varied.

From FIGS. 46A and 46B, it is understood that the generating direction and the circumferential direction unevenness in the potential is improved if the sum of the carbon atom, nitrogen atom and oxygen atom contents (C+N+O) in the surface layer 23 is 40–90 atomic % (particularly 50–80 atomic %).

From FIGS. 46C, it is understood that either one of the generating line direction unevenness and the circumferential direction unevenness is improved depending on the ratio C/(C+N+O).

The description will be made as to the various properties of the a-Si photosensitive member 11 when the oxygen atom content in the photoconductive layer 22 of the a-Si photosensitive member 11 is changed.

Experiment 19

The a-Si photosensitive member 11 has the structure shown in FIG. 16A in which the carbon atom content distribution of the photoconductive layer 22 was such that a=0 atomic % and b=10 atomic %, and the carbon, nitrogen and oxygen atom contents in the surface layer 23 were 40 atomic %, 10 atomic % and 10 atomic %, respectively.

FIG. 47 shows the result of experiments on the potential shift.

From this, it is understood that the potential shift can be further decreased when the content of the oxygen atom in the photoconductive layer 22 is 10–5000 atomic ppm.

As regards the properties other than the potential shift, they do not particularly change even if the content of the oxygen atoms in the photoconductive layer 22 is changed.

Next, the fluorine atom content distribution in the photoconductive layer 22 was changed to investigate the light memory, the charging property, the potential shift, the generating line direction potential unevenness, the circumferential direction potential unevenness and the temperature dependency in Experiment 20–22.

Experiment 20

Various properties were investigated under the following conditions:

Used machine: Electrophotographic machine of FIG. 1:
Drum peripheral speed: 380 mm/sec
Power to the light source: Constant Duty ratio of 25%
Light quantity thereof: 5.5 $\mu J/cm^2$ (constant)
Wavelength of the light thereof: 565 nm (constant)
Frequency of reference wave R: 4 KHz The temperature dependency was determined in the following manner. The temperature of the a-Si photosensitive member is controlled to be a predetermined level (approx. 45° C.). The charging current of the main charger 12 is adjusted so as to provide a dark portion potential of 400 V at the position of the developing device (FIG. 1). The actuation voltage for the halogen lamp for emitting the exposure light 13 is adjusted to provide a light portion voltage of 200 V when the original to be copied is a blank copy sheet of A3 size. The temperature Th of the photosensitive member 11 is measured, and the heater is switched off. When the temperature becomes 35° C., the light portion potential is measured. The temperature dependency is defined as the difference of the potential Vth at Th and that at 35° C. divided by the temperature difference (Th-35).

The fluorine atom content distribution in the photoconductive layer 22 of the a-Si photosensitive member was classified into three types, as follows:

(1) Type 1

As shown in FIG. 29A, the fluorine atom content was the maximum, i.e., a atomic ppm at the portion closest to the surface layer 23, was the minimum, i.e., a−b atomic ppm at the portion closest to the conductive base 21, and was changed linearly therebetween:

(2) Type 2

As shown in FIG. 29B, the fluorine atom content was the maximum, i.e., a atomic ppm at the portion closes to the surface layer 23, was the minmum, i.e., a−b atomic ppm at the portion closest to the conductive base 21, and was changed stepwisely therebetween: and (3) Type 3

As shown in FIG. 29C, the carbon atom content was the maximum, i.e., a atomic ppm at the portion closest to the surface layer 23, was the minimum, i.e., a−b atomic ppm at the portion closest to the conductive base 21, and was changed stepwisely at least at one position and continuously at the other.

FIGS. 48A, 48B and 48C are concerned with Type 1 shown in FIG. 29A when a fluorine atom content (atomic ppm) in the portion closest to the surface layer is varied. FIG. 48A shows a test result when the fluorine atom content (a−b atomic ppm) in the portion closest to the conductive base is a atomic ppm; FIG. 48B shows a test result when the fluorine atom content (a−b atomic ppm) in the portion closest to the conductive base is a−20 atomic ppm; and FIG. 48C shows a test result when the fluorine atom content (a−b atomic ppm) in the portion closest to the conductive base is a−30 atomic ppm. FIGS. 49A, 49B and 49C show the same but for type 2. FIGS. 50A, 50B and 50C show the same but for type 3.

From the results shown in FIGS. 48A, 48B, 48C, 49A, 49B, 49C, 50A, 50B and 50C, it is understood that when the fluorine atom content distribution in the photoconductive layer 22 is such that the content decreases from the surface layer 23 side toward the conductive base 21, the light memory, the charging property, the potential shift, the generating line direction unevenness, the circumferential unevenness and the temperature dependency, are hardly dependent on the fluorine atom content a atomic ppm at the position closest to the surface layer 23 and the fluorine atom content a−b atomic ppm at the position closest to the conductive base 21, and therefore, the advantageous effects of the present invention are sufficiently provided.

Experiment 21

Various properties were investigated under the following conditions:

Used machine: Electrophotographic machine of FIG. 1:

Drum peripheral speed: 380 mm/sec

Power to the light source: Constant duty ratio of 25%

Light quantity thereof: 5.5 $\mu J/cm^2$

Wavelength of the light thereof: 565 nm (constant)

Frequency of reference wave R: 4 KHz

The fluorine atom content distribution in the photoconductive layer 22 of the a-Si photosensitive member was classified into three types, as follows:

(1) Type 1

As shown in FIG. 33A (the broken line), the fluorine atom content was the maximum, i.e., a atomic ppm at the portion closest to the surface layer 23, and was the minimum, i.e., a−b atomic ppm between the surface layer 23 and the conductive base 21, and the carbon atom content was a−c atomic ppm at the portion closest to the conductive base, and the fluorine atom content was changed continuously therebetween:

(2) Type 2

As shown in FIG. 33B, the fluorine atom content was the maximum, i.e., a atomic ppm at the portion closest to the surface layer 23, and was the minimum, i.e., a−b atomic ppm between the surface layer 23 and the conductive base 21, and the carbon atom content was a−c atomic ppm at the portion closest to the conductive base, and the fluorine atom content was changed stepwisely therebetween: and (3) Type 3

As shown in FIG. 33C, the carbon atom content was the maximum, i.e., a atomic ppm at the portion closest to the surface layer 23, and was the minimum, i.e., a−b atomic ppm between the surface layer 23 and the conductive base 21, and the carbon content was a−c atomic ppm at the portion closest to the conductive base, and the fluorine atom content was changed stepwisely at least at one position and continuously at the other.

FIGS. 51A, 51B and 51C are concerned with Type 1 shown in FIG. 33A in which the fluorine atom content a in the portion closest to the surface layer is changed. FIG. 51A is a graph showing a result of the test in which the fluorine atom content between the surface layer and the conductive base (a−b atomic ppm) is a−5 atomic ppm, and the fluorine atom content in the portion closest to the conductive base (a−c atomic ppm) is a−2 atomic ppm, FIG. 51B is a graph showing a result of the test in which the fluorine atom content between the surface layer and the conductive base (a−b atomic ppm) is a−20 atomic ppm, and the fluorine atom content in the portion closes to the conductive base (a−c atomic ppm) is a−10 atomic ppm; and FIG. 51C is a graph showing a result of the test in which the fluorine atom content between the surface layer and the conductive base (a−b atomic ppm) is a−3 atomic ppm, and the fluorine atom content in the portion closest to the conductive base (a−c atomic ppm) is a−15 atomic ppm. FIGS. 52A, 52B and 52C show the same but for type 2. FIGS. 53A, 53B and 53C show the same but for type 3.

From the results shown in FIGS. 51A, 51B, 51C, 52A, 52B, 52C, 53A, 53B and 53C, it is understood that even when the fluorine atom content distribution is as shown in FIG. 50, the light memory, the charging property, the potential shift, the generating line direction unevenness, the circumferential direction unevenness and the temperature dependency are hardly dependent on the fluorine atom content a atomic ppm at the position closest to the surface layer 23, the content a−b atomic ppm between the surface layer 23 and the conductive base 21 and the fluorine atom content a−c atomic ppm at the position closest to the conductive base 21, and therefore, the advantageous effects of the present invention are sufficient provided.

Experiment 22

Various properties were investigated under the following conditions:

Used machine: Electrophotographic machine of FIG. 1:

Drum peripheral speed: 380 mm/sec

Power to the light source: Varied Duty ratio

Light quantity thereof: 5.5 $\mu J/cm^2$

Wavelength of the light thereof: 565 nm (constant)

Frequency of reference wave R: 4 KHz

Fluorine atom content distribution in the photoconductive layer 22 of the a-Si photosensitive member 11 was as shown in FIG. 54, in which the fluorine atom content is the maximum at the position closest to the surface layer 23 (70 atomic ppm, and it is the minimum at the position closest to the conductive base 21 (10 atomic ppm). The content was changed irregularly therebetween.

FIG. 55 shows the result of the experiments.

From this, it is understood that even if the fluorine atom content in the photoconductive layer 22 is as shown in 54, the light memory, the charging property, the potential shift, the generating line unevenness, the circumferential unevenness and the temperature dependency, are sufficiently improved by reducing the duty ratio D of the main discharging light.

From the Experiment 18-22, the following has been found:

(1) When the sum of the carbon atom, the nitrogen atom and the oxygen atom contents in the surface layer 23 is 40-90 atomic %, the generating direction unevenness and the circumferential direction unevenness of the a-Si photosensitive member 11 are decreased.

(2) When the oxygen atom content in the photoconductive layer 22 of the a-Si photosensitive member 11 is 10-5000 atomic ppm, the potential shift can be reduced without adverse influence to the other properties.

There is no particular limit to the carbon atom content in the photoconductive layer 22, but it is preferably 0.5-50 atomic % in the photoconductive layer 22, and is 0-40 atomic % at the position closest to the surface layer 23, and is further preferably 1-40 atomic % in the photoconductive layer 22 and 0-30 atomic % at the position closest to the surface layer 23. There is no particular limit to the fluorine atom content in the photoconductive layer, but it is preferably 1-95 atomic ppm in the photoconductive layer 22 and 10-100 atomic ppm at the position closest to the surface layer, and is further preferably 10-70 atomic ppm in the photoconductive layer 22 and is 20-80 atomic ppm at the position closest to the surface layer 23. The photoconductive layer 22 may contain hydrogen atoms and/or halogen atoms. It may contain the group III atoms, the group V atoms and/or group VI atoms, has desired. The content of each of the groups of the atoms is preferably 1 atomic ppm-40 atomic %.

The description will be made as to the Example 13 and Comparison Example 9.

(1) Example 13

The experimental conditions are as follows:

Used machine: Electrophotographic machine of FIG. 1:

Drum peripheral speed: 380 mm/sec

Light source of the main discharger: LED

Power to the light source: Constant duty ratio of 25%

Light quantity thereof: 5.5 $\mu J/cm^2$ (constant)

Wavelength of the light thereof: 565 nm (constant)

Frequency of reference wave R: 4 KHz (constant)

The photosensitive member 11 has the structure shown in FIG. 16A (type 1) having the carbon atom content distribution of a=0 atomic % and b=10 atomic %. The fluorine atom distribution in the photoconductive layer 22 was as shown in FIG. 28A (type 1) wherein a=50 atomic ppm nd b=40 atomic ppm. The oxygen atom content in the photoconductive layer 22 was 400 atomic ppm. The carbon atom, nitrogen atom and oxygen atom contents in the surface layer 23 were 40 atomic %, 10 atomic % and 10 atomic %, respectively.

(2) Comparison Example 9

The carbon atom content in the photoconductive layer 22 was constant (10 atomic %); the oxygen atom content in the photoconductive layer 22 was substantially 0 atomic %; and the fluorine atom content in the photoconductive layer 22 was constant (50 atomic ppm). The carbon atom content in the surface layer 23 was 5 atomic %. In the other respect, the photosensitive member of this Comparison Example was the same as in Example 5

Table 10 shows the evaluations of the light memory, the charging property, the potential shift, the potential unevenness and the temperature dependency.

TABLE 10

| | EXAMPLE 13 | COMP. EXAMPLE 9 |
|---|---|---|
| WAVELENGTH | 565 | 565 |
| LIGHT QUANTITY | 5 | 5 |
| DUTY RATIO | 25 | 25 |
| LIGHT MEMORY | G | G |
| CHARGING PROPERTY, POTENTIAL SHIFT | P | E |
| POTENTIAL EVENNESS | E | G |
| TEMP. DEPENDENCY | E | G |
| TOTAL | P | E |

(P: Particularly excellent, E: Excellent, G: Good)

From this table, it will be understood that in Example 13, the charging property and the potential shift can be improved with the light memory level maintained at the satisfactory level. Further, the potential unevenness and the temperature dependency can be decreased. Particularly, the potential shift improvement is very good.

Referring to FIG. 2, the features of the sixth a-Si photosensitive member will be described. The description of the features common to the foregoing photosensitive members will be omitted for simplicity of explanation.

Photoconductive layer 22 comprises a-SiC (H, F, O) containing silicon atoms, carbon atoms, nitrogen atoms and fluorine atoms from the conductive base 21 side. It is given the desired photoconductivity, particularly the charge retaining property, the charge generating property and the charge carrying property. In this embodiment of the present invention, the fluorine atom content is the maximum at the position closest to the surface layer 23 in the photoconductive layer 22. This is effective to ease the internal stress change between the conductive base 21 and the surface layer 23 attributable to the change of the carbon atom content in the direction of the layer thickness, and therefore, the defects in the accumulated layers, and therefore, the film qualities are improved. As a result, the temperature dependency of the a-Si photosensitive member 11 is improved.

As the combination effect of the co-existence of the oxygen atoms in the photoconductive layer 22, the stress between the accumulating films is effectively eased to suppress the structural defects of the films. Therefore, the mobility of the carrier in the a-SiC is improved. This particularly decreases the potential shift which is a problem with the photoconductive layer of the a-SiC photosensitive member. In addition, the surface potential property such as the sensitivity and the residual potential are improved.

The oxygen atoms may be uniformly distributed all over in the photoconductive layer 22. They may be distributed non-uniformly in the layer thickness direction in part. If the oxygen atom content is less than 10 atomic ppm, the further improvement in the close contact of the films and the further suppression of the abnormal development are not sufficiently expected, and the potential shift is increased. If the oxygen atom content exceeds 5000 ppm, the electric properties becomes not sufficient in view of the recent demand for the high speed operation of the electrophotography. From these standpoint, the oxygen atom content is preferably 10–5000 atomic ppm.

For example, when the a-SiC (H, F, O) photoconductive layer is produced through the glow discharging method, basically, the silicon atom (Si) supplying gas, the carbon atom (C) supplying gas, the hydrogen atom (H) supplying gas and the fluorine atom (F) supplying gas are introduced in a desired gas sate in the pressure-reducible reactor. Then, the glow discharge is produced in the reactor to deposit the a-SiC (H, F, O) layer on the surface of the conductive base 21 placed in the reactor.

As the starting materials for introduction of the oxygen atom (O), there may be effectively used, for example, oxygen ($O_2$), nitrogen dioxide ($NO_2$), dinitrogen oxide ($N_2O_4$), dinitrogen pentoxide trinitrogen tetraoxide ($N_3O_4$), dinitrogen pentoxide ($N_2O_5$). From the standpoint of introducing the oxygen atoms as well as the carbon atoms (C), CO and $CO_2$ are usable.

In order to produce the photoconductive layer 22 of a-SiC (H, F, O) having the properties suitable for the present invention, the temperature of the conductive base 21 and the gas pressure in the reactor are properly selected. The temperature (Ts) of the conductive base 21 is properly selected in accordance with the layer design, but in the normal case, it is 20°–500° C., preferably 50°–480° C. and further preferably 100°–450° C. The gas pressure in the reactor is properly selected in accordance with the layer design, but it is normally $1\times10^{-5}$–10 Torr, preferably $5\times10^{-5}$–3 Torr, further preferably $1\times10^{-4}$–1 Torr. In the present invention, the temperature of the conductive base 21 and the gas pressure for the formation of the layers are as described above, but the various parameters are not determined independently from each other, and they are determined in consideration of the interrelation between them to provide the desired properties of the photoconductive layer 22.

The surface layer 23 is of amorphous material containing silicon atoms, carbon atoms, nitrogen atoms and oxygen atoms simultaneously, and further nitrogen atoms and halogen atoms. The surface layer 23 substantially does not contain the material controlling the conductivity unlike the photoconductive layer 22. The carbon atoms, the nitrogen atoms and the oxygen atoms may be uniformly distributed all over in the surface layer 23, or they may be distributed in the layer thickness direction all over but non-uniformly in part. However, in any case, it is desirable that they are distributed uniformly all over in a plane perpendicular to the surface of the conductive base 21, since then, the characteristics thereof are made uniform.

When the carbon atoms, nitrogen atoms and oxygen atoms are simultaneously contained in the entire layer of the surface layer 23, the high dark resistance effect and the high hardness effect are particularly provided. The carbon atom content in the surface layer 23 is preferably 40–90 atomic %, further preferably 45–85 atomic %, even further preferably 50–80 atomic %. In order to assure the advantageous effects of the present invention, the contents of the oxygen atoms and the nitrogen atoms are preferably not more than 10 atomic %.

According to this embodiment of the present invention, the main discharge light is actuated through a pulse width modulation system and projects the pulse light at high intensity. The photoconductive layer of the amorphous silicon photosensitive member contains the carbon atoms with the maximum content at the position closest to the surface layer, 10–5000 atomic ppm of oxygen atoms, and fluorine atoms with the maximum content at the position closest to the surface layer. The surface layer contains the carbon atoms, the nitrogen atoms and oxygen atoms in which the sum of the contents is 40–90 atomic %. By doing so, the charging property reduction and the potential shift are minimized, and the potential unevenness and the temperature dependency can be decreased with the light memory maintained at the satisfactory level. Thus, the total performance is increased.

The manufacturing method for the a-Si photosensitive member usable with the present invention. There are a high frequency plasma CVD method, a microwave plasma CVD method by which the films are accumulated.

FIG. 56 illustrates the high frequency plasma CVD (RF-PCVD method) to manufacture the electrophotographic photosensitive member. The accumulation film manufacturing apparatus using the RF-PCVD method comprises an accumulation device 3100, a material gas supplying device 3200 and a exhausting device (not shown) for reducing the pressure in the reactor container 3111 in the accumulation device 3100.

The reactor 3111 contains a cylindrical supporting member 3112, a support heating heater 3113 and a material gas pipe 3114. The reactor 3111 is interconnected with a high frequency matching box 3115. The gas supplying device 3200 includes gas containers 3221–3226 containing material gases such as $SiH_4$, $H_4$ $CH_4$, NO, $NH_3$ or $SiF_4$, valves 3231–3236, inlet valves 3241–3246, outlet valves 3251–3256 and mass-flow controllers 3211–3216. The gas containers 3221–3226 are connected with the gas inlet pipe 3114 in the reactor 3111 through an auxiliary valve 3260.

An example of operation using the manufacturing apparatus will be described. The cylindrical support 3112 is placed in the reactor 3111, and the inside of the reactor 3111 is exhausted by an unshown exhausting device (vacuum pump, for example). Thereafter, the temperature of the cylindrical support 3112 is controlled to be a predetermined level between 20°–500° C. by the supporting member heating heater 3113. Before the material gases are supplied into the reactor 3111 for the formation of the film, it is confirmed that the valves 3231–3236 of the gas containers 3221–3226 and a leak valve 3117 of the reactor container are closed, that the inlet valves 3241–3246 and the outlet valves 3251–3256 and the auxiliary valve 3260 are opened. Then, the main valve 3118 is opened to exhaust the reactor 3111 and the gas pipe 3116. When the read of the vacuum gage 3119 reaches $5\times10^{-6}$ Torr, the auxiliary valve 3260 and the outlet valves 3251–3256 are closed. Subsequently, the valves 3231–3236 are opened to supply the gases from the gas containers 3221–3226. The gas pressure is controlled to be 2 kg/cm$^2$ by the pressure controllers 3261–3266. Then, the inlet valves 3241–3246 are gradually opened to permit the gases to be supplied to the mass-flow controllers 3211–3216.

In this manner, the preparation for the film formation is completed. Then, the photoconductive layer 22 and the surface layer 23 are formed on the cylindrical support 3112.

When the temperature of this cylindrical support 3112 reaches a predetermined level, a necessary one or ones of the output valves 3251–3256 and the auxiliary valve 3260 are gradually opened to permit the gases to flow into the reactor 3111 from the gas containers 3221–3226 through the gas inlet pipe 3114. Then, the flow rate, of the gases are controlled by the mass-flow controllers 3211–3216. In addition, the opening of the main valve 3118 is controlled so that the pressure in the reactor 3111 is at a predetermined level not higher than 1 Torr, while looking at the vacuum gauge 3119. When the internal pressure is stabilized, an unshown RF power source is set at a predetermined level, and the RF electric power is supplied to the reactor 3111 through a high frequency matching box 3115, by which the RF glow discharge is produced. By the discharging energy, the gases introduced in the reactor 3111 are dissolved, and accumulation layer or film including silicon has the main component is formed on the cylindrical support 3112. When the desired thickness of the layer is reached, the RF electric power supply is stopped. The outlet valves 3251–3256 are closed to stop the supply of the gases into the reactor 3111. Thus, the formation of the accumulation layer is completed.

By repeating the above described operations, a multilayer photoreception layer is formed.

In the formation of each of the layers, all of the outlet valves 3251–3256 except for the used material gases, are closed. In order to avoid stagnation of the gases in the reactor 3111, the outlet valves 3251–3256 and the pipes therebetween, the outlet valves 3251–3256 are closed, and then the auxiliary valve 3260 is opened, and in addition, the main valve 3118 is completely opened. Then, the system is once exhausted to a high vacuum. In order to accomplish the uniform film formation, the cylindrical support 3112 is rotated at a predetermined speed by a driving device (not shown) during formation of the film.

The gases and the valve operations may be modified in view of the desired layer forming conditions.

The heating method for the cylindrical support 3112 may be any if it is designed for the vacuum. More particularly, usable heaters include, electric resistance heat generating element such as wrapped sheath heater, plate heater or ceramic heater, a heat radiation lamp heater such as halogen lamp or infrared lamp, and a heating element using heat exchanger with liquid, gas or the like. The material of the surface of the heating means may be metal such as stainless steel, nickel, aluminum or copper, ceramic material or heat durable high polymer resin. As another method, an additional container exclusively for the heating may be used, by which the cylindrical support 3112 may be heated, and then the cylindrical support 3112 is conveyed into the reactor 3111 through a vacuum passage.

The description will be made as to the microwave plasma CVD method ($\mu$W-PCVD method).

FIGS. 57 and 58 illustrate an example of a accumulation film formation reactor for forming the accumulation film for an electrophotographic photosensitive member through the $\mu$W-PCVD method. FIG. 59 illustrates the electrophotographic photosensitive member manufacturing device using the $\mu$W-PCVD method.

The accumulating device 3100 in the RF-PCVD method shown in FIG. 56 is replaced with an accumulation device 4100 shown in FIG. 57, and the accumulating device 4100 and the material gas supplying device 3200, as show in FIG. 59, are connected together. By doing so, the electrophotographic photosensitive member manufacturing device using the $\mu$W-PCVD method.

The manufacturing apparatus comprises a sealed reactor 4111, the material gas supplying device 3200 and an exhausting device (not shown) for reducing the pressure in the reactor 4111. The reactor container 4111 is provided with a microwave guiding window 4112 made of such a material as to efficiently transmit the microwave electric power into the reactor 4111 and as to maintain the vacuum (quartz glass, alumina ceramics or the like), a stub tuner (not shown), a microwave guide 4113 connected with the microwave power source (not shown) through an isolator (not shown), a cylindrical support 4115 for formation of the accumulation film shown in FIG. 57, a support heating heater 4116, a gas inlet pipe 4117, and an electrode 4118 for supplying an external electric bias for controlling plasma potential. The inside of the reactor 4111 is in communication with an unshown diffuser pump through an exhausting pipe 4121. The gas supplying device 3200, as shown in FIG. 59, comprises material gas containers 3221–3226 for containing $SiH_4$, $H_2$, $CH_4$, NO, $NH_3$, $SiF_4$ or the like, valves 3231–3236, inlet valves 3241–2246, outlet valves 3251–3256, and mass-flow controllers 3211–3216. The gas containers 3221–3226 are connected to the gas inlet pipe 4117 in the reactor 3111 through an auxiliary valve 3260. As shown in FIG. 58, the space enclosed with the cylindrical support 4115 constitutes the discharge space 4130.

In operation of this apparatus using the $\mu$W-PCVD method, the cylindrical support 4115 is set in place in the reactor 4111, and the cylindrical support 4115 is rotated by a driving device 4120. The inside of the reactor 4111 is exhausted by an unshown exhausting device (vacuum pump, for example) through the exhausting pipe 4121 so that the internal pressure of the reactor 4111 is not higher than $1\times10^{-6}$ Torr. Subsequently, the temperature of the cylindrical support 4115 is heated to and maintained at a predetermined temperature level between 20°–500° C. by a supporting member heating heater 4116.

Before the material gases for the formation of the accumulation film is supplied into the reactor 4111, it is confirmed that the valves 3231–3236 of the gas containers 3221–3226 and a leak valve (not shown) of the reactor 4111 are closed and that the inlet valves 3241–3246 and the outlet valves 3251–3256 and the auxiliary valve 3260 are opened. Then, the main valve (not shown) is opened to exhaust the gas pipe 4222 and the reactor 4111. When the read of the vacuum gauge (not shown) reaches approximately $5\times10^{-6}$ Torr, the auxiliary valve 3260 and the outlet valves 3251–3256 are closed. Thereafter, the valves 3231–3236 are opened to permit supply of the gases from the gas containers 3221–3226, and each of the gas pressures is controlled to be 2 kg/cm$^2$ by the pressure controllers 3261–3266. Subsequently, the inlet valves 3241–3246 are gradually opened to permit the gases to be supplied to the mass-flow controllers 3211–3216.

After the completion of the preparation for the film forming operation, the photoconductive layer 22 and the surface layer 23 are formed on the cylindrical supporting member 4115.

When the temperature of the cylindrical support 4115 reaches the predetermined level, the necessary one or ones of the outlet valves 3251–3256 and the auxiliary valve 3260 are gradually opened to permit the material gases to be supplied to the discharging space 4130 in the reactor 4111 through the gas inlet pipe 4117 from the gas containers 3221–3226. Then, the flow rates are controlled by the mass-flow controllers 3211–3216. At this time, the opening of the main valve is controlled so that the pressure in the discharging space 4130 is at a predetermined level which is not higher than 1 Torr, while looking at the vacuum gauge. After the pressure is stabilized, the microwave of the frequency of 500 MHz or higher, preferably 2.45 GHz by an unshown microwave power source (not shown), and the microwave power source is set at a predetermined power level. Through the wave guide 4113 and the microwave guiding window 4112, the microwave energy is introduced into the discharging space 4130, by which the microwave glow discharge is produced. In parallel therewith, an electric bias, i.e., DC bias, for example, is supplied to the electrode 4118 from the power source 4119. In the discharging space 4130 enclosed with the cylindrical support 4115, the introduced gases are excited by the microwave energy and dissolved, so that the accumulation film is formed on the cylindrical support 4115. For the purpose of uniform layer thickness, the cylindrical support is rotated at a desired rotational speed by a motor 4120. After the desired thickness is provided, the microwave power supply is stopped. Then, the outlet valves 3251–3256 are closed, so that the gas supply to the reactor 4111 is shut off. Thus, the accumulation film formation is completed.

By repeating the above operations, a desired multilayer structure photoreceptive layer is provided.

When a layer is formed, the outlet valves 3251–3256 except for the necessary gases are closed. In order to avoid the stagnation of the gases in the reactor 4111, the outlet valves 3251–3256 and the pipe between them, the outlet valves 3251–3256 are closed, the auxiliary valve 3260 is opened, and the main valve is fully opened, and the system is once exhausted to a high vacuum. This operation is carried out at desired times.

The materials of the gases and the valve operation may be modified for the respective layer formation conditions.

The heating method for the cylindrical support 4115 may be any if it is designed for vacuum. Usable heaters include an electric resistance heat generating element such as sheath wrapped heater, plate heater, ceramic heater, a heat radiation lamp heater such as halogen lamp or infrared lamp, and a heater using heat exchanger with liquid or air. The material of the surface of the heating means may be stainless steel, nickel, aluminum, copper or another metal, ceramic material or heat resistive high polymer resin or the like. As another method, an additional container may be provided exclusively for the heating. After the cylindrical support is heated, it is conveyed to the reactor 4111 through a vacuum passage.

In the $\mu$W-PCVD method, the pressure in the discharging space 4130 is not lower than $1\times10^{-3}$ Torr and not higher than $1\times10^{-1}$ Torr, preferably not lower than $\times10^{-3}$ Torr and not higher than $5\times10^{-2}$ Torr, further preferably not lower than $5\times10^{-3}$ Torr and not higher than $3\times10^{-2}$ Torr. The pressure outside the discharging space 3140 is usable if it is lower than the pressure in the discharging space 4130. When the pressure of the discharging space 4130 is not higher than $1\times10^{-1}$ Torr, particularly not higher than $5\times10^{-2}$ Torr, the accumulation film properties are particularly improved if the pressure in the discharging space 4130 is not less than three times the pressure output the discharging space 4130.

As for the method for introducing the microwave to the reactor, the wave guide is usable. The introduction method to the reactor may include one or more dielectric material window. At this time, the material of the window includes alumina ($Al_2O_3$), aluminum nitride (AlN), boron nitride (BN), silicon nitride (SIN), silicon carbide (SIC), silicon oxide ($SiO_2$), beryllium oxide (BeO), Teflon, polystyrene or the like with which the loss of the microwave energy is small.

The electric field generated between the electrode 4118 and the cylindrical support 4115 is preferably a DC electric field. In addition, the direction of the electric field is from the electrode 4118 to the cylindrical support 4115. An average of the DC voltage applied to the electrode 4118 for the generation of the electric field is not less than 15 V and not more than 300 V, preferably not less than 30 V and not more than 200 V. The DC voltage wave form is not particularly limited, but various wave forms are usable. In other words, it will suffice if the direction of the voltage does not change with time. For example, a constant voltage (not changing with time), a pulse wave voltage, a rectified voltage or another changing voltage (changing with time) are usable. In addition, an AC voltage application is also effective. Any frequency is usable, but practically it is 50–60 Hz in the case of low frequency, or 13.56 MHz in the case of high frequency. The wave form of the AC voltage may be sine or rectangular form or another form. Practically, sine wave is usable. In any case, the voltage means an effective voltage.

The size and shape of the electrode 4118 may be any if the discharging is not disturbed. Practically however, it is cylindrical member having a diameter of not less than 0.1 cm and not more than 5 cm. At this time, the length of the electrode 4118 is not limited if it is enough to apply uniform electric field to the cylindrical support 4115. The material of the electrode 4118 may be any if it provides the electrically conductive surface. The examples include stainless steel, Al, Cr, Mo, Au, In, Nb, Te, V, Ti, Pt, Pd, Fe or another metal or an alloy thereof, or glass, ceramic or plastic material having a surface treated for the electric conductivity.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic apparatus comprising:

an amorphous silicon electrophotographic photosensitive member having a conductive base, a photoconductive layer thereon and a surface layer thereon, wherein said photoconductive layer contains carbon atoms, a content of which is minimum adjacent a position closest to the surface layer, and the surface layer contains 40–90 atomic % of carbon atoms;

a discharging light source for electric discharge driven through a pulse width modulation using a reference wave having a frequency of not higher than 10 kHz;

charging means for charging said photosensitive member at a position downstream of said light source with respect to a movement direction of said photosensitive member;

means for projecting information light onto said photosensitive member; and at a position downstream of said charging means with respect to the moving direction of said photosensitive member; and driving means for driving said photosensitive member relative to the light source at such a speed that a peripheral speed of said photosensitive member divided by the frequency of the reference wave is not more than 1 mm.

2. An electrophotographic apparatus comprising:

an amorphous silicon electrophotographic photosensitive member having a conductive base, a photoconductive layer thereon and a surface layer thereon, wherein said photoconductive layer contains carbon atoms, a content of which is minimum adjacent a position closest to the surface layer, and the surface layer contains carbon atoms, nitrogen atoms and oxygen atoms, a sum of contents of which is 40–90 atomic %;

a discharging light source for electric discharge driven through a pulse width modulation using a reference wave having a frequency of not higher than 10 kHz;

charging means for charging said photosensitive member at a position downstream of said light source with respect to a movement direction of said photosensitive member;

means for projecting information light onto said photosensitive member at a position downstream of said charging means with respect to the moving direction of said photosensitive member; and driving means for driving said photosensitive member relative to the light source at such a speed that a peripheral speed of said photosensitive member divided by the frequency of the reference wave is not more than 1 mm.

3. An electrophotographic apparatus comprising:

an amorphous silicon electrophotographic photosensitive member having a conductive base, a photoconductive layer thereon and a surface layer thereon, wherein said photoconductive layer contains carbon atoms, a content of which is minimum adjacent a position closest to the surface layer and fluorine atoms, a content of which is maximum adjacent the position closest to the surface layer, and the surface layer contains 40–90 atomic % of carbon atoms;

a discharging light source for electric discharge driven through a pulse width modulation using a reference wave having a frequency of not higher than 10 kHz;

charging means for charging said photosensitive member at a position downstream of said light source with respect to a movement direction of said photosensitive member;

means for projecting information light onto said photosensitive member at a position downstream of said charging means with respect to the moving direction of said photosensitive member; and driving means for driving said photosensitive member relative to the light source at such a speed that a peripheral speed of said photosensitive member divided by the frequency of the reference wave is not more than 1 mm.

4. An electrophotographic apparatus comprising:

an amorphous silicon electrophotographic photosensitive member having a conductive base, a photoconductive layer and a surface layer, wherein the photoconductive layer contains carbon atoms, a content of which is minimum adjacent a position closest to the surface layer and fluorine atoms, a content of which is maximum adjacent a position closest to the surface layer, and the surface layer contains carbon atoms; nitrogen atoms and oxygen atoms, a sum of contents of which is 40–90% atomic %;

a discharging light source for electric discharge driven through a pulse width modulation using a reference wave having a frequency of not higher than 10 kHz;

charging means for charging said photosensitive member at a position downstream of said light source with respect to a movement direction of said photosensitive member;

means for projecting information light onto said photosensitive member at a position downstream of said charging means with respect to the moving direction of said photosensitive member; and driving means for driving said photosensitive member relative to the light source at such a speed that a peripheral speed of said photosensitive member divided by the frequency of the reference wave is not more than 1 mm.

5. An electrophotographic apparatus comprising:

an amorphous silicon electrophotographic photosensitive member having a conductive base, a photoconductive layer and a surface layer, the photoconductive layer contains carbon atoms, a content of which is minimum adjacent a position closest to the surface layer and 10–5000 atomic ppm of oxygen atoms, the surface layer contains carbon atoms, nitrogen atoms and oxygen atoms, a sum of contents of which is 40–90 atomic %;

a discharging light source for electric discharge driven through a pulse width modulation using a reference wave having a frequency of not higher than 10 kHz;

charging means for charging said photosensitive member at a position downstream of said light source with respect to a movement direction of said photosensitive member;

means for projecting information light onto said photosensitive member at a position downstream of said charging means with respect to the moving direction of said photosensitive member; and driving means for driving said photosensitive member relative to the light source at such a speed that a peripheral speed of said photosensitive member divided by the frequency of the reference wave is not more than 1 mm.

6. An electrophotographic apparatus comprising:

an amorphous silicon electrophotographic photosensitive member having a conductive base, a photoconductive layer and a surface layer, wherein the photoconductive layer contains carbon atoms, a content of which is minimum adjacent a position closest to the surface layer, 10–5000 atomic ppm of oxygen atoms and fluorine atoms, a content of which is maximum adjacent a position closest to the surface layer, and the surface layer contains carbon atoms, nitrogen atoms and oxygen atoms, a sum of contents of which is 40–90% atomic %;

a discharging light source for electric discharge driven through a pulse width modulation using a reference wave having a frequency of not higher than 10 kHz;

charging means for charging said photosensitive member at a position downstream of said light source with respect to a movement direction of said photosensitive member;

means for projecting information light onto said photosensitive member at a position downstream of said charging means with respect to the moving direction of said photosensitive member; and driving means for driving said photosensitive member relative to the light source at such a speed that a peripheral speed of said photosensitive member divided by the frequency of the reference wave is not more than 1 mm.

* * * * *